US012257469B2

(12) United States Patent
Rose

(10) Patent No.: US 12,257,469 B2
(45) Date of Patent: Mar. 25, 2025

(54) SHOULDER EXERCISE MACHINE

(71) Applicant: Greg Rose, Littleton, CO (US)

(72) Inventor: Greg Rose, Littleton, CO (US)

( * ) Notice: Subject to any disclaimer, the term of this patent is extended or adjusted under 35 U.S.C. 154(b) by 398 days.

(21) Appl. No.: 17/825,991

(22) Filed: May 26, 2022

(65) Prior Publication Data

US 2023/0381570 A1 Nov. 30, 2023

(51) Int. Cl.

| | |
|---|---|
| ***A63B 21/062*** | (2006.01) |
| ***A63B 21/00*** | (2006.01) |
| ***A63B 23/02*** | (2006.01) |
| ***A63B 23/12*** | (2006.01) |

(52) U.S. Cl.

CPC ..... *A63B 21/063* (2015.10); *A63B 21/152* (2013.01); *A63B 21/154* (2013.01); *A63B 21/4005* (2015.10); *A63B 21/4035* (2015.10); *A63B 23/02* (2013.01); *A63B 23/1245* (2013.01); *A63B 23/1263* (2013.01); *A63B 23/129* (2013.01)

(58) Field of Classification Search

CPC . A63B 21/063; A63B 21/4035; A63B 21/152; A63B 21/154; A63B 23/1245; A63B 23/1263; A63B 23/129

See application file for complete search history.

(56) References Cited

U.S. PATENT DOCUMENTS

| | | | | |
|---|---|---|---|---|
| 4,907,795 A * | 3/1990 | Shaw | ..... | G16H 40/67 482/901 |
| 2009/0075791 A1* | 3/2009 | Kissel | ..... | A63B 21/155 482/93 |
| 2011/0251021 A1* | 10/2011 | Zavadsky | ..... | A63F 13/28 482/5 |
| 2023/0310932 A1* | 10/2023 | Rose | ..... | A63B 21/0628 482/102 |

FOREIGN PATENT DOCUMENTS

| | | | |
|---|---|---|---|
| CN | 109350925 A | * | 2/2019 |
| DE | 102020126469 A1 | * | 4/2022 |

* cited by examiner

*Primary Examiner* — Sundhara M Ganesan
*Assistant Examiner* — Jacqueline N L Loberiza
(74) *Attorney, Agent, or Firm* — Braxton Perrone, PLLC; Gregory Perrone; Bobby W. Braxton

(57) ABSTRACT

A weight resistance exercise apparatus for the external and internal muscles of the shoulder having a multiple plane unit with a rotating axis armature for exercise in intervening planes, a primary armature, a secondary armature connected at a proximate end to the primary armature and a plurality of mode selection disks disposed on the secondary armature.

10 Claims, 53 Drawing Sheets

SHOULDER EXERCISE MACHINE

INCORPORATION BY REFERENCE

U.S. patent application Ser. No. 17/714,033, filed Apr. 5, 2002, by the same inventor here, is incorporated herein by reference in its entirety.

FIELD OF THE DISCLOSURE

The claimed subject matter relates to a weight resistance exercise method and apparatus for the external and internal muscles of the shoulder. Specifically, the apparatus and methods disclosed expand the usual approach to exercise of the external muscles of the shoulder (traditionally requiring a total of six machines to cover the three, major orthogonal planes) to a multiple plane unit using a rotating axis armature allowing the six machines to be effectively contained in one machine, additionally allowing exercise in intervening planes. The apparatus and methods described herein also allow exercise of the internal muscles of the shoulder (supraspinatus, infraspinatus, subscapularis, and teres minor) and external muscles.

BACKGROUND

Strength of the shoulder joint in athletics is crucial. Numerous sources support the importance of resistance exercise in building muscle and maintaining flexibility. While almost all sports performance improves with shoulder strength, activities of everyday life also require shoulder strength. The external muscles provide power and the internal muscles (rotator cuff) provide stability. Flexion and extension of the external muscles move the humerus in a plane while the internal muscles rotate the humerus about its long axis.

Before Universal exercise weight machines of the 70's, most weight training exercise was performed with dumbbells, barbells, and pulleys. The workouts were tedious as much time was spent changing the weights rather than exercising the muscles of interest. Later, Universal machines allowed quick weight resistance selection removing the time spent getting plates, adding them to barbells, and putting them back. Most of these exercises were compound exercises meaning they worked multiple muscle groups at the same time instead of focusing on a particular muscle group. There are pros and cons to compound exercises. Maximal muscle building is achieved when the athlete exercises a particular muscle or muscle group to muscular failure. This is challenged in performing compound exercises. For example, the bench press, an exercise meant to focus on the pectoralis muscles, additionally exercises the deltoids and triceps muscles (and others to a lesser degree). If the athlete wishes to maximally fatigue the pectoralis muscle, other recruited muscles need to remain stronger than the pectoralis muscle to allow the pectoralis muscle to exercise to failure. While compound exercises can be performed using the cable system, the presently described exercise apparatus additionally enables isolated exercise, allowing the athlete to exercise the muscle of interest to failure. Eventually, "dual" machines were created to allow the athlete to exercise opposite aspects of the shoulder allowing pushing and pulling of the handles. However, this is usually in one fixed plane. This cut the footprint of the shoulder machines in half but the result were three dual machines instead of one, while neglecting of all the planes in between.

SUMMARY OF THE DISCLOSURE

According to an embodiment of the exercise apparatus of the present disclosure, referred commercially from time to time herein as "Axis," the apparatus works with the natural axes of motion when exercising the external muscles. To the left and right of the user, an upper, posterior supporting structure holds a main armature that extends to a position perpendicular to the given axis of the shoulder. From this main armature, a secondary armature rotates about the axis from the end of the primary armature. The main armature rotates about the supporting structure with its end subtending a circle at its end. To be perpendicular to the shoulder at the three critical locations, the axis of the supporting structure points at the given shoulder along a (1,1,1) direction based on an X, Y, Z plane. Through this configuration and positioning, not only does the armature allow perpendicular positioning in the three critical planes but also a limitless number of other points limited only by the number of stop points created on the supporting structure.

In another embodiment, the "Atlas" machine builds on the structure and function of the Axis machine. Atlas performs all the functions of the Axis machine but with some added functionality and therefore added design features. Atlas allows separate or simultaneous exercise of the rotator cuff (internal) muscles by incorporating a pulley system in the secondary armature. Atlas incorporates the same (1,1,1) direction axis rotation but originates inferiorly rather than superiorly to allow internal and external rotation of the armature in exercising the infraspinatus and subscapularis muscles. Atlas allows a separate resistance and therefore separate weight stack for rotator cuff resistance. With this additional weight stack, an additional weight assist pedal is added to help lift the weight stack for the rotator cuff exercises (in addition to a weight assist pedal for the external muscle weight stack). As there are two parallel cable systems with armature rotation 360 degrees about the (1,1,1) axis, the cables twist on each other. This necessitated the creation of a mechanism to keep the cable from twisting as the main armature rotated about the (1,1,1) axis.

BRIEF DESCRIPTION OF THE DRAWINGS

The novel features believed characteristic of the invention are set forth in the appended claims. The invention itself, however, as well as a preferred mode of use, further objectives, and advantages thereof, will be best understood by reference to the following detailed description of illustrative embodiments when read in conjunction with the accompanying drawings, wherein:

DETAILED DESCRIPTIONS OF THE DRAWINGS

Before undertaking the detailed description below, it may be advantageous to set forth definitions of certain words and phrases used in connection to the disclosed exemplary embodiments: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although the subject matter of this application has been described with reference to illustrative embodiments, this description is not intended to be construed in a limiting sense. Various modifications and combinations of the illustrative embodiments as well as other embodiments will be apparent to persons skilled in the art upon reference to the description. It is, therefore, intended that the appended claims encompass any such modifications or embodiments. The general processes and systems described herein may be modified heavily depending on several factors, with rearrangement and/or addition/deletion of steps anticipated by the scope of the present disclosure. Integration of this and other preferred exemplary embodiment methods in conjunction with a variety of preferred exemplary embodiment apparatus or systems described herein is anticipated by the overall scope of the presently disclosed apparatus, method and/or system.

The presently described exercise apparatus is effectively discussed and described in two parts. First, the aspects of the presently described apparatus that in the embodiments provides isolated exercise of the external muscles of the shoulder in multiple planes, also referred to as "Axis", are described first. Then, with the first aspect serving as the foundation, the aspects of the presently described apparatus that additionally allows exercise of the rotator cuff muscles (internal muscles), referred to as "Atlas", are described second.

External Shoulder Exercise Apparatus ("Axis")

Figure 1:
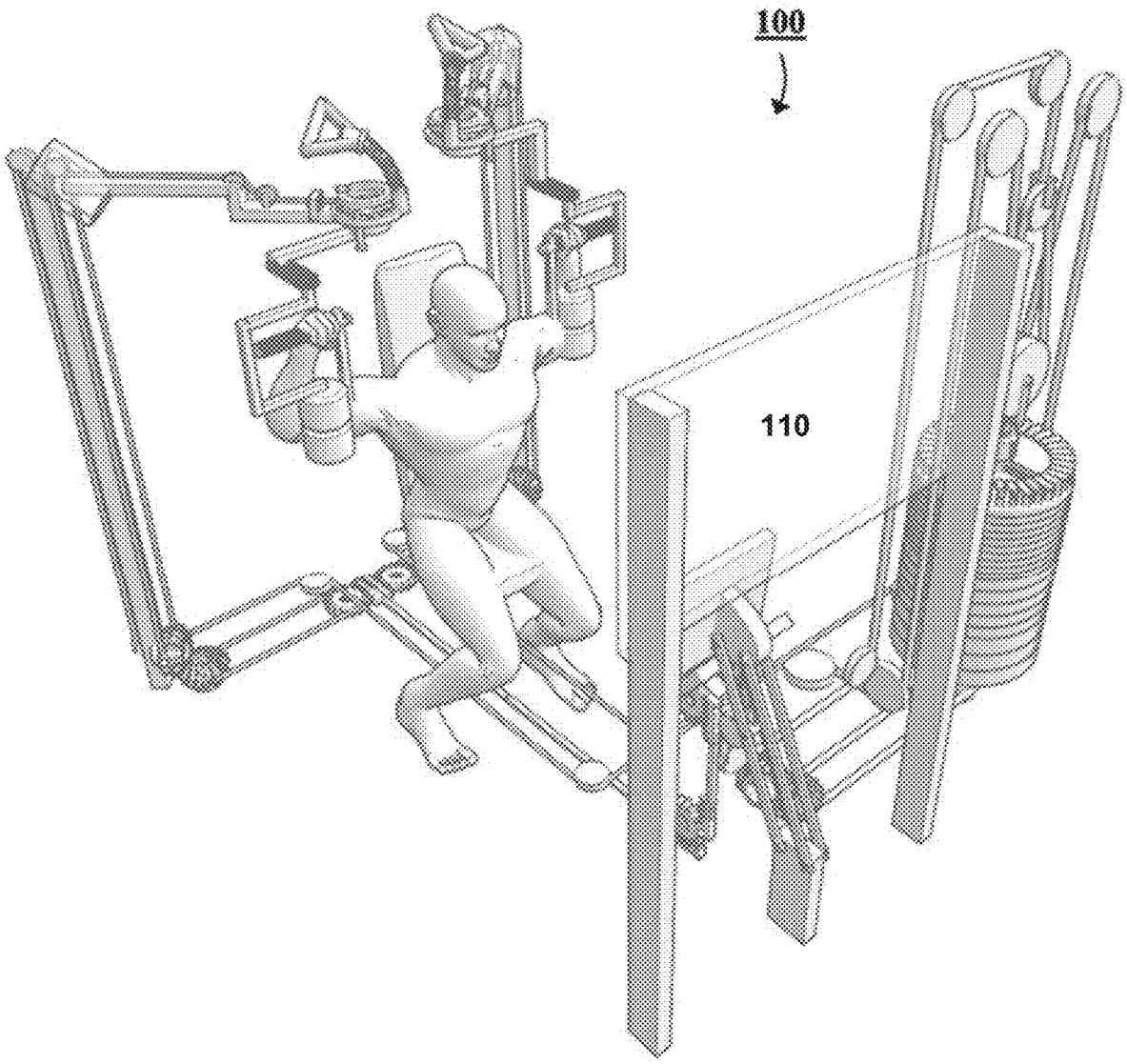
FIG. 1 is a perspective views of the external shoulder exercise apparatus according to the embodiments.
Figure 2:
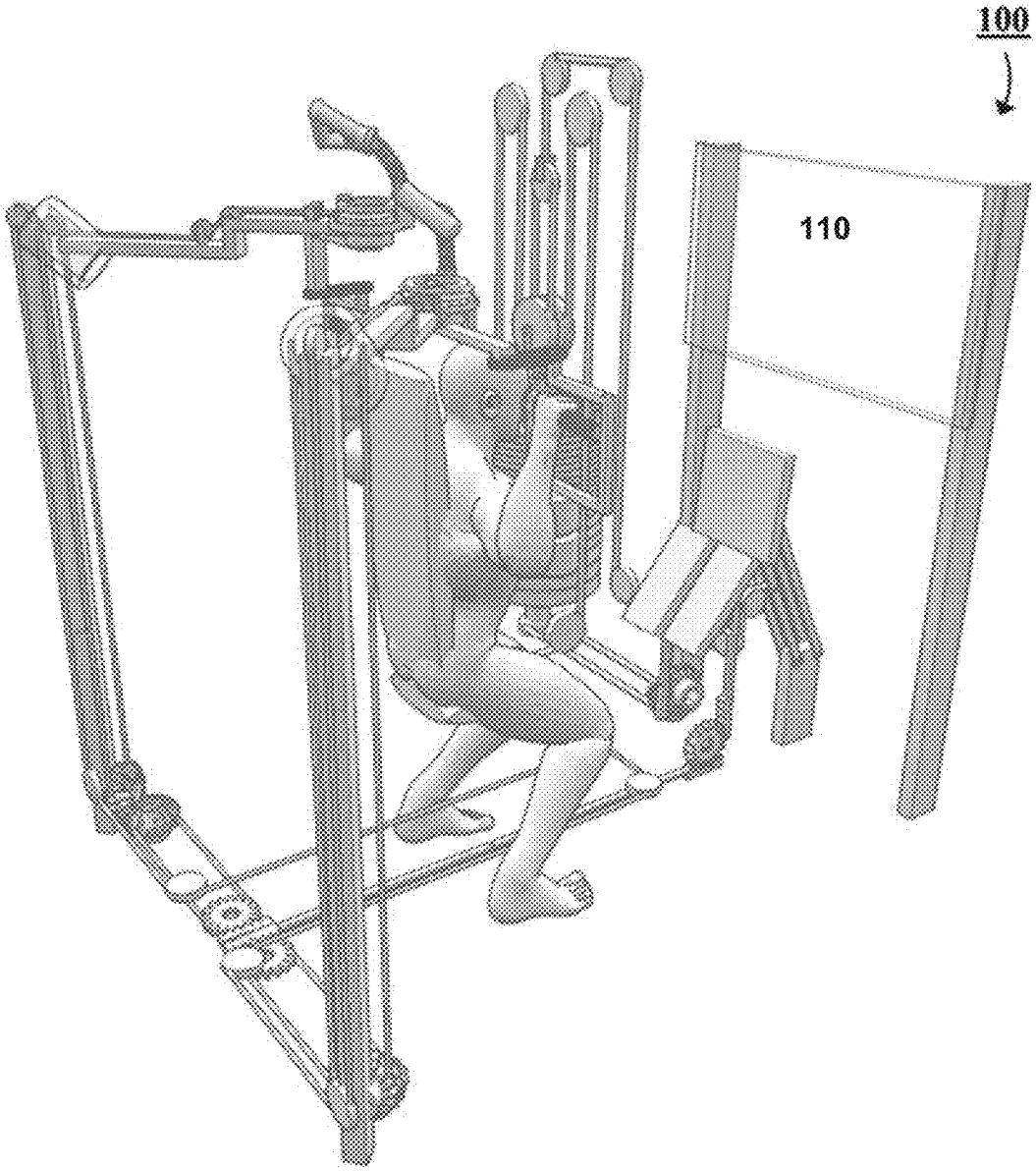
FIG. 2 is a perspective views of the external shoulder exercise apparatus according to the embodiments.
Figure 3:
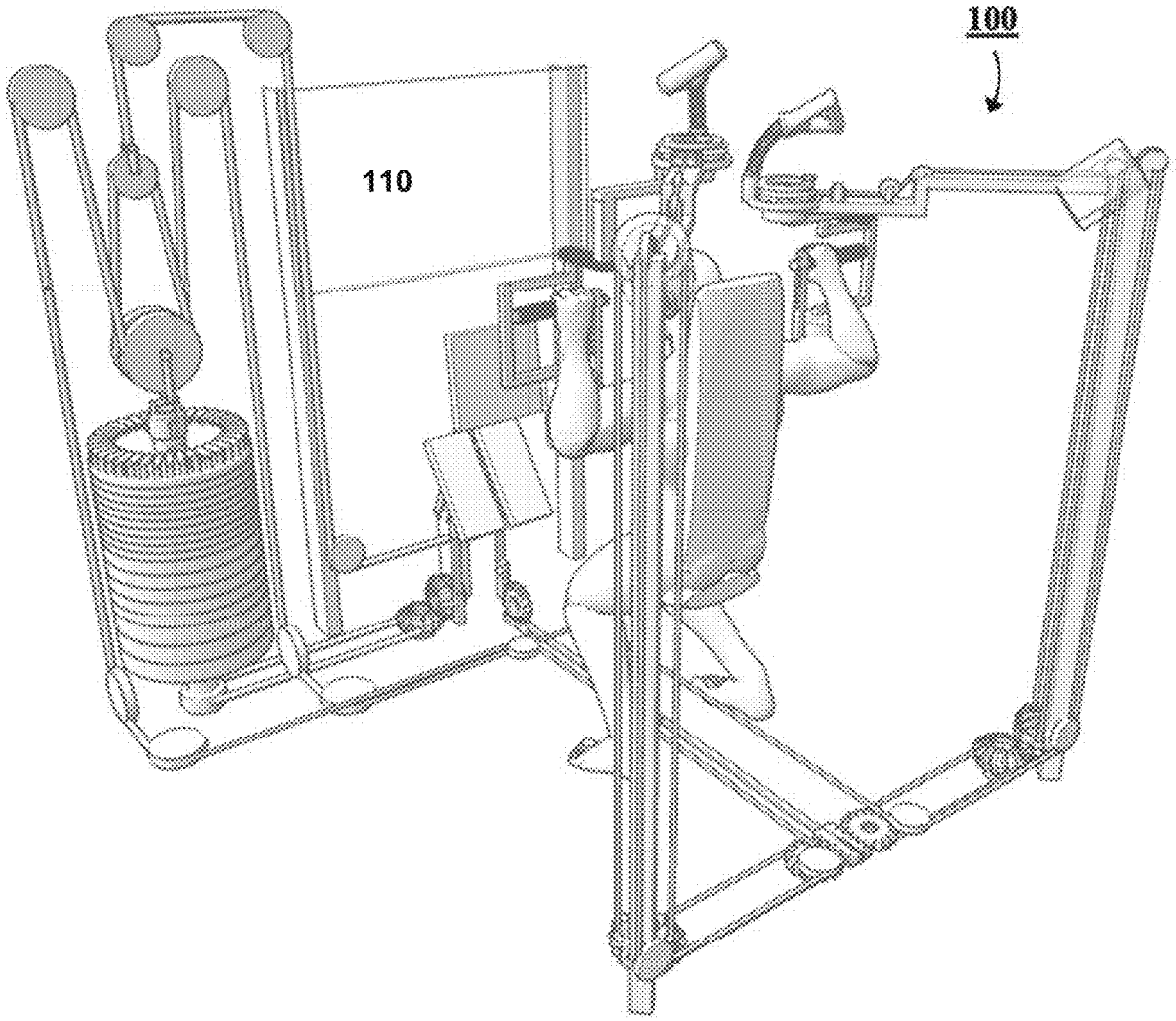
FIG. 3 is a perspective views of the external shoulder exercise apparatus according to the embodiments.
Figure 4:
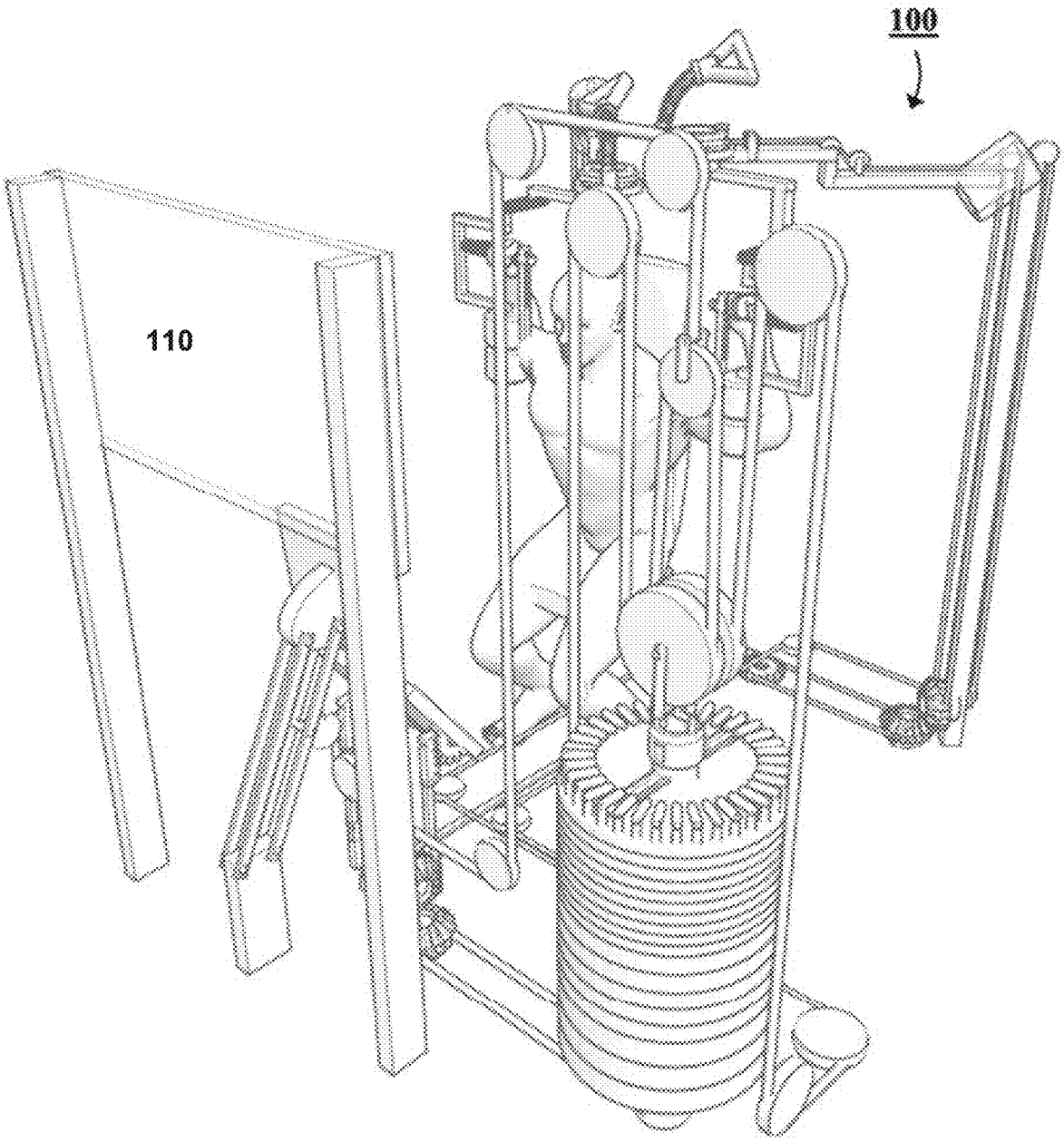
FIG. 4 is a perspective views of the external shoulder exercise apparatus according to the embodiments.
Figure 5:
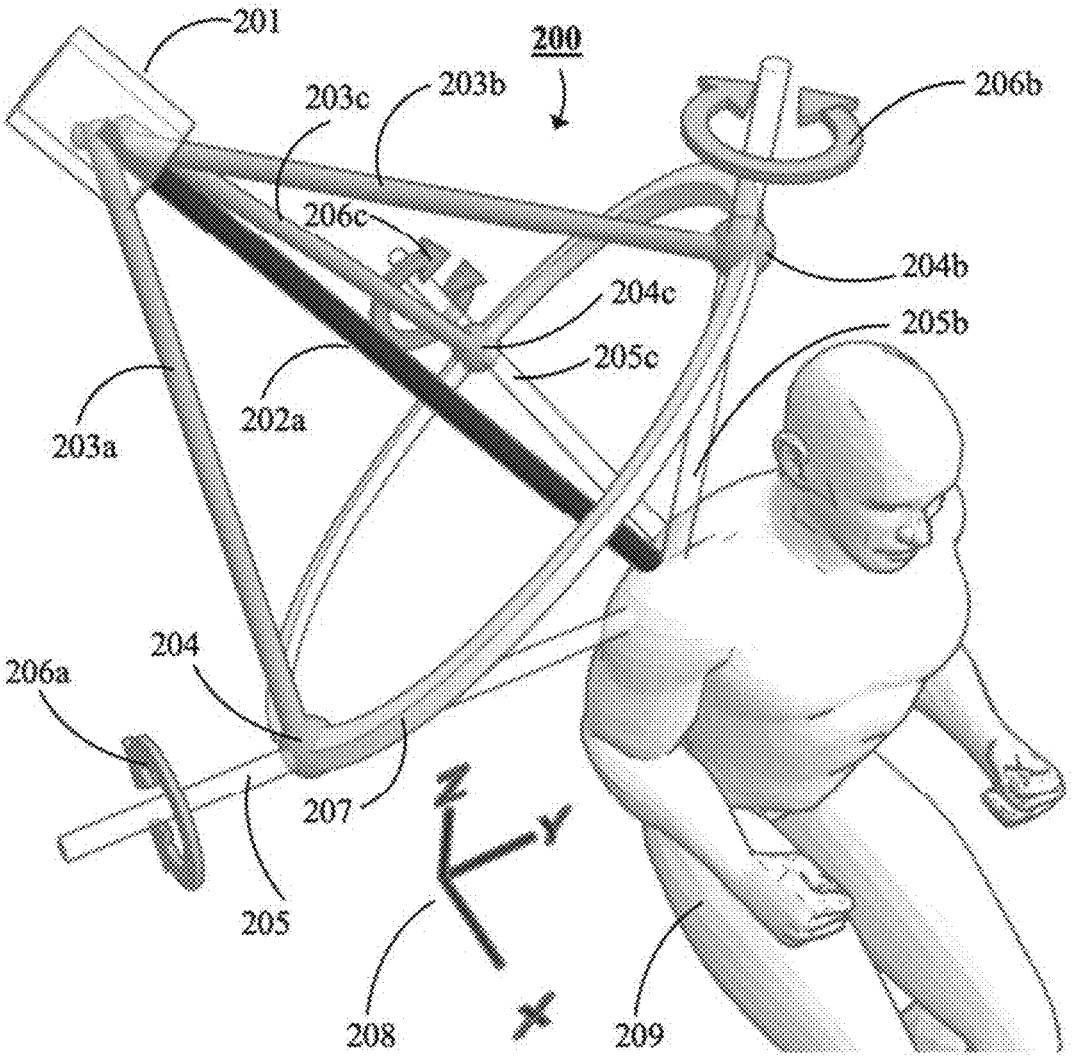
FIG. 5 is a conceptual diagram illustrating the fundamental operating principle according to the embodiments.

FIGS. 1-4 depict various perspective views of the Axis apparatus 100 with a seated user according to the embodiments of the present invention. A detailed view depicting conceptually the ranges of motion and rotation and fundamental principle of external shoulder exercise apparatus 200 is provided in FIG. 5.

A rotating, posterior, armature hub 201, is connected to a right main armature 203 that rotates about an imaginary axis 202. Geometrically, imaginary axis 202*a* points along the vector direction (1,1,1) on the x,y,z coordinates from armature hub 201 to the user's shoulder.

A distal end of right main armature 203 is connected to right armature hub 201*a* and to right secondary armature 205 at an approximate end, with right secondary armature 205 rotating about an axis perpendicular to right main armature 203. Right armature hub 201*a* rotates continuously 360 degrees. Three distinct positions 203*a*, 203*b*, and 203*c* of right main armature 203 are achieved through right armature hub 201*a* rotation. These three positions 203*a*, 203*b* and 203*c* of right main armature 203 allow exercise of the shoulder in the three traditional planes.

When right main armature 203 is positioned as shown, right secondary armature 205 rotates in either direction as shown by y-axis rotational arrows 206*a* about the Y-axis. With forward motion, the anterior deltoid and lower pectoralis of user 209 are exercised; with reverse motion, the posterior deltoid and latissimus dorsi are exercised.

When right main armature 203 is in position 203*b*, right secondary armature 205 in position 205*b* rotates in either direction as shown by z-axis rotational arrow 206*b*. With forward motion, the mid pectoralis and anterior deltoid of user 209 are exercised; with reverse motion, the posterior deltoid and rhomboid are exercised.

When right main armature 203 is in position 203*c*, right secondary armature 205 in position 205*c* rotates in either direction as shown by x-axis rotational arrow 206*c*. With abduction, the lateral deltoid and trapezius of user 209 are exercised; with adduction, the latissimus dorsi, serratus anterior, and rhomboid are exercised.

Right main armature 203 also rotates along any position on right imaginary ring 207. Right main armature 203, for the right-hand right armature hub 201 intersects right imaginary ring 207 at joints 204.

Positioned at the front of a user position, in one embodiment, is video monitor that is connected electronically to external shoulder exercise apparatus 100. Through a monitor the user is able to view a variety of displayed information such as repetitions, weight, exercise type, resting period, vital signs, scenery traveled through, game interface, virtual instructor, television programming movies, streaming entertainment, exercise dynamics (weights, repetitions, rest time, total exercise time, vitals), training, interactive games, and team competitions.

Figure 6A:
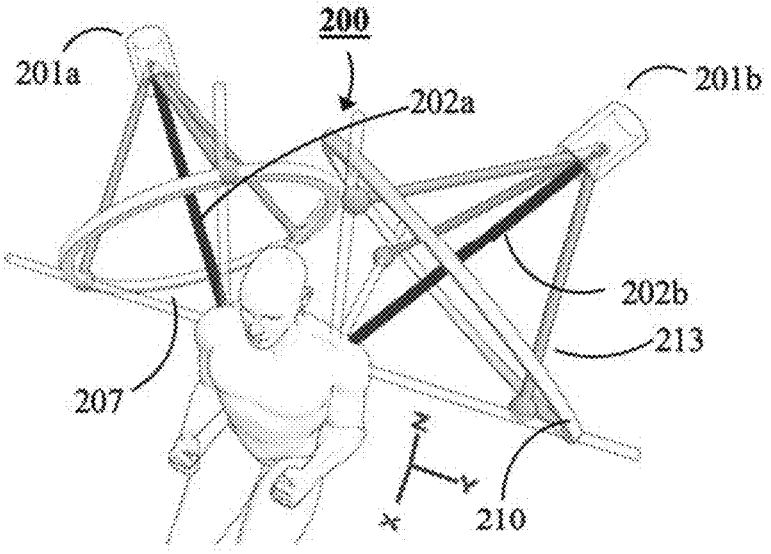
FIG. 6*a* is a conceptual diagram illustrating the fundamental operating principle according to the embodiments.

FIG. 6*a* is a conceptual diagram showing motion of the left side armature hub 201*b*. Of note is that left imaginary ring 210 is intentionally of a larger diameter than right imaginary ring 207 so that it and right imaginary ring 207 keep right main armature 203 and left main armature 213 from colliding or "intersecting" when posterior to the user. Further, right main armature 203 and left main armature 213 are angled to keep them from colliding.

Figure 6B:
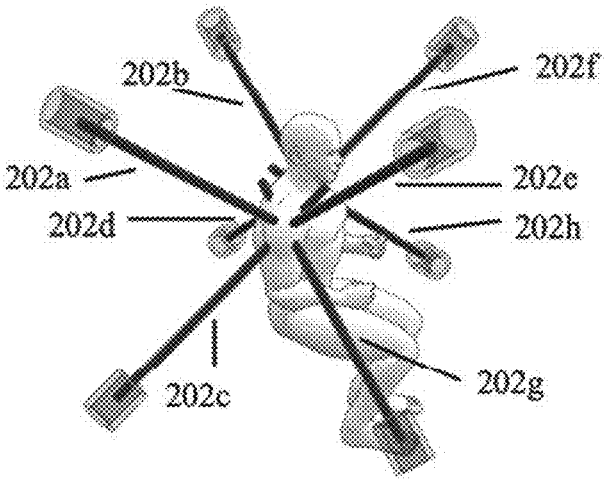
FIG. 6*b* is a conceptual diagram illustrating the fundamental operating principle according to the embodiments.

FIG. 6*b* is a similar conceptual diagram that provides an oblique, schematic view of how central axis 202 may originate from the upper posterior direction (axes 202*a*/202*b*) as in the Axis machine or lower posterior (axes 202*c*/202*d*) in the Atlas machine, but in other embodiments, the central axis could originate from any of the four paired directions shown for either machine including paired axes 202*e*/202*f*, and 202*g*/202*h*.

Figure 7:
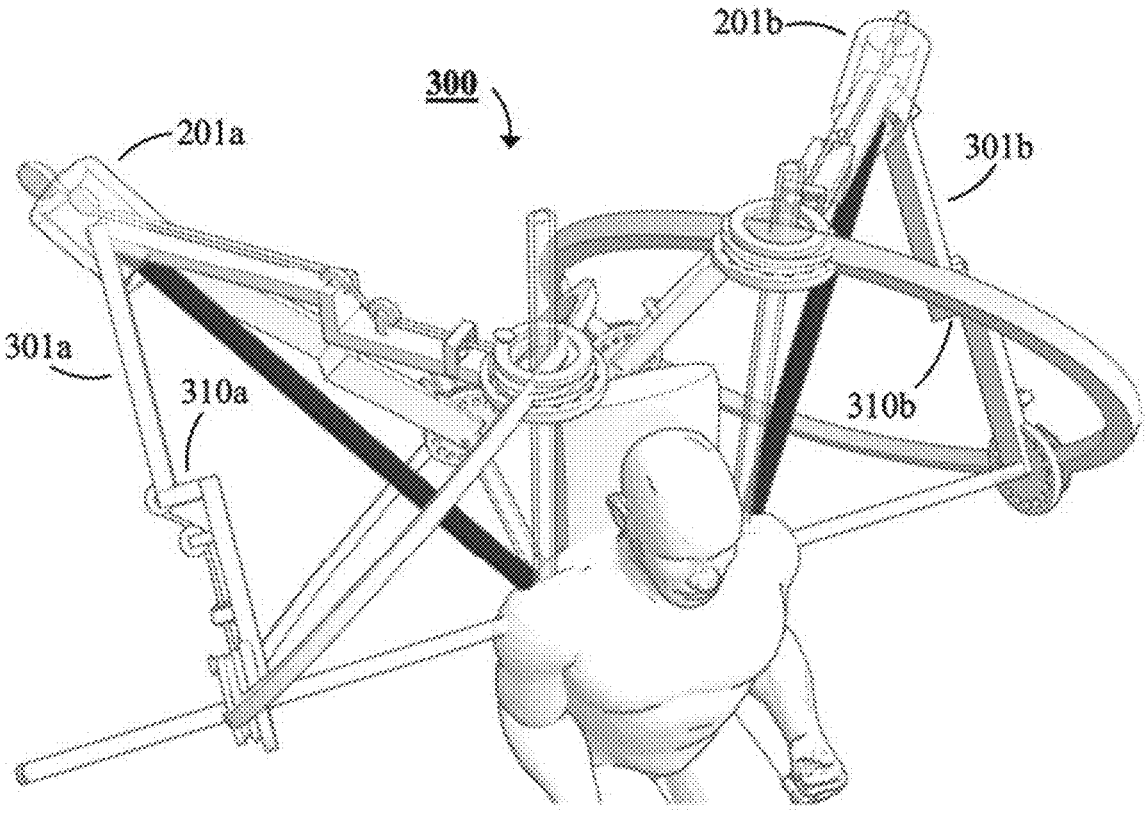
FIG. 7 is a partially is a conceptual diagram illustrating the fundamental operating principle according to the embodiments.

FIG. 7 is a partially conceptual diagram of the Axis apparatus 200. In the Axis apparatus, schematic main armatures 203 in the previous figures are replaced by with detailed main armatures 301*a* and 301*b*. Note that an opposite direction step offs 310*a* and 310*b* in main armatures 301*a* and 301*b*, respectively, adjusts the position of the distal ends of the main armatures so they do not collide posteriorly. Main armatures 301*a* and 301*b* are connected to associated armature hubs 201*a* and 201*b*.

Figure 8:
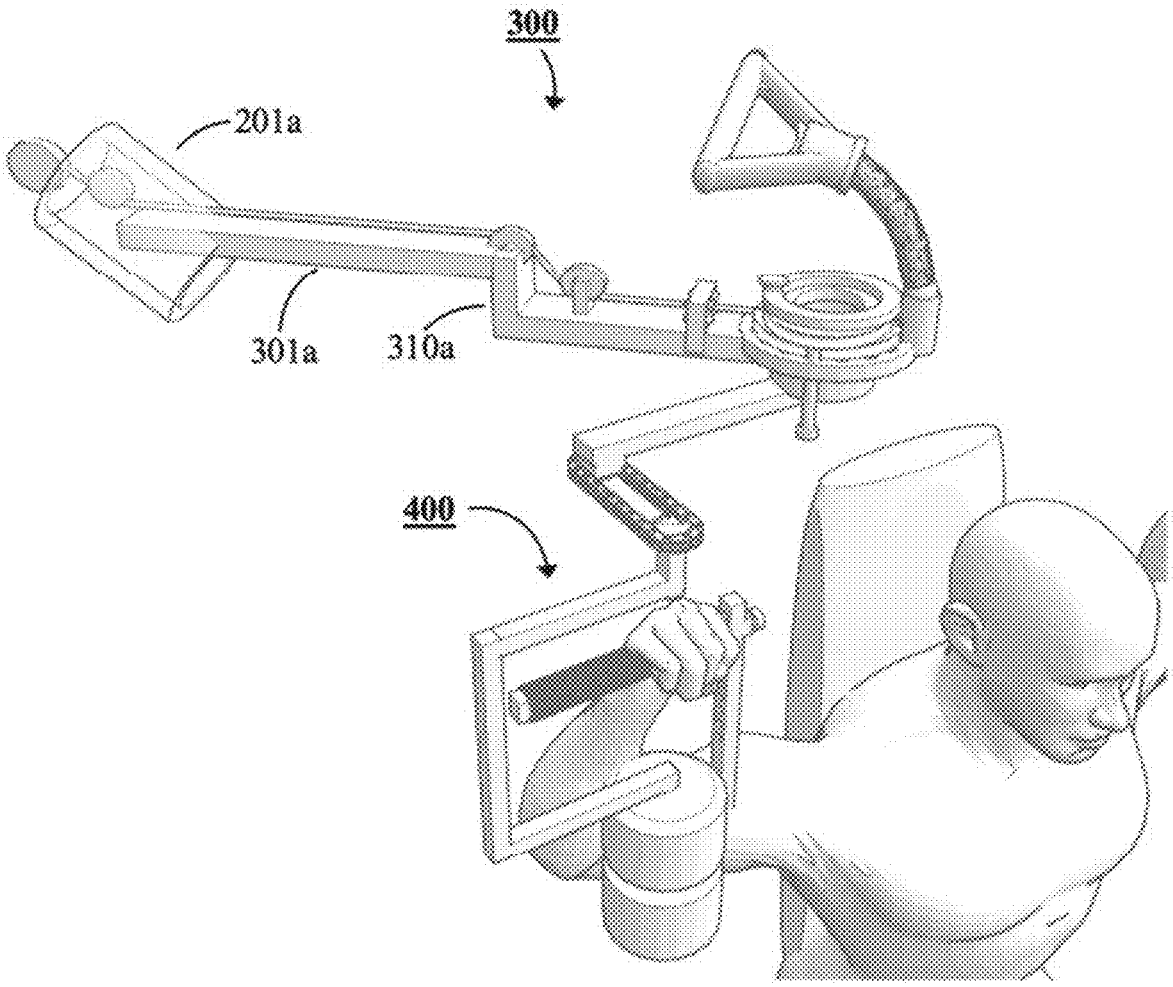
FIG. 8 is a perspective view of a main armature and secondary armature according to an embodiment.

FIG. 8 is a diagram depicting Axis 300, having main armature 301*a* attached to secondary armature 490*a*. Main armature 301*a* includes oppositive direction step off 310*a*.

Figure 9:
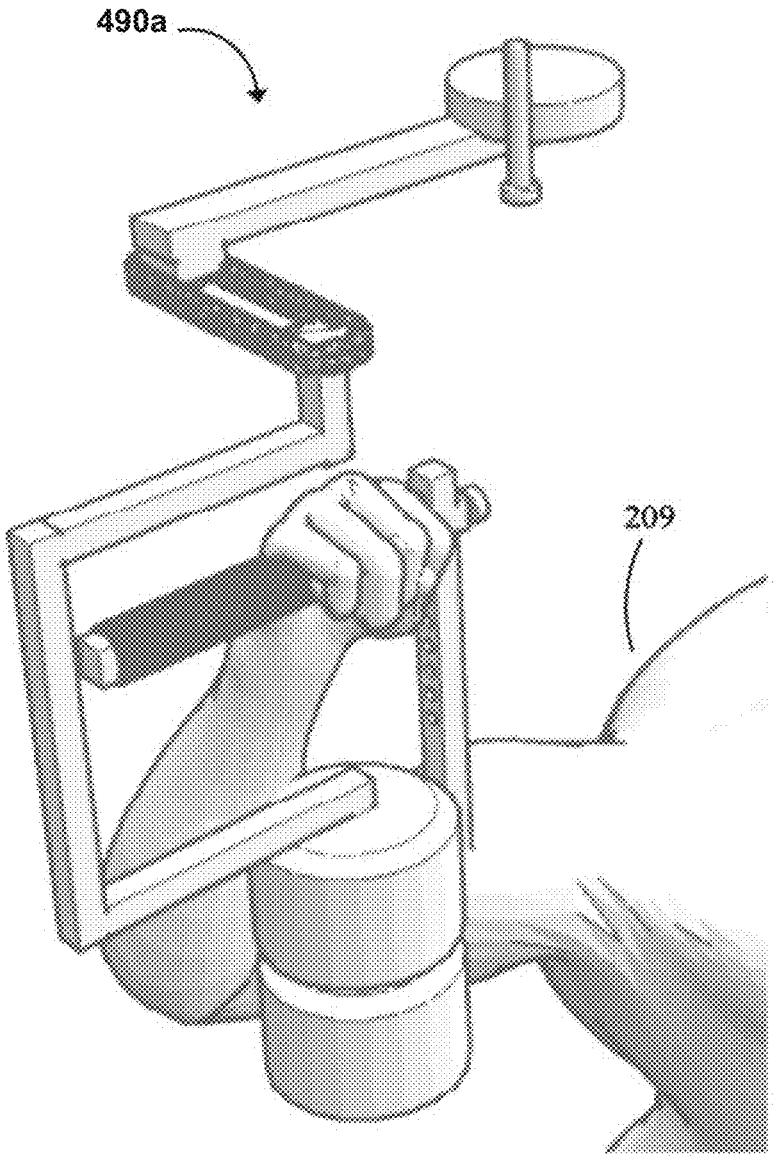
FIG. 9 is a is a perspective view of a secondary armature and secondary armature according to an embodiment.

FIG. 9 is a focused view of secondary armature 490*a* as employed by user 209.

Figure 10:
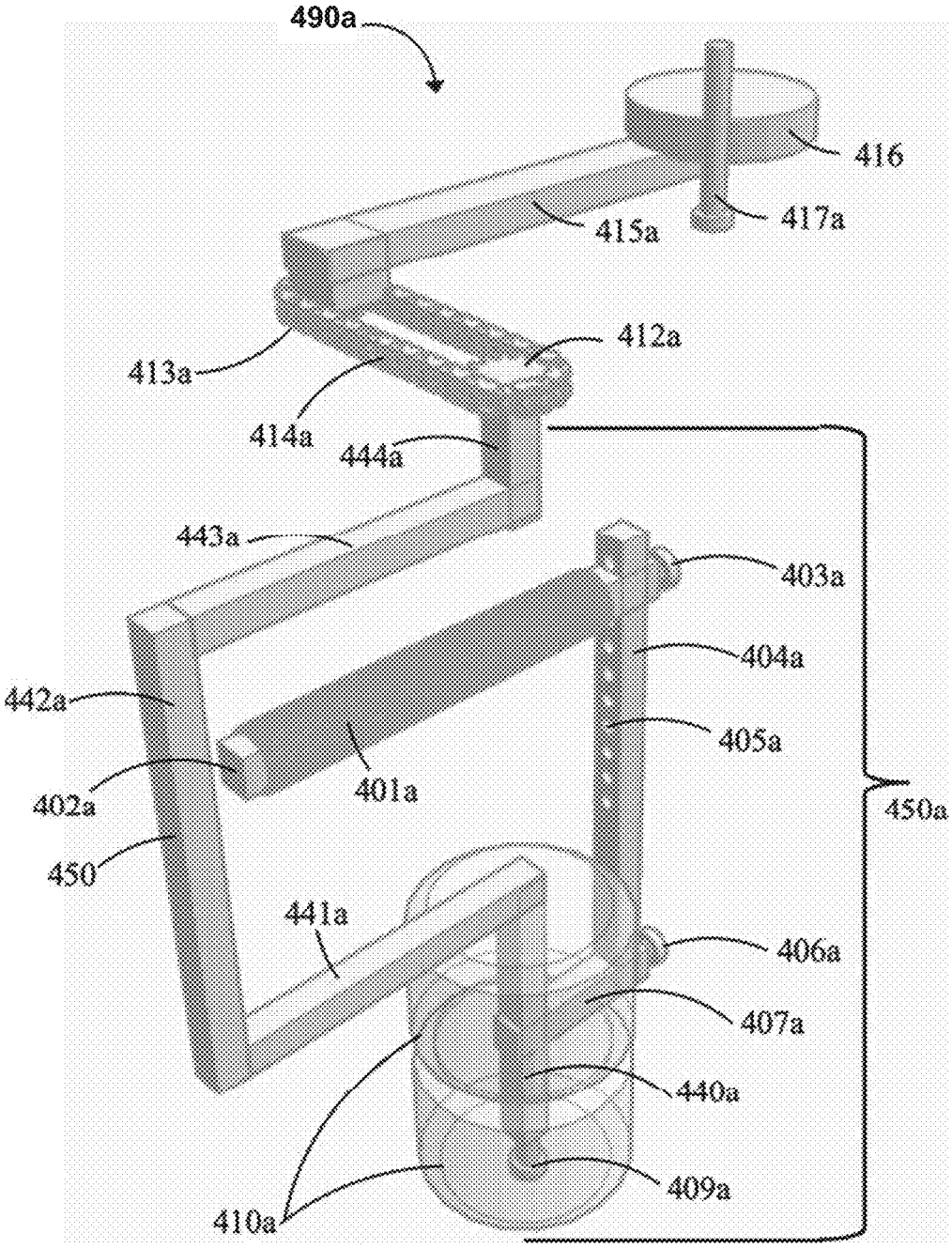
FIG. 10 is a perspective view of a secondary armature according to an embodiment.

FIG. 10 is a detailed view of secondary armature 490*a* of Axis apparatus 300. The components of secondary armature 490*a* will be described starting with where user 209 holds hand grips and then serially progress throughout secondary armature 490*a*.

Figure 11:
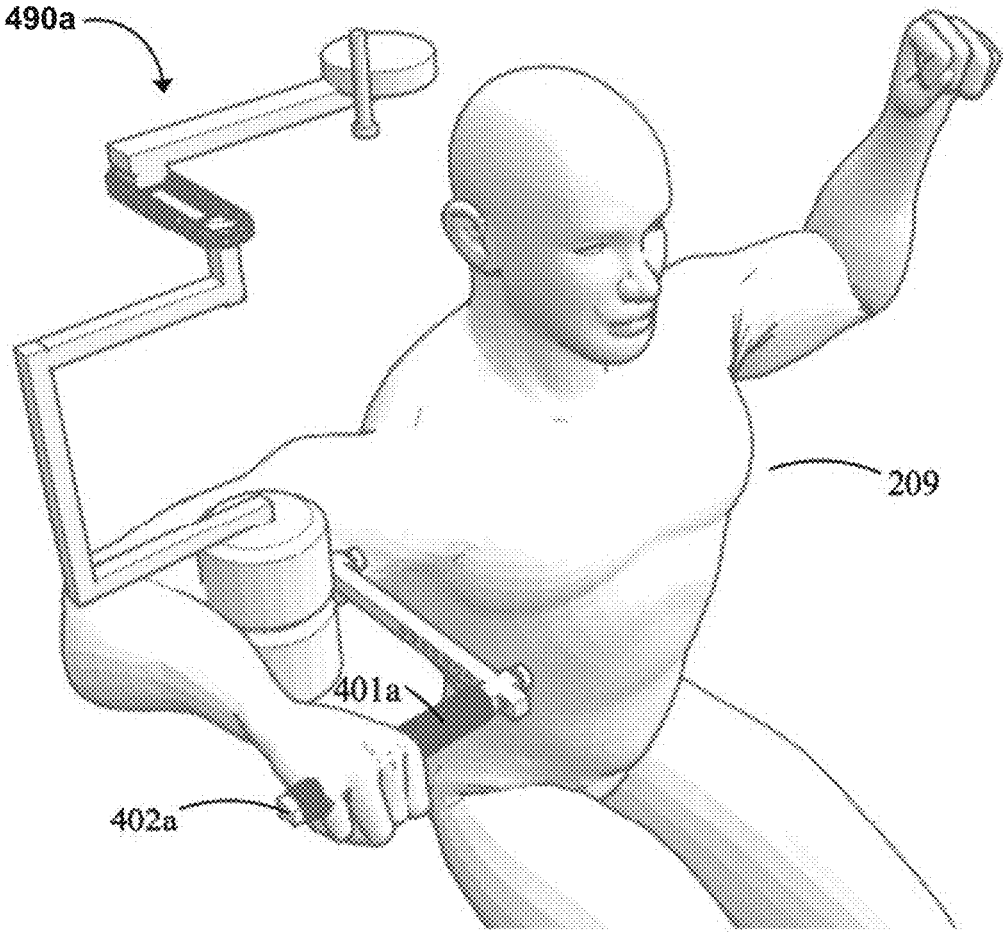
FIG. 11 is a perspective view of an alternate position of a handgrip of a secondary armature according to an embodiment.

As shown in detail in FIG. 10, user 209 holds hand grip 401*a* (as shown in FIG. 9). Hand grip 401*a* is formed of soft material such as rubber or other suitable material that provides comfort as well as a suitable grip for the user. Hand grip 401*a* wraps around handle 402*a*. Handle 402*a* takes the shape of a solid or hollow cylindrical rectangle, circle or oval. Handle 402*a* connects to vertical pipe 404*a*, which in one embodiment is perforated with holes 405*a* permitting adjustment by the user of the location of handle 402*a* to accommodate users of different sizes and heights. Attached at the end of handle 402*a* is handle set pin 403*a*, which allows securing handle 402 within multiple holes 405*a* to set handle 402*a* at the desired height. First vertical pipe 404*a* pipe connects to first horizontal pipe 407*a* with first set pin, 406*a*. First set pin 406*a* allows setting multiple positions of first vertical pipe 404*a* rotated about first set pin 406*a*, including 90 degrees as shown in FIG. 11.

Continuing with FIG. 10, lower set pin 409*a* allows roller pads 410*a* (shown transparently for illustrative purposes) to remain fixed or rotate. Roller pads serve to prevent injury of the user's arms and prevent direct contact to the frame of secondary armature. Extending upward from lower set pin 409*a* and through roller pads 410*a* are first frame pipe 440*a*, second frame pipe 441*a*, third frame pipe 442*a*, fourth frame pipe 443*a* and fifth frame pipe 444*a*. These five pipes, as shown, are rectangular cylindrical in shape in one embodiment but in others can be oval, circular or other suitable shape. The five pipes 440*a*, 441*a*, 442*a*, 443*a* and 444*a* are connected to one another at right angles to form a frame connected to form frame 450 that largely houses handle 402 and supports upper components of secondary armature 490*a* as will be described. Continuing with FIG. 10, in order to accommodate varying shoulder widths of users, the lower portion 450*a* of secondary armature 400*a* rotates about the distal end of bar 415*a* via associated chain 414 and sprockets 412 and 413 (obscured). Fifth bar 444*a* is attached to sprocket 412 enabling rotation of lower portion 450*a* of secondary armature 400*a*. This arrangement allows lower portion 450*a* of secondary armature 404*a* to remain parallel to bar 415*a* regardless of shoulder separation distance. Bar

415*a* attaches to lower disk 416*a* that connects to main armature 301*a*. Top pin 417 passes through corresponding openings in bar 415*a* and disk 416*a* and acts as the start point of rotation of secondary armature 301*a*.

Continuing with FIG. 10, in order to accommodate varying shoulder widths of users, the lower portion 450*a* of secondary armature 490*a* rotates about the distal end of bar 415*a* via associated chain 414 and sprockets 412 and 413 (obscured). Fifth bar 444*a* is attached to sprocket 412 enabling rotation of lower portion 450*a* of secondary armature 400*a*.

This arrangement allows lower portion 450*a* of secondary armature 404*a* to remain parallel to bar 415*a* regardless of shoulder separation distance. Bar 415*a* attaches to lower disk 416*a* that connects to main armature 301*a*. Top pin 417 passes through corresponding openings in bar 415*a* and disk 416*a* and acts as the start point of rotation of secondary armature 301*a*.

FIG. 11 depicts secondary armature 401*a* equipped with handle 402*a* and hand grip 401*a* in an alternate position, angled at 90 degrees anteriorly in relation to the view of FIG. 10. Note that in this position, user's 209 upper arm instead of the elbow pushes on roller pads 410*a*.

Figure 12:
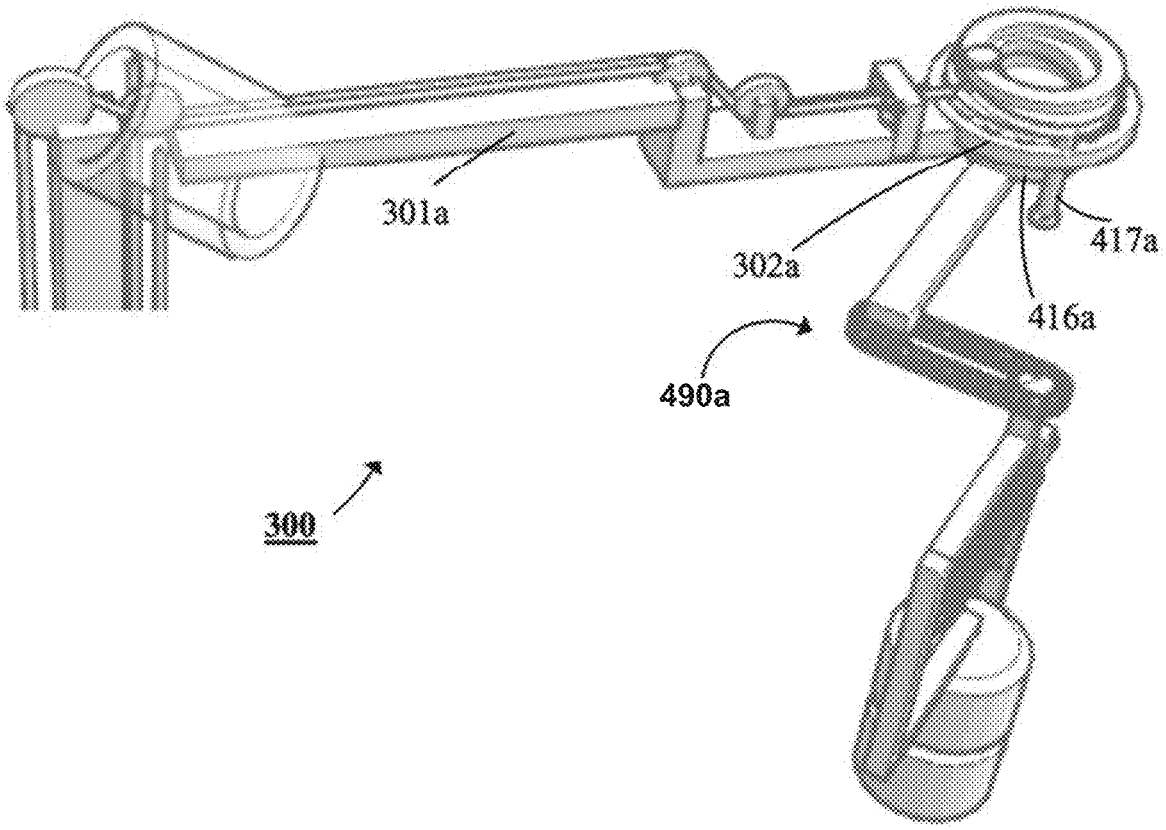
FIG. 12 is a perspective view of an attachment of secondary and main armatures according to an embodiment.

FIG. 12 is a diagram showing the attachment of the secondary and main armatures. Secondary armature, 490*a*, connects to main armature, 300, with disk 416*a*. Pin 417*a* fits into set disk, 302*a*, to set a start position of rotation of the secondary armature.

Figure 13:
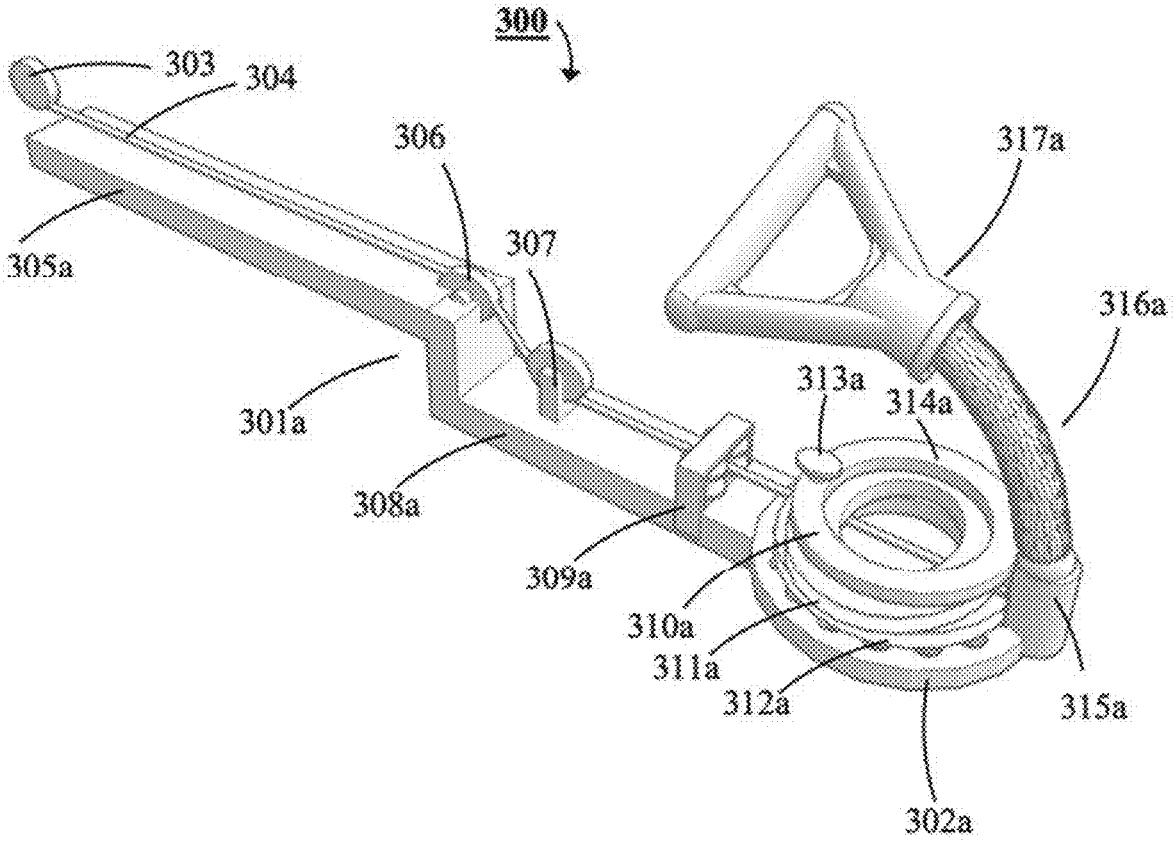
FIG. 13 is a perspective view of a main armature according to an embodiment.

FIG. 13 is a diagram of the Axis apparatus 300 showing detail and embodiment of main armature 301*a* connected to secondary armature 490*a*. In one embodiment, secondary armature 401*a* connects to main armature at disk 302*a* above lower disk 416*a*. Top pin 417*a* fits into a rotation starting point hole in disk 302*a* (obscured by disks). The connection of main armature 301*a* and secondary armature 490*a* is shown in more detail in FIG. 8. In FIG. 13, First disk 314*a*, second disk 310*a*, third disk 311*a*, and fourth disk 312*a* are concentric and fixed to each other and stacked vertically above lower disk 416*a*. Cable 304 attaches to disk pin 313*a*, which secures the stack of first disk 314*a*, second disk 310*a*, third disk 311*a*, and fourth disk 312*a*. This is described in greater detail in FIGS. 14 and 15. Cable 304 travels through cable straightener 309*a*. As the stack of first disk 314*a*, second disk 310*a*, third disk 311*a*, and fourth disk 312*a* (collectively "disk stack") rotates, cable straightener 309*a* keeps the cable straight as it extends to lower pulley 307*a* disposed on lower section 308*a* of main armature 301*a*. As described earlier, there is a position shift, 310*a*, in the main support to keep the two main armatures from colliding. Cable 304 travels across middle pulley 306 disposed on upper section 305*a* of main armature 301*a*, then to upper pulley 303*a*. On a near end of main armature 301*a*, cable 304 travels to upper handle base 315*a*. Cable 304 attaches to a ball cap (not shown) associated with upper handle base 315*a*. Sheath 316*a* holds the extended end of cable 304 attaching to upper handle 317*a*. This combination of structural elements serves as a cable pulley for performing additional exercises via upper handle 317*a* that require a freer motion and allow for compound exercises.

Figure 14:
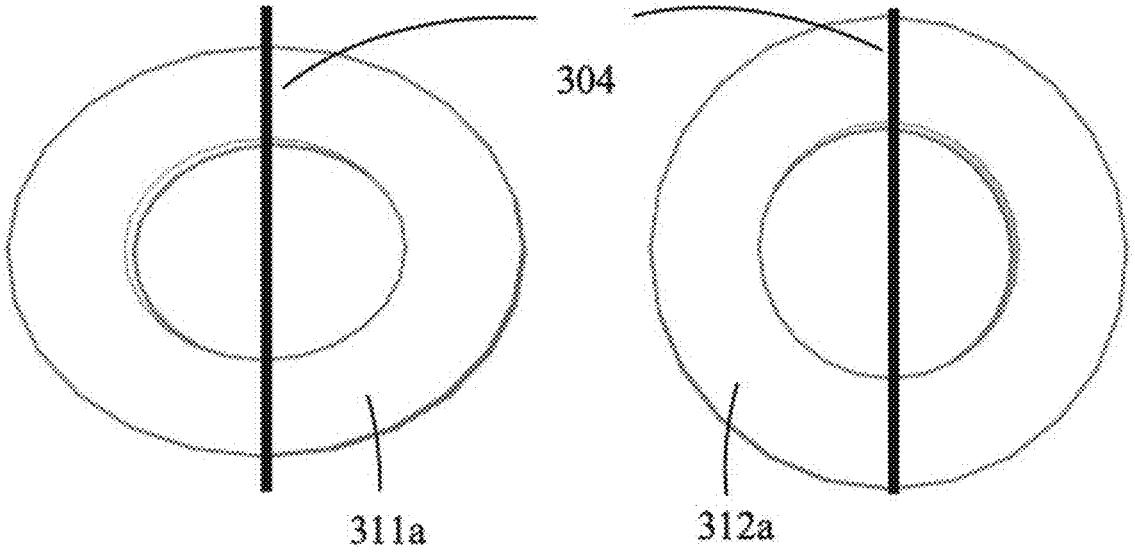
FIG. 14 is a view of disks of a main armature according to an embodiment.

FIG. 14 depicts third disk 311*a*, and fourth disk 312*a* removed and viewed from above with cable 304 passing through the disks. In an embodiment, these disks provide the user a choice of constant tension (fourth disk 312*a*) or variable tension (third disk 311*a*). As the user rotates upper handle 317*a* when connected to disk 312*a*, cable 304 takes a uniform radius path providing a constant tension. When connected to third disk 311*a*, on the other hand, as the user rotates upper handle 302*a*, the resulting tension begins lower than fourth disk 312*a* tension grows to higher than that of fourth disk 312*a*, then back to tension lower than 312*a*. This models muscle function where the muscle is weakest at full extension, strongest at mid-cycle, and weakest again toward the end of the cycle.

Figure 15:
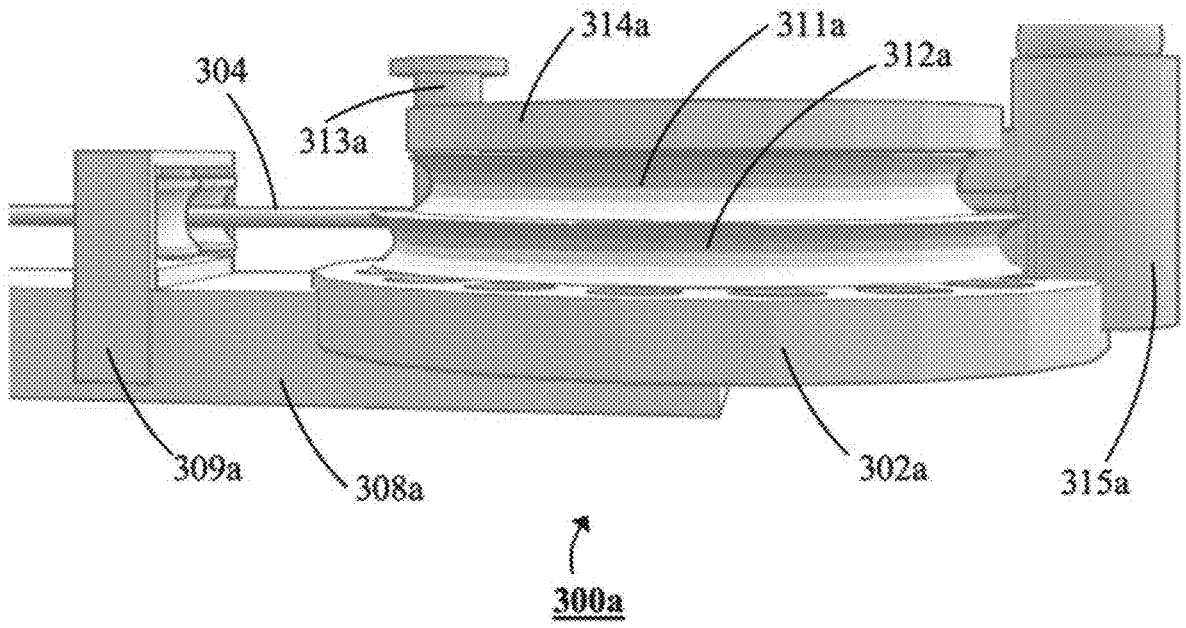
FIG. 15 is an enlarged side view of a disk assembly and disks of a main armature according to an embodiment.

FIG. 15 is a blown up, side view diagram of the end of main armature 300*a*, or the side on which first disk 314*a*, second disk 310*a*, third disk 311*a*, and fourth disk 312*a* are stacked. This arrangement incorporates the functionality described with respect to FIG. 14 for user selection of variable tension according to the disk. When disk pin 313*a* is pulled up, the user selects, for example, the elliptical, variable tension disk or third disk 311*a*. Conversely, when disk pin 313*a* is pushed down, constant tension disk or fourth disk 312*a* is selected. Disk pin 313*a* operates as a selector in this manner and is shaped to either lock into third disk 311*a* or fourth disk 312*a*, which results in selection of that particular disk.

FIGS. 16*a-e* depict top and simplified views of the alternate embodiment of the main armature. In this embodiment, main armature 350*a* superimposed on the previously described main armature 301*a*. Like the previous embodiment of main armature 301*a*, in this embodiment main assembly, 350*a* also contains two disks: disk 311*a* and disk 312*a* on top of each other, with disk 311*a* elliptical and disk 312*a* circular. For clarity of illustration, in FIGS. 16*a-e*, only disk 311*a*, the elliptical disk, is shown.

Figure 16A:
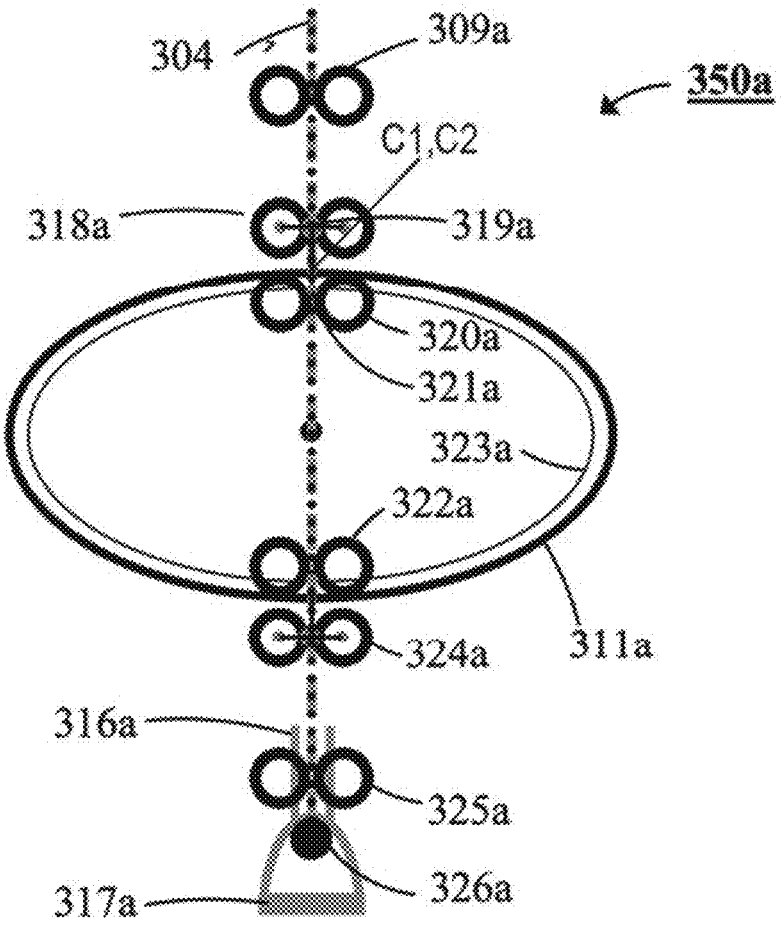
FIGS. 16*a-e* are top views of circular and elliptical disk rotation according to an embodiment.
Figure 16B:
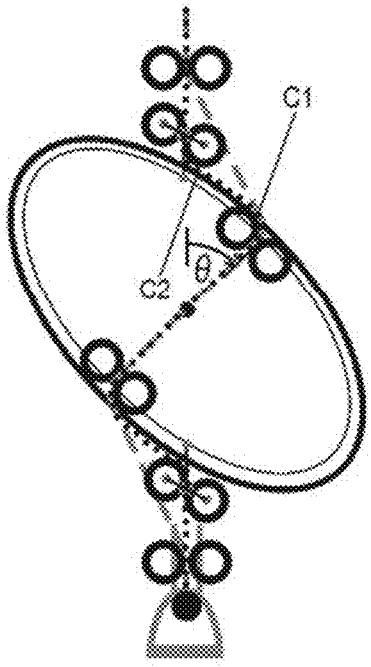
Figure 16C:
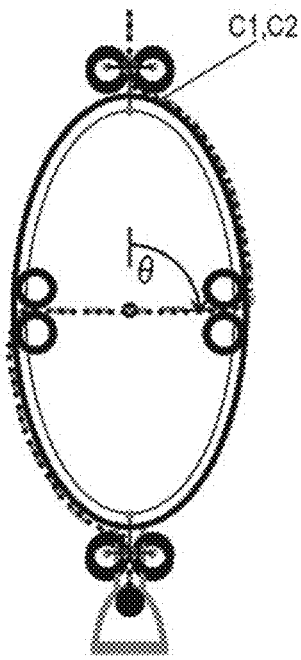
Figure 16D:
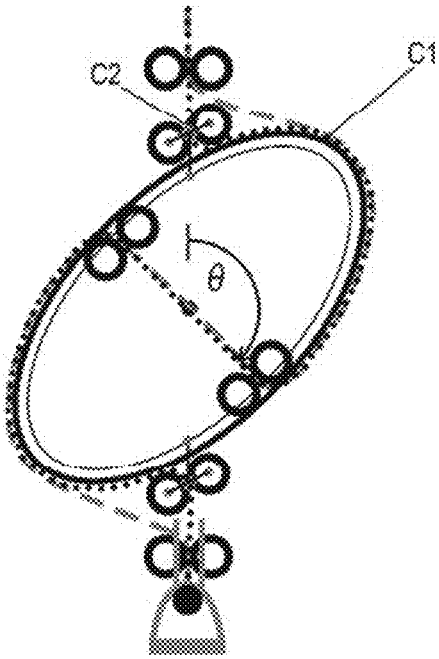
Figure 16E:
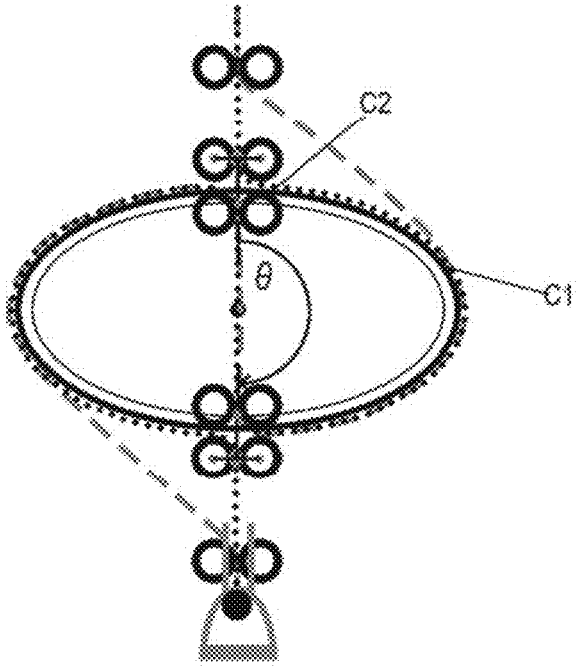
Figure 17A:
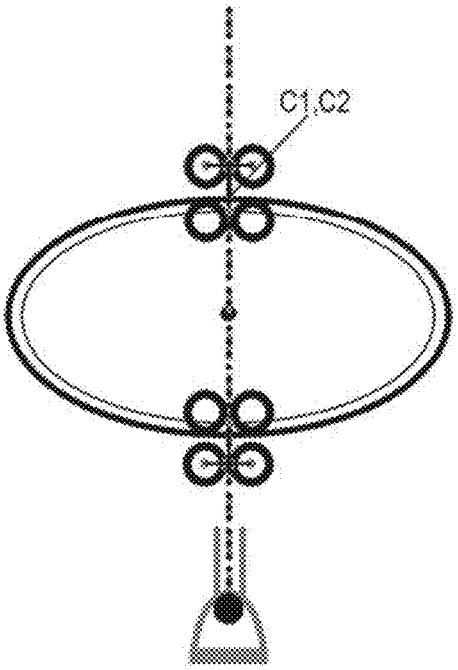
FIG. 17*a-e* are top views of circular and elliptical disk rotation according to an embodiment.
Figure 17B:
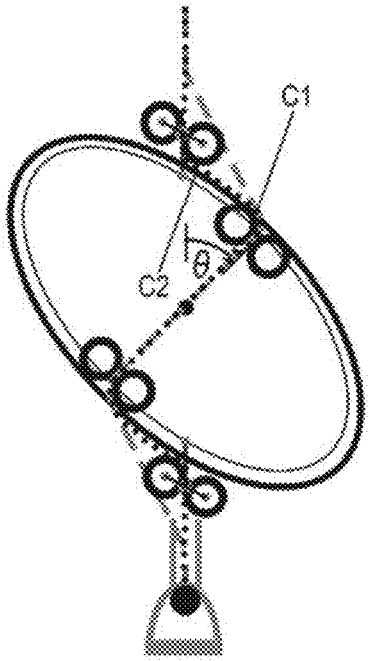
Figure 17C:
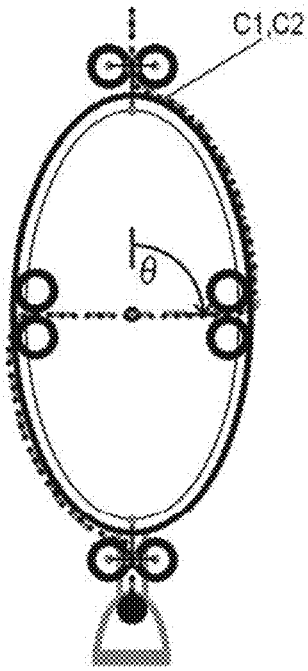
Figure 17D:
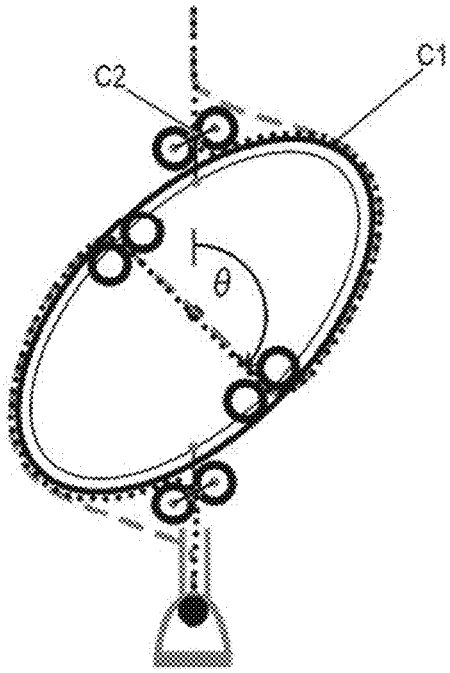
Figure 17E:
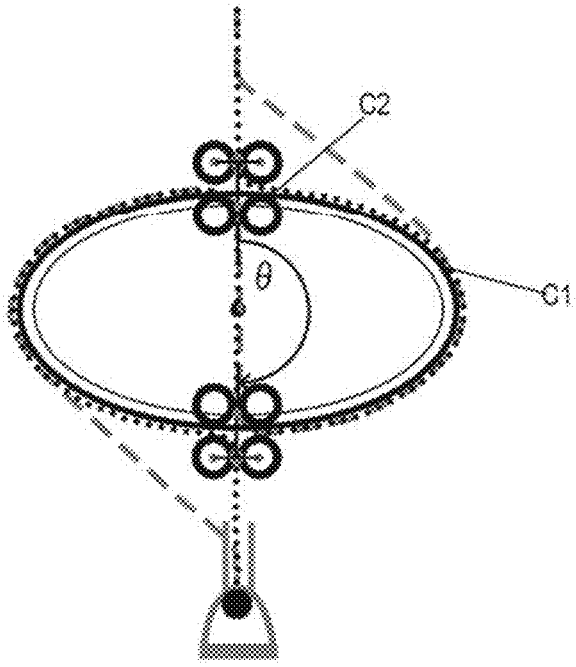

The purpose of the elliptical disk is to provide a varying torque (radius times force) that increases, then decreases over 180 degrees of rotation. In this embodiment of main armature 350*a*, cable 304 traverses double cylinders 309*a* keeping the cable straight proximally. The cable 304 then passes thru double cylinders 318*a*, with each cylinder stabilized by a straight bar, 319*a*. The cable then passes thru a hole in elliptical, disk, 311*a*, through double cylinders 320*a*, then straight through the interior of elliptical, disk 311*a* to exit through inner double cylinders 322*a*, then through exterior double cylinders 324*a*, thru pully channel 316, and again straightened by double cylinders 325*a*, then terminating at tethering ball 326 at upper handle 317*a*. First double cylinders 318*a* and exterior double cylinders 324*a* are placed close to the outside of elliptical, disk 311*a*, with elliptical disk 311*a* connected inner track 323*a*. This allows cable 304 to closely contact disk 311*a* throughout the disk's rotation. Note in FIG. 16*b* as elliptical disk 311*a* begins to rotate through 45 degrees, the connection point on elliptical disk 311*a*, C1, remains at the same point when it is desired that the radius increase by connecting at connection point C2. In FIG. 16*c*, halfway through the cycle, the connection points match but with another 45 degrees of rotation, the connection point, C1, remains close to the maximum radius when it should have fallen to a smaller radius by connecting at C2. By the end of 180 degrees of rotation (FIGS. 16*d* and 16*e*), the radius in the original model remains close to the maximum whereas it has fallen close to the proper radius in the new model.

FIG. 17*a-e* depict the elements of modified main armature 350 according to the embodiment described with respect to FIG. 16.

Figure 18:
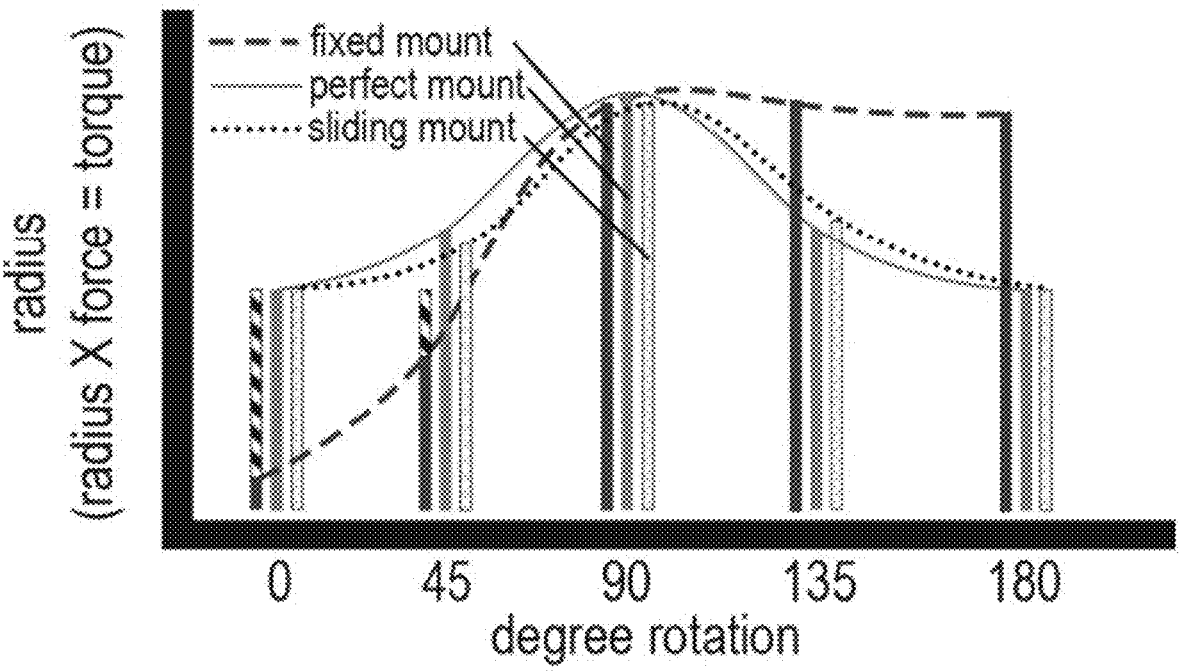
FIG. 18 is a graph showing three radius (torque) models as a function of rotation according to an embodiment.

FIG. 18 is a graph showing three radius (torque) models as a function of rotation through 180 degrees of rotation of elliptical disk 311*a*. The original model, present on most machines that use a changing radius, is represented by the dashed, gray line labeled the "fixed mount" and histogram vertical value lines in black and stripes. Note that for small degrees, there is very little force required to begin the cycle as the fixed mount is far from the cylinder leading to very little cable pull initially. The force required then rises precipitously to at least match the "perfect mount" but then stays close to the same radius further into the stroke cycle. The improved assembly keeps the pulleys close to the ellipse along with the contact points for better tracking and following of the changing radius and position of elliptical, lower disk 311*a*.

Figure 19:
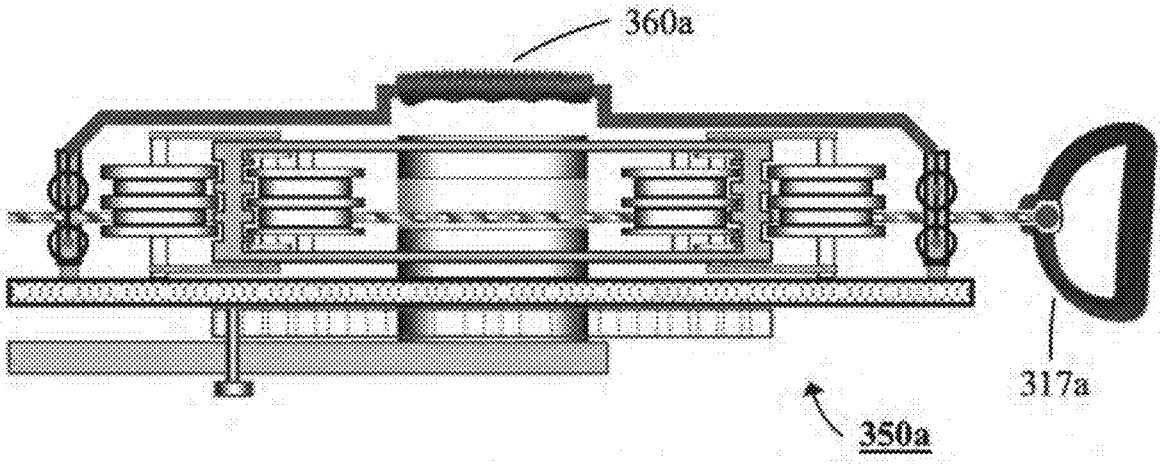
FIGS. 19*a* and *b* are side, cross-sectional, detailed views of a main armature according to an embodiment.
Figure 19B:
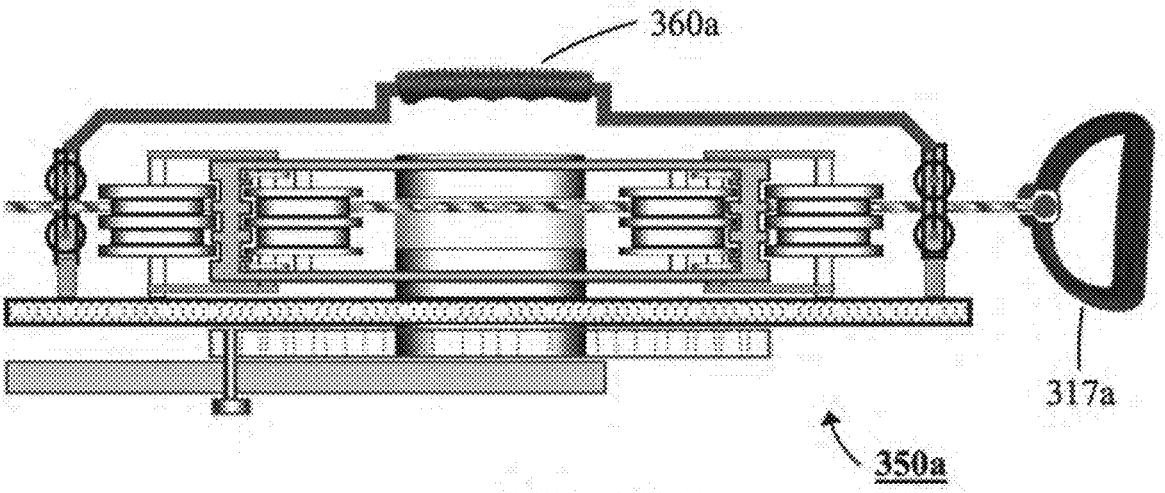

FIGS. 19*a* and *b* are side, cross-sectional, detailed views of main armature 350*a* according to an embodiment. Here, armature 350*a* is set in the mode where the circular, lower, fourth disk 312*a* is selected. Circular, fourth disk 312*a*, is selected in one embodiment by pushing disk pin 313*a* in the downward position, engaging circular, fourth disk 312*a*, which has a constant radius/torque. FIG. 19*b* shows main armature 350*a* with disk selection handle 360*a* pulled up, engaging the elliptical, third disk 311*a* (varying radius/torque). This is described in detail in connection with FIG. 20.

Figure 20:
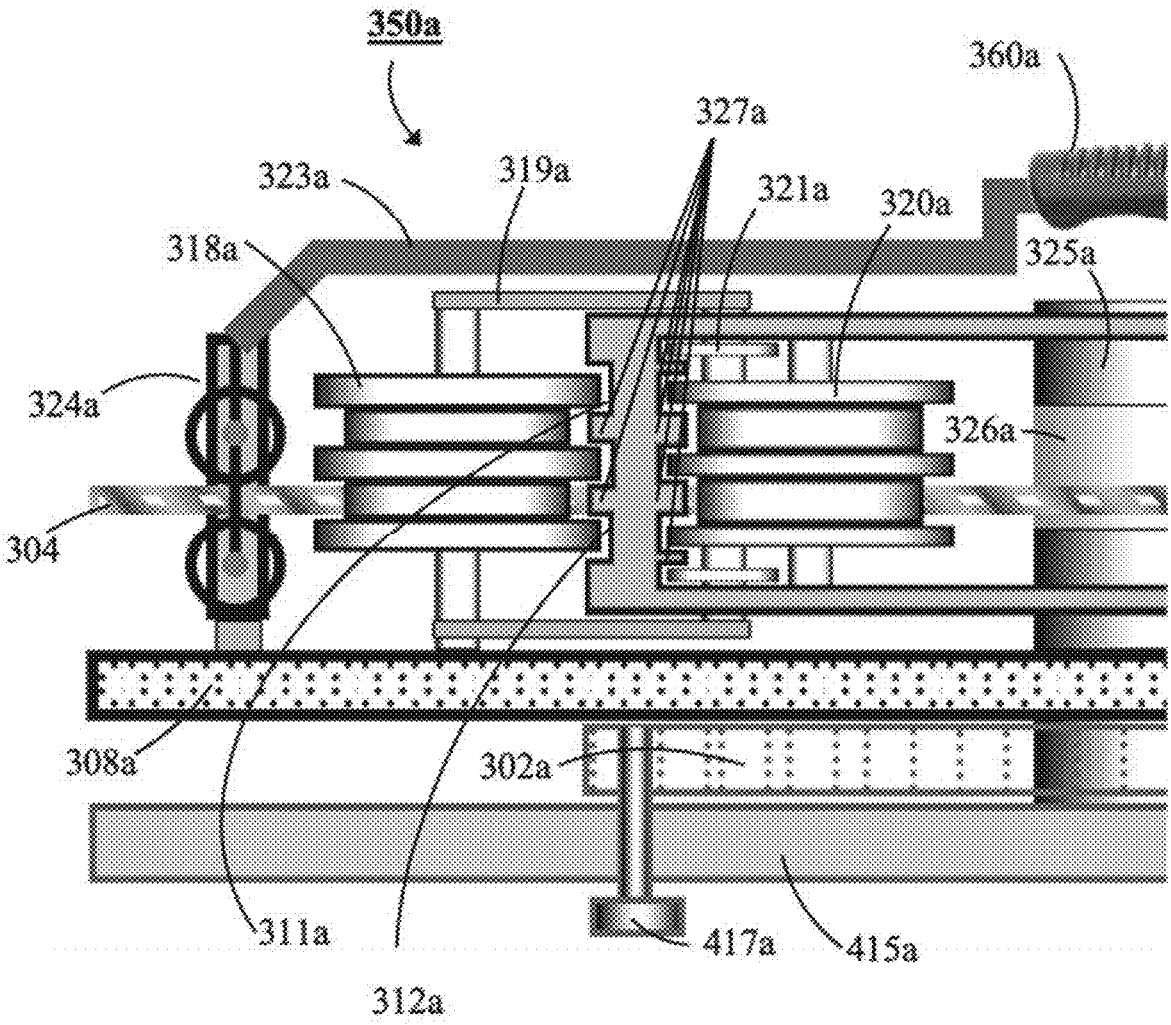
FIG. 20 is a side, cross-sectional, detailed view of a main armature according to an embodiment.

FIG. 20 is a side, cross-sectional, detailed view of an embodiment of the proximal side of main armature 350. The distal side of main armature 350 is similar to the proximate side, except for termination of the cable inside the pulley at upper handle 317*a*, as shown in FIGS. 19*a* and *b*. Cable 304 traverses unit exterior double cylinders 324*a*, which comprise roller wheels. Exterior double cylinders 324*a* comprise of a vertical support post holding two wheels, as shown. These wheels guide cable 304 to the proper one of the disks, circular vs. elliptical (circular disk 312*a* or elliptical disk 311*a*). When beam 323*a* is pushed downward, wheels of exterior double cylinders 324*a* force down on cable 304, engaging lower disk 312*a*, the circular disk.

When beam 323*a* is pulled upward, the exterior double cylinders 324*a* lift cable 304 to engage disk 311*a*, the elliptical disk. Note that in one embodiment, this change of disks can only be performed when the disks are at zero rotation.

The distal side of the main armature 350*a* operates in a similar manner with respect raising and lowering beam 323 to select between the circular and elliptical disk.

First double cylinders, 318*a*, which comprise roller wheels, remain adjacent to disk 311*a* and disk 312*a* by connector 319*a*, which connects first inner roller wheel 321*a*. As above, this allows correct tangential connection of cable 304 with the disk of choice. Second double cylinders 320*a* are fixed to the inside of the selected disk. With rotation, cable 304 lengthens proximally and distally. Stabilizing ridges 327*a* on the various double cylinders are optional and may be excluded to reduce manufacturing complexity and cost. Lower disk 312*a* and disk 311*a*, when selected, revolve around main axis 325 positioned at the approximate center of main armature 350*a* apparatus with a center hole allowing travel of cable 304 through main axis 325*a*. This is attached to lower section 308*a* of main armature 350*a*, as previously described. Bar 415*a*, also previously describes with respect to FIG. 10, attaches to main axis 325*a*. The starting position of bar 415*a* is selected by perforated disk 302*a* disposed in one embodiment on the lower section 308*a* of main armature 350*a*) and selected with bar pin 417.

Figure 21A:
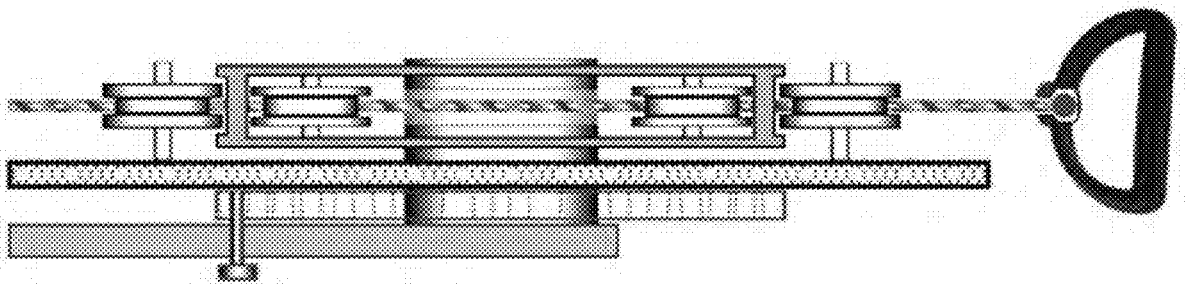
FIGS. 21*a* and *b* are side, cross-sectional, detailed views of a main armature according to an embodiment.
Figure 21B:
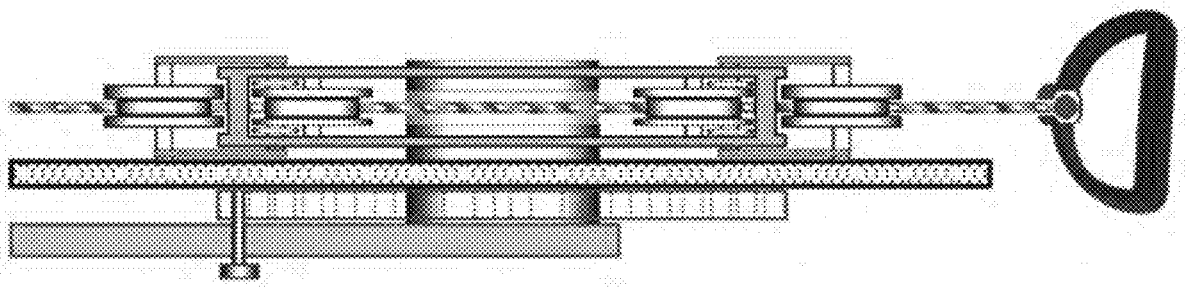

FIGS. 21*a* and *b* are diagrams illustrating how the apparatus could be constructed with only one of a circular, FIG. 21*a*, or elliptical FIG. 21*b* were desired. The components are the same as in the above described main armature 350*a* disk assembly described with respect to FIG. 20. In one embodiment, main armature 350*a* allows both elliptical and circular disks, but in a single disk embodiment, various unnecessary components removed. Note the main difference between these two single disk options and the two-disk model is the presence of the stabilizing small inner wheels with the elliptical disk, which would be excluded from the circular disk-only model.

Figure 22:
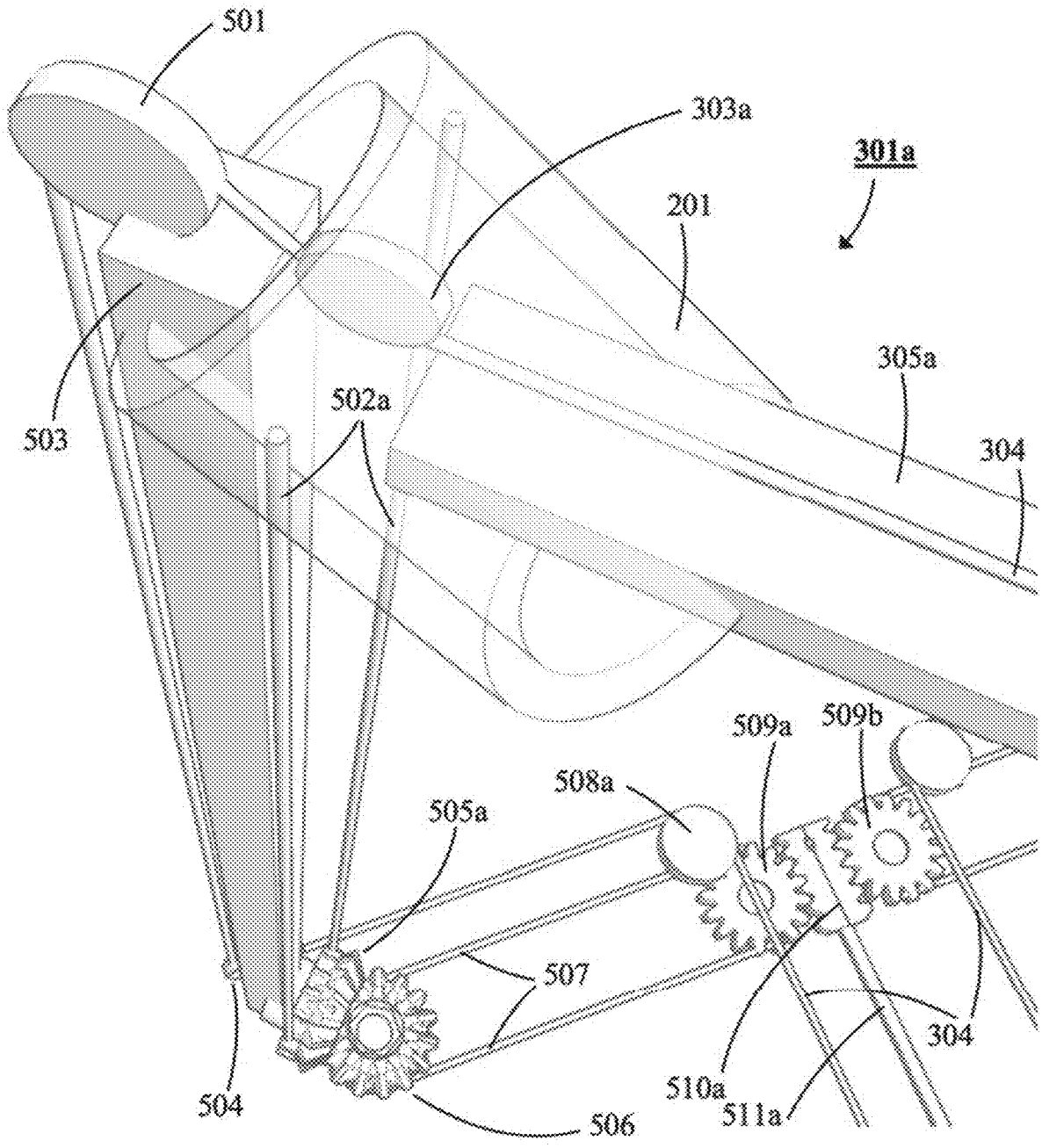
FIG. 22 is a perspective view of a connection between a main armature and a supporting structure according to an embodiment.

FIG. 22 is a diagram illustrating an embodiment of the connection of main armature 301*a* with support frame 500 of external shoulder exercise apparatus 100. Cable 304 of main armature 350*a* wraps around upper pulley 303*a* disposed on an end of upper section 305*a* of main armature 301*a*. Cable 304 then travels over upper post pulley 501*a* disposed at the top of first post 503*a* of support frame 500, then travels downward over lower pulley 504 disposed at the bottom of first post 503*a* and across to interior pulley 508*a*. From interior pulley 508*a*, cable 304 travels forward to a weight stack. Upper section 305*a* of main armature 301*a* attaches to armature hub 201*a* that rotates in a circle pointing in the (1,1,1) direction as previously explained. The rotation of armature hub 201*a* is provided by the user pedals (not shown in FIG. 22). Inner cables 502*a* are pulled from one side or the other using a ratchet system depending on the direction of rotation of armature hub 201*a*. Inner cables 502*a* attach first beveled cog 505*a*, that in turn interlaces with second beveled cog 506*a*. Second beveled cog 506*a* is pulled laterally by lower cables 507*a* with lower cables 507*a* also attached to first cog 509*a* and second cog 509*b*. First cog 509*a* and second cog 509*b* are ratcheted forward or backward by rack 510*a* along rod 511*a*.

Figure 23:
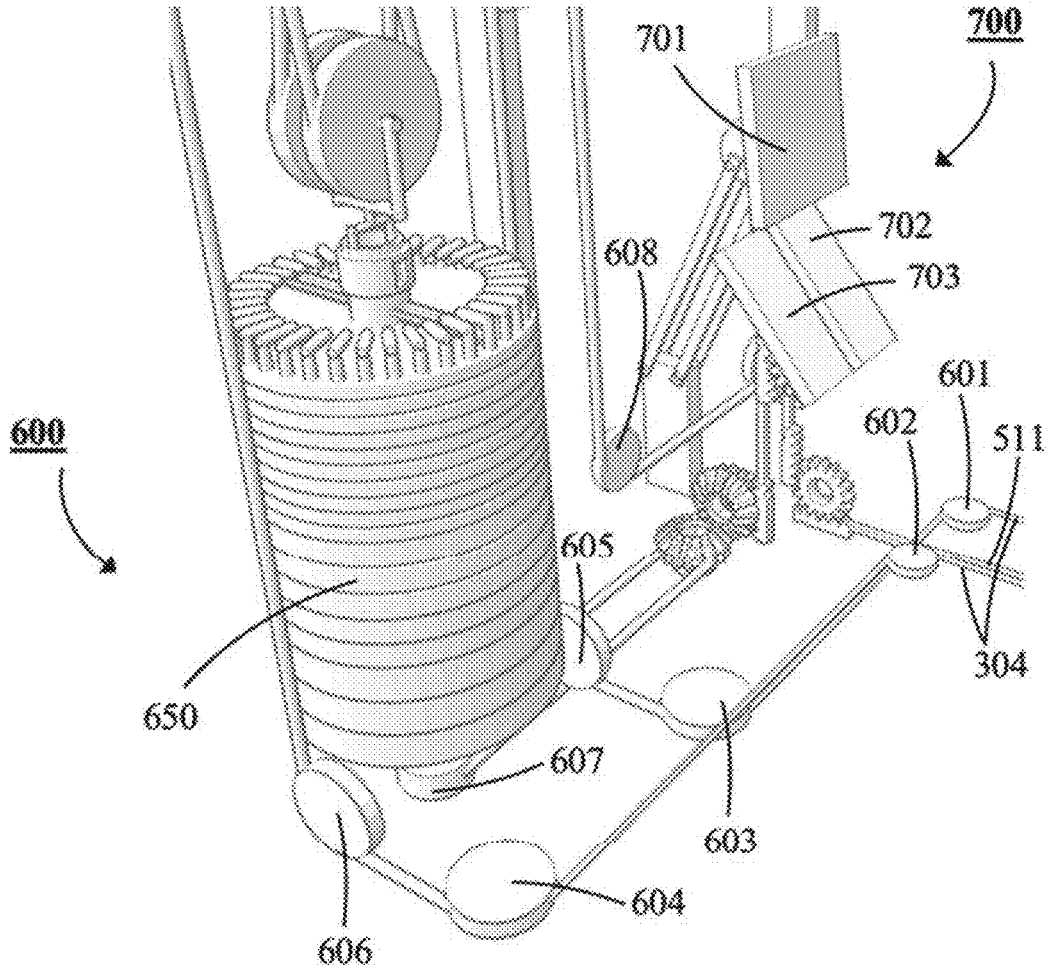
FIG. 23 is a perspective view of a cable and pulley arrangement according to an embodiment.

FIG. 23 is a diagram depicting weight stack assembly 600 and pedal system 700, which in one embodiment are used with Axis apparatus 100. Previously described cable 304 wraps around first base pulley 601*a* and second base pulley 602*a* from the right and left sides of pedal system 700 apparatus from behind, respectively. Cable 304 then wraps around third base pulley 603 and fifth base pulley 605 from the right and around fourth base pulley 604 and sixth base pulley 606 from the left. The right and left sides of cable 304 then ascend the sides of weight stack 650. Weight disk 607 in one embodiment comprises a ratchet mechanism that turns one click clockwise or counterclockwise as driven by pedal 703 as will be described with respect to FIG. 25.

Figure 24:
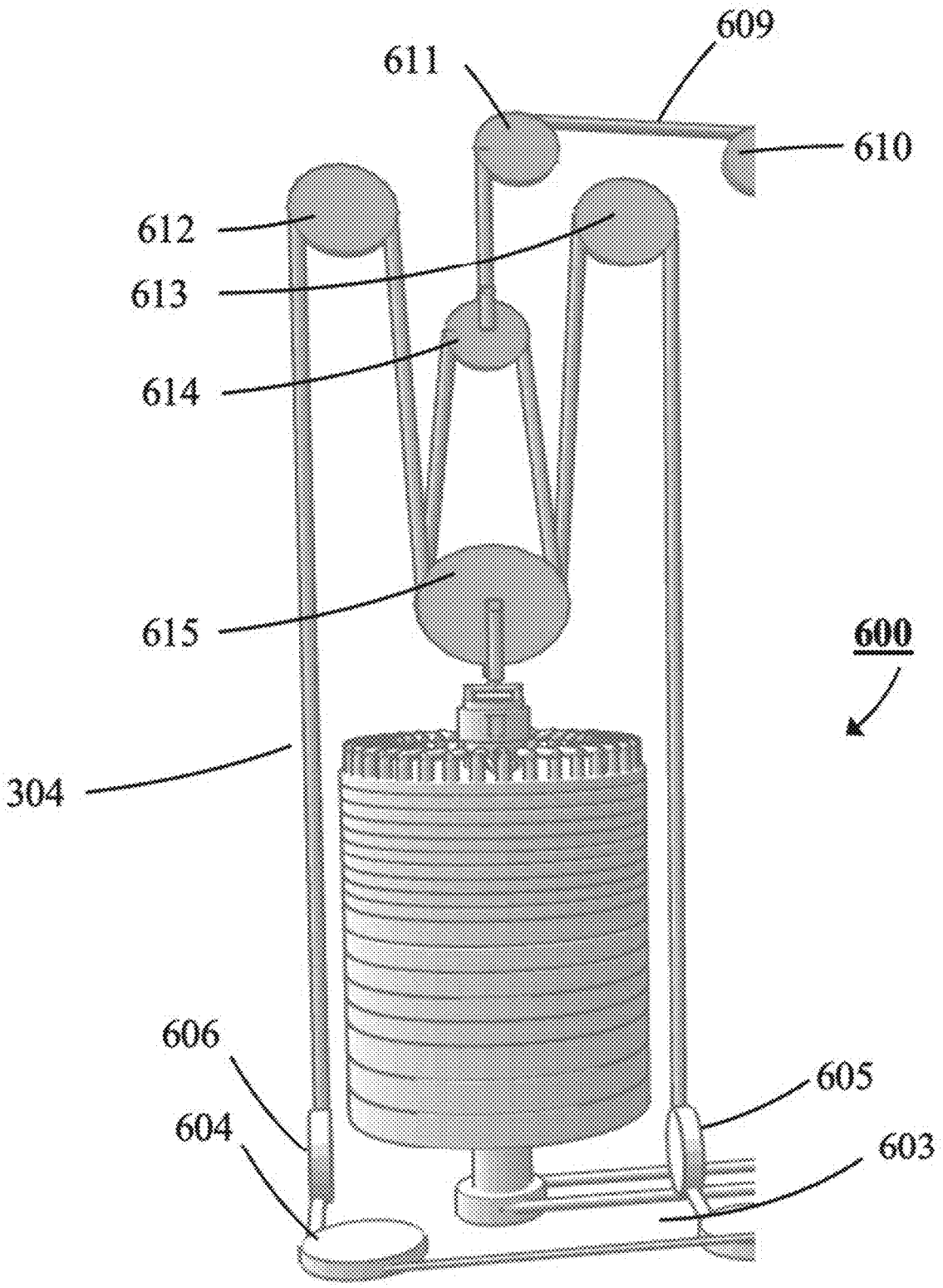
FIG. 24 is a perspective view of a cable and pulley arrangement and associated weight stack according to an embodiment.
Figure 25:
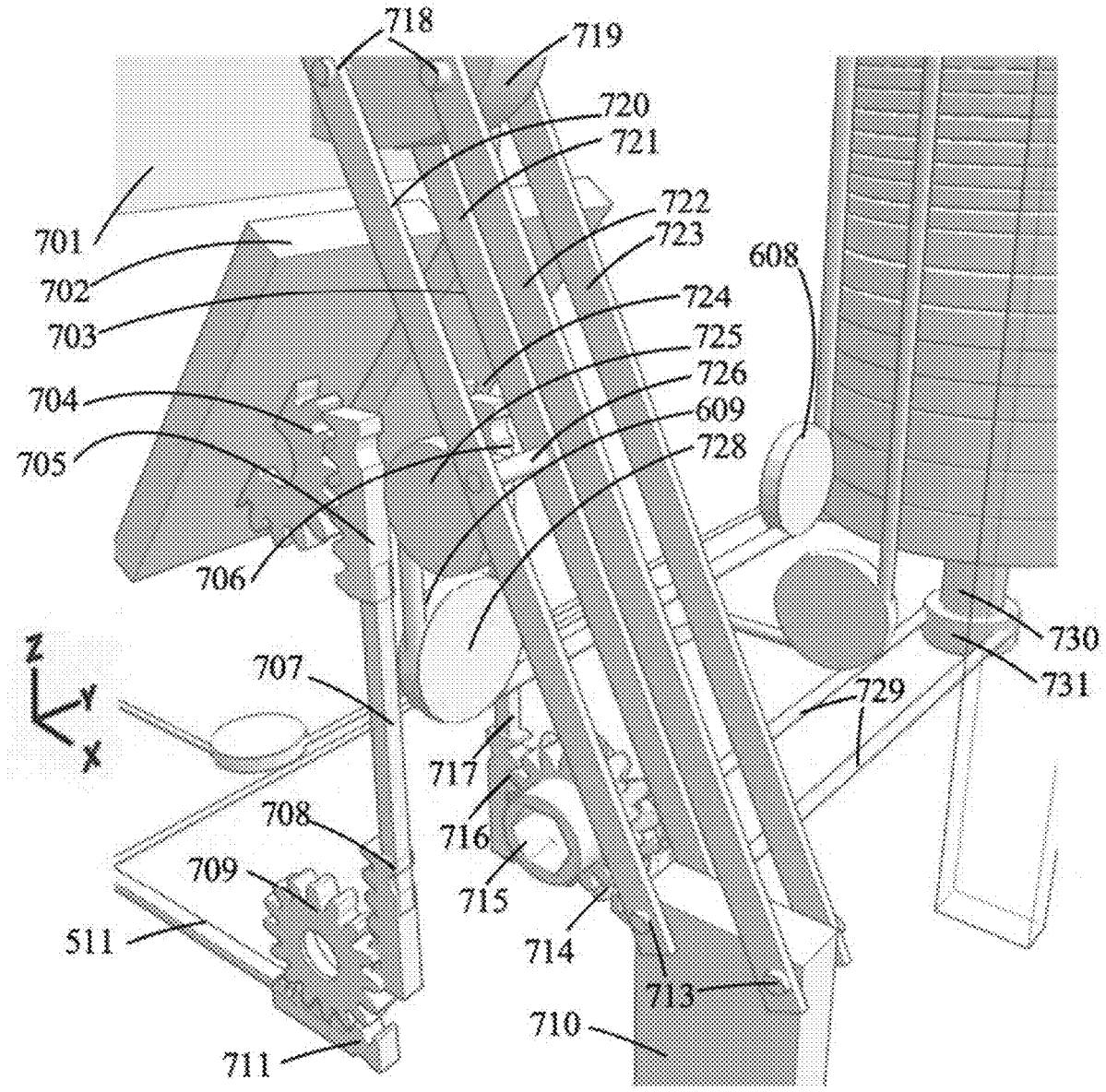
FIG. 25 is a perspective view of a pedal mechanism according to an embodiment.

FIG. 24 is a more detailed view of weight stack assembly 600. An arrangement of pulleys lift weight stack 650 via a single continuous cable 304 tethered on the ends of the left main armature 301*a* and right main armature 301*b*. Cable 304 loops up from fifth base pulley 605, around first upper pulley 613, down around double pulley 615, back up around center pulley 614, back down around double pulley 615, up to left pulley 612, down to sixth base pulley 606. When either or both sides of cable 304 are pulled, weight stack 650 is raised. From weight assist pedal, 701, to be discussed, is assist cable 609 that loops around first assist pulley 608 (FIG. 25). Assist cable 609 then loops around second assist pulley 610, then third assist pully 611 then terminates at center pulley 614. Pulling on assist cable 609 raises weight stack 650 independent of cable 304. Assist cable 609 may be pulled at any time during the stroke of the repetition. The details of weight stack 650 are discussed later.

FIG. 25 is a detailed depiction of weight assist assembly 700, that includes a weight assist pedal that assists in lifting the selected amount of weight-on-weight stack 650, changing the weight resistance and changing the main armature shoulder axis. Broad based upper pedal 701 (more fully shown in FIG. 23), is pushed by the user to provide assistance in lifting a given weight. Upper foot pedal 701 attaches to upper support rod 719, which in turn attaches to posterior struts 720 and 721 and anterior struts 722 and 723.

and fixed by rotating bolts 718 and 713. upper pedal 701 remains fairly parallel through its stroke due to the function of the struts. The struts are attached to lower support structure 710, inferiorly. When upper pedal 701 is pushed, assist cable 609 is pulled by attachment rod 726 between posterior struts 720 and 721. Assist cable 609 wraps around fourth assist pulley 725, then fifth assist pulley 728, then fifth assist pulley 608 as shown in FIG. 18.

First lower pedal 702 determines the rotation of the main armature posteriorly. First lower pedal 702 rotates about the Y-axis one click at a time with a ratcheting mechanism as first lower pedal 702 connects to first upper rack 705 and first upper pinion 704 which connects to first intermediate rod 707. which then connects to first lower rack 708 and first lower pinion 709, in turn connecting to first base rack 711, in turn connecting to first base rod 511, that connects with the posterior system.

Second lower pedal 703, also depicted in FIG. 23, uses a similar ratchet system to incrementally change the weight resistance up or down. Second lower pedal 703 rotates about the Y-axis one click at a time. Second lower pedal 703 connects to a second upper rack 706 and second upper pinion 724 which connects to second intermediate rod 717 connecting to first lower rack 716 and first beveled pinion 715. First beveled pinion 715 articulates with second beveled pinion 714. Lower weight assist cable 729 wraps around base pinion 714 and base hub 731. When base pinion 714 rotates one click in either direction, it selects a lower or higher weight by rotating base hub 731 attached to stack rod 730. The operation of the weight stack will be discussed later.

Figure 26:
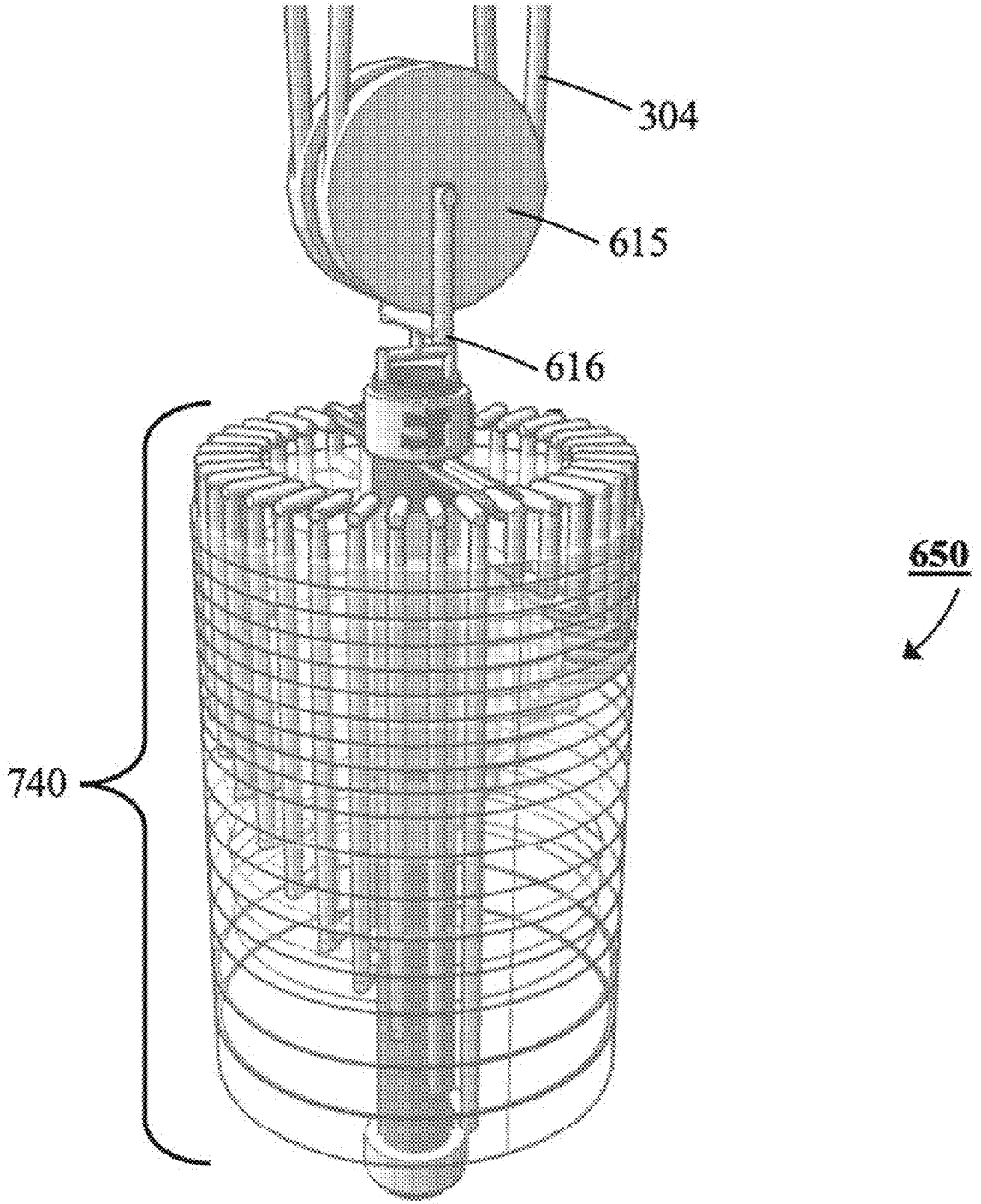
FIG. 26 is a perspective view of a weight stack and weight plates according to an embodiment.

FIG. 26 is a diagram of weight stack 650 in position. Group 740*a* of individual weight plates are shown transparently for illustrative purposes.

Figure 27:
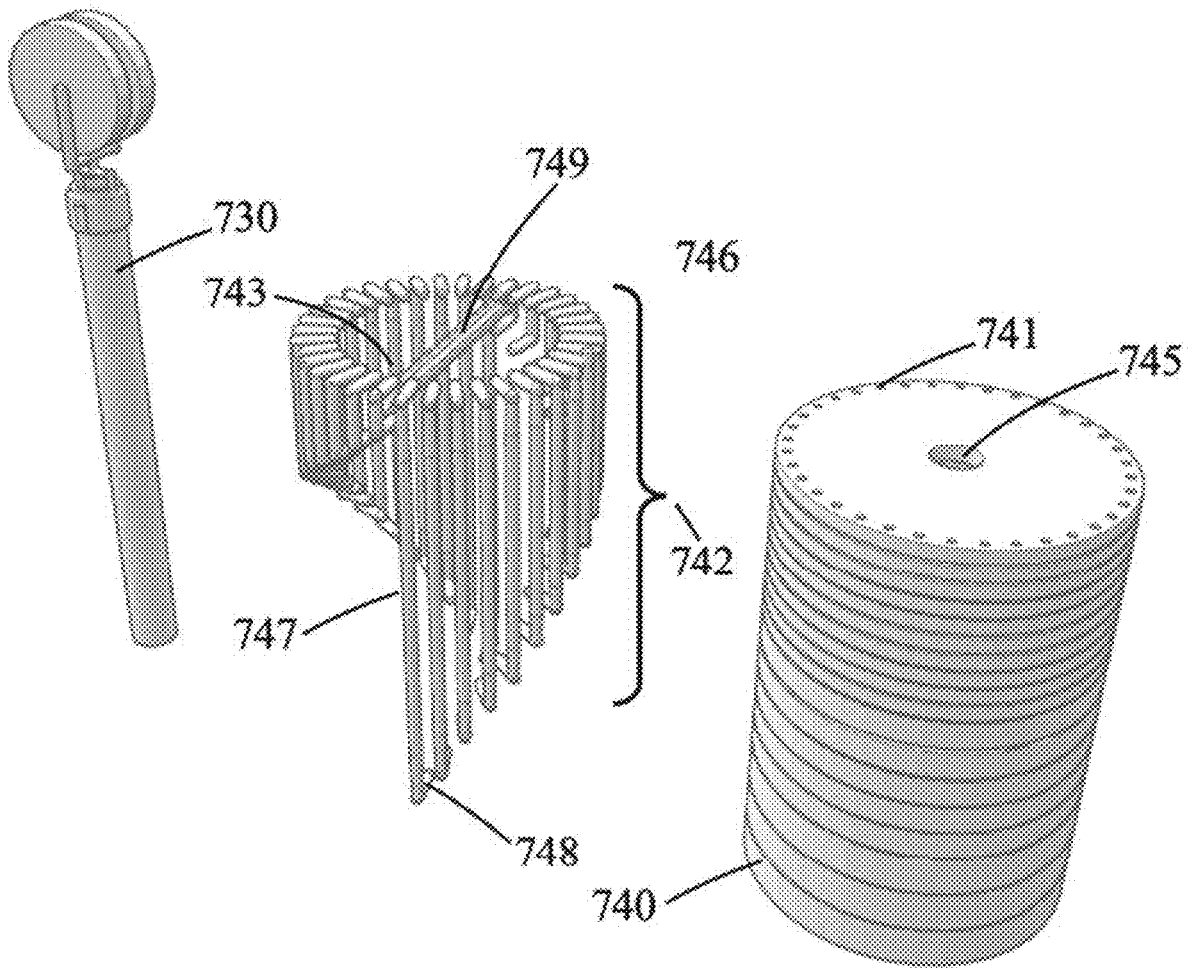
FIG. 27 is a diagram of separate components of a weight stack according to an embodiment.

FIG. 27 is a diagram isolating the major components of the weight stack 650. plate stack 740 comprises a stack of a plurality of individual weight plates. While conventional weight stacks increase at similar intervals, e.g. 10 lbs, plate stack 740 in one embodiment includes lighter weights at the top of plate stack 740 weighing less than 10 lbs. and increasing as plate stack 740 progresses toward the bottom of plate stack at intervals greater than 10 lbs. For example, the weight of each plate (in lbs for an 18 plate weight stack) could be 5 lbs×5, 10 lbs×5, 20 lbs×5, 40 lbs×3 for a total weight stack of 295 lbs.

Concentrically positioned and imbedded in plate stack 740 within weight stack 650 are C-shaped rods 742. C-shaped rods 742 allow selection of one or more of the eighteen individual plates that comprise plate stack 740 Each rod 742 comprises a short, horizontal, upper rod 743, a variable length, vertical rod 747, and lower horizontal rod 748, identical in length to upper rod 743. Depending on the rotation position of selection carriage 749, lower horizontal rod 748 a given C shaped rod 742 is selected. C-shaped rods 742 traverse the peripheral holes 741 in plate stack 740.

Selection carriage 749 traverses through weight selection rod 730 that slides in and out of the center hole 745 in plate stack 740 holding and guiding the plates.

Figure 28:
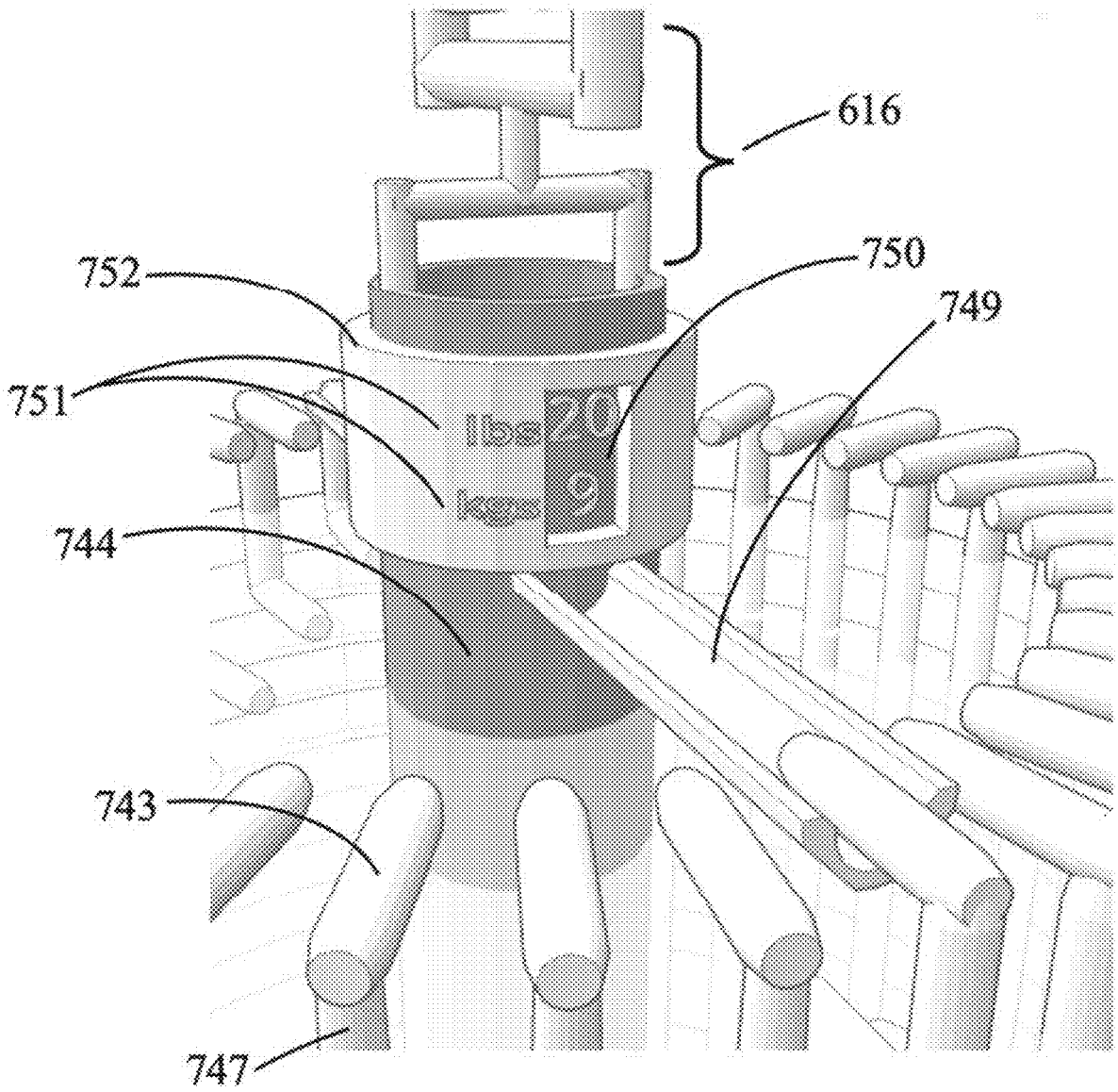
FIG. 28 is a perspective view of a weight carriage mechanism of a weight stack according to an embodiment.

FIG. 28 is carriage assembly of weight stack 650 according to an embodiment. Selection carriage 749 in one embodiment is a half cylinder meant to lift C shaped rods 742 that hold the plates within plate stack 740. As rod 730 (shown in FIG. 21) is rotated by the ratchet system described in FIG. 19, selection carriage 749 rotates with it. The user can also manually rotate the carriage to any selection rod by twisting 616. When the plates are at rest, selection carriage 749 lies slightly below the level of top aspect of C-shaped rods 743 (see FIG. 23). Selection carriage 749 lifts the given C-shaped rod 742 through contact with 743 and all the weight plates above the corresponding 748 pin of 742. Fixed position cylindrical sleeve 752, displays "lbs." and "kgs" (751). As selection carriage 749 rotates to a new position, "lbs.": and "kgs." are displayed in the window 750 of 752.

Figure 29A:
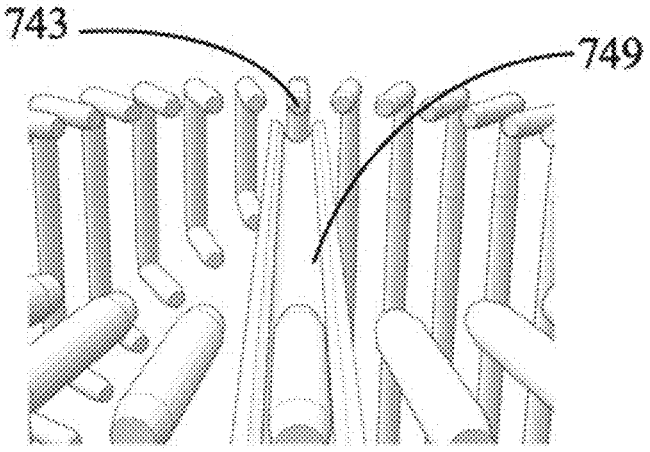
FIGS. 29*a-c* depict a weight carriage mechanism at various positions according to an embodiment.
Figure 29B:
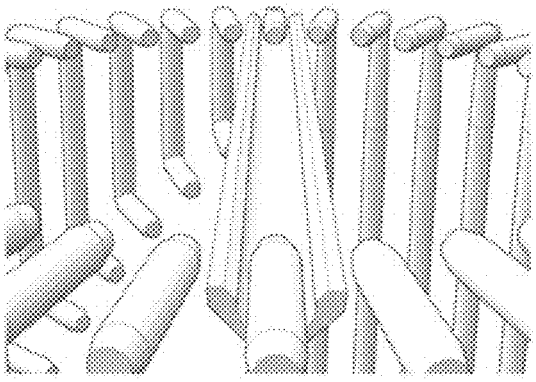
Figure 29C:
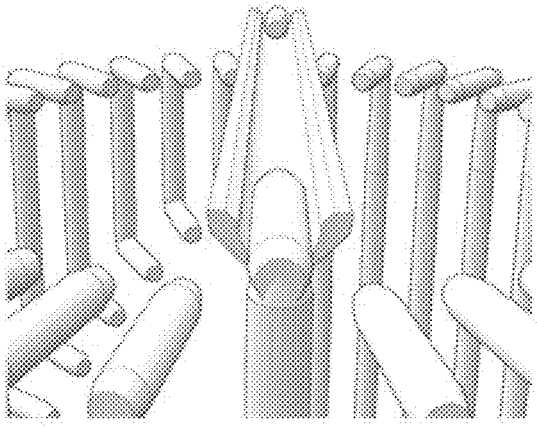

FIGS. 29*a-c* depict selection carriage 749 at various positions. FIG. 29*a* shows the weights at rest with selection carriage 749 lying below the plane of the upper portion of the selected C-shaped rod 742*a*. This allows the selection carriage to rotate to the other C-shaped rods. FIG. 29*b* shows the selection carriage first touching the selected C-shaped rods to lift them at 743. FIG. 29*c* shows the selection carriage having lifted the selected C-shaped rods a small distance. Note the selection carriage also lifts the C-shaped rods from opposite side for stability.

Figure 30A:
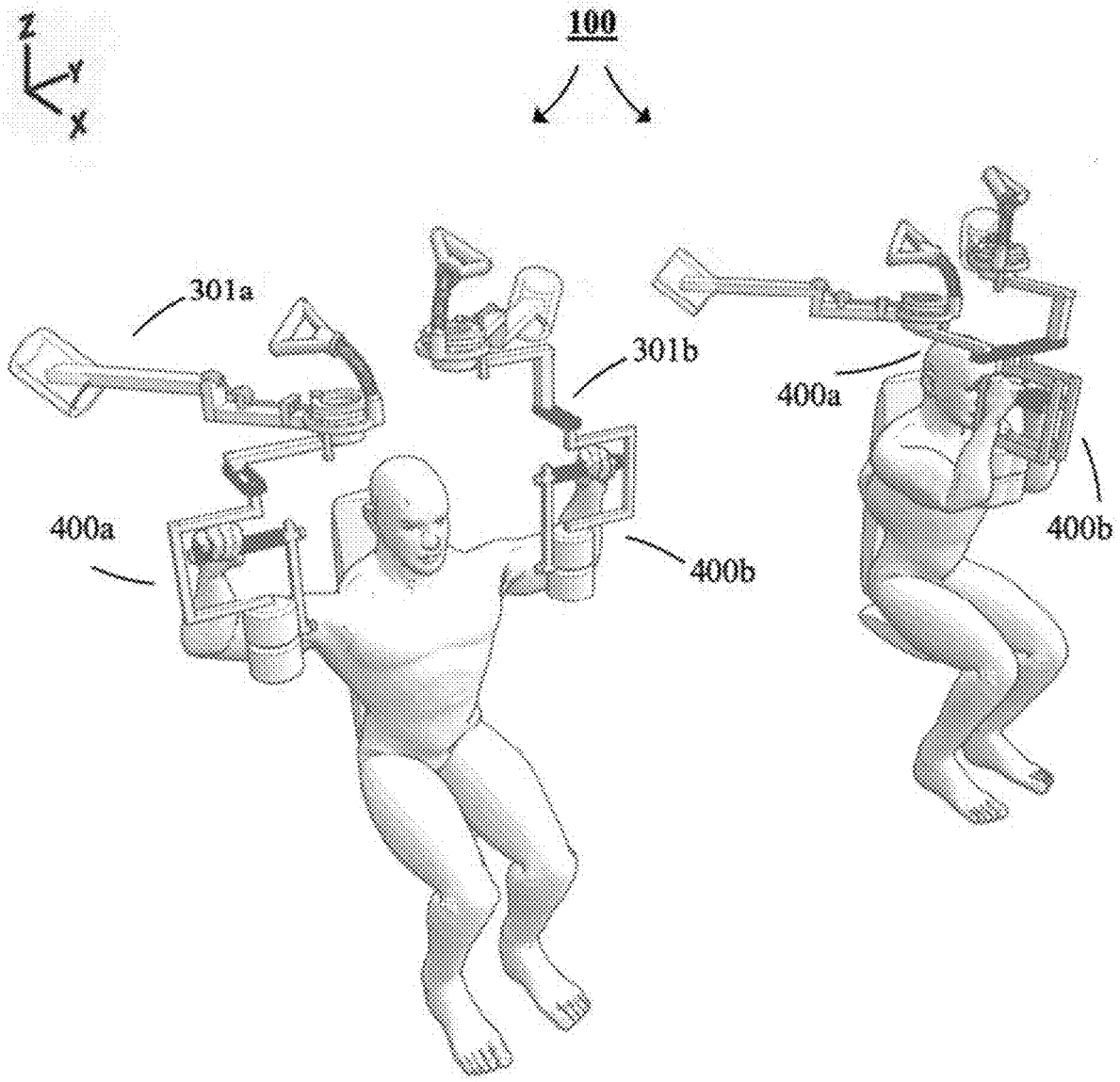
FIGS. 30*a-d* depict start and finish positions of the external shoulder exercise apparatus in three major exercise planes according to an embodiment.
Figure 30B:
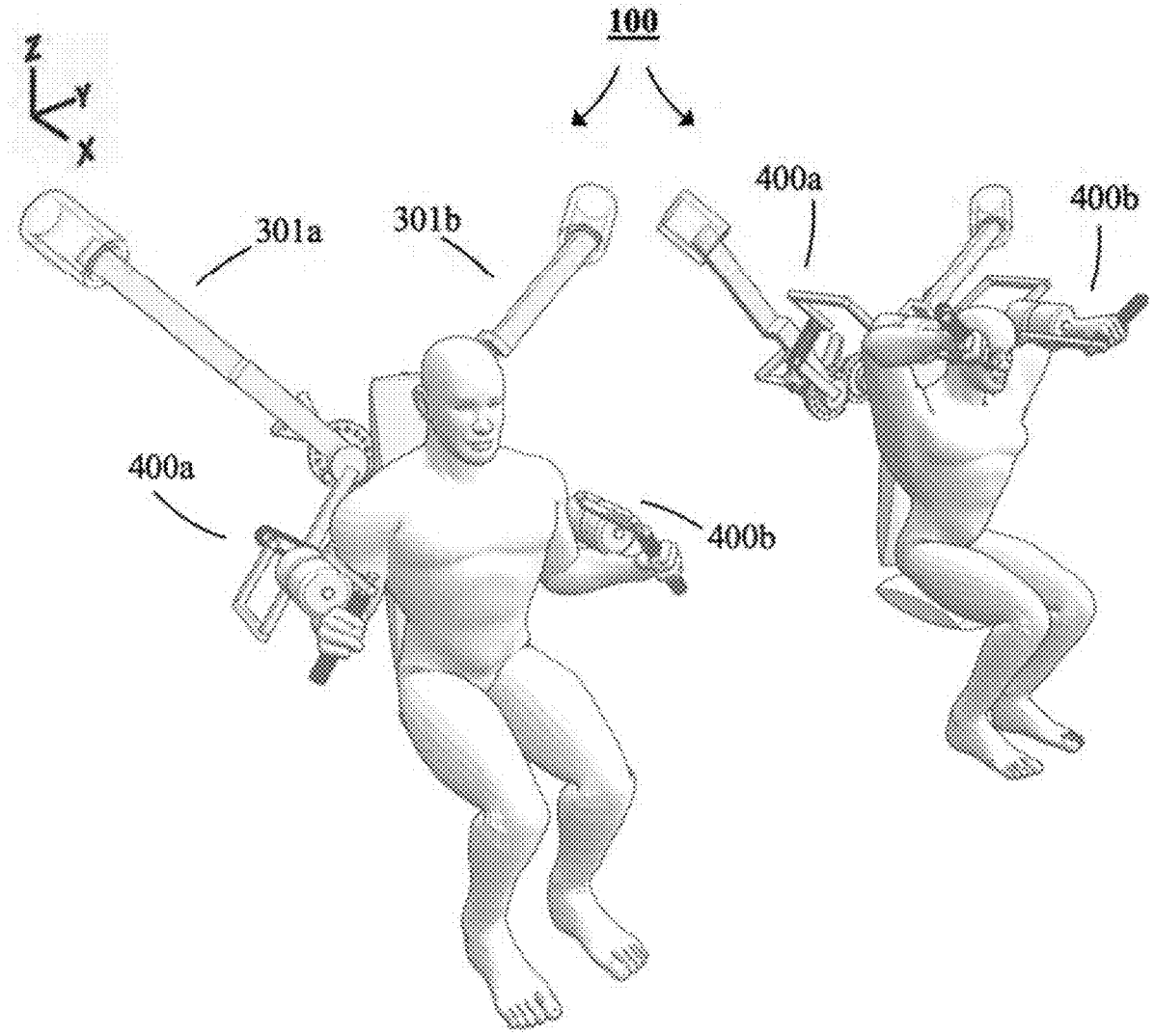
Figure 30C:
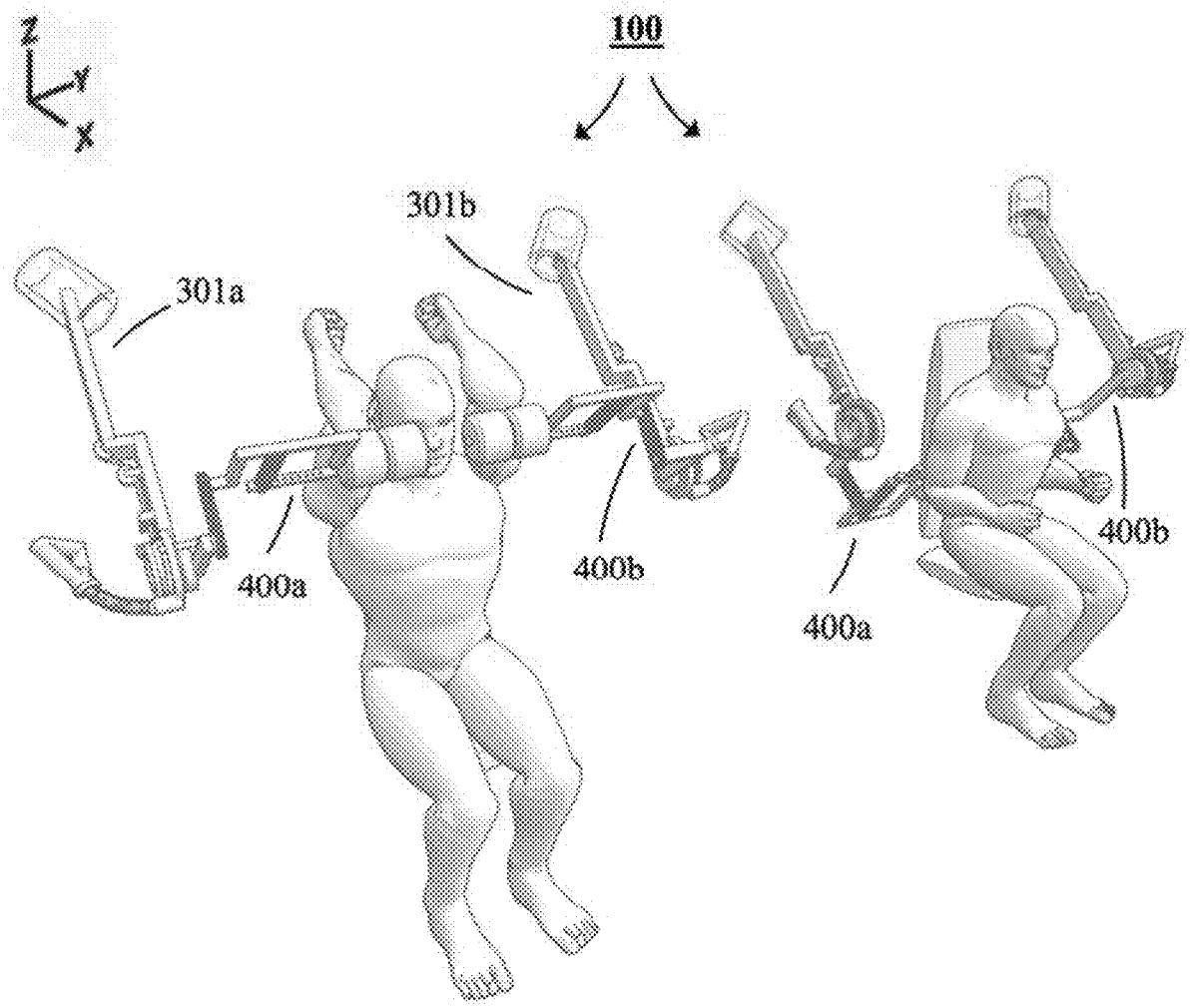
Figure 30D:
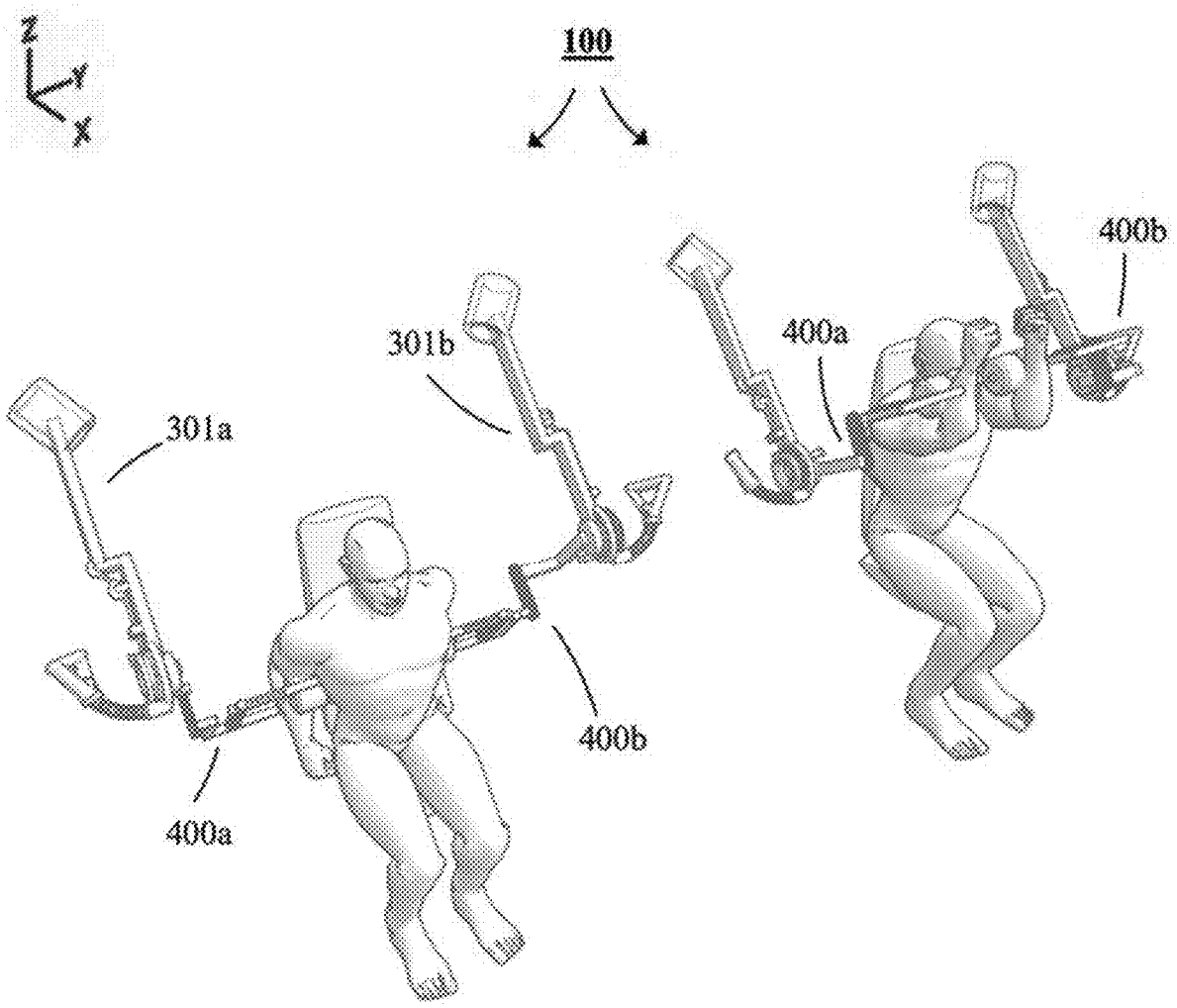

FIGS. 30*a-d* depict the start and finish positions, respectively, of external shoulder exercise apparatus 100 in the three major exercise planes for one direction of the exercise stroke (with FIGS. 30*c* and 30*d* showing both directions for clarity).

FIG. 30*a* shows rotation of secondary armatures 301*a* and 301*b* about the z-axis corresponding to exercise mainly of the pectoralis muscle. The reverse motion would begin with the end position shown and end with the start position, exercising mainly the upper back.

FIG. 30*b* shows rotation of secondary armatures 301*a* and 301*b* about the x-axis corresponding to exercise mainly of the lateral deltoid muscle. The reverse motion would begin with the end position shown and end with the start position, exercising mainly the lower pectoralis and latissimus dorsi.

FIG. 30*c* shows rotation of secondary armatures 301*a* and 301*b* about the y-axis corresponding to exercise mainly of the upper back and upper chest. For this case the reverse motion is shown in FIG. 30*d*. This motion would mostly work the anterior deltoids.

Internal and External Shoulder Exercise Apparatus ("Atlas")

In many respects, internal and external shoulder exercise apparatus ("Atlas") according to embodiments described herein is largely the same as external shoulder exercise apparatus and its various embodiments previously described. There are differences, with the discussion below and accompanying figures focusing on the differences.

Figure 31A:
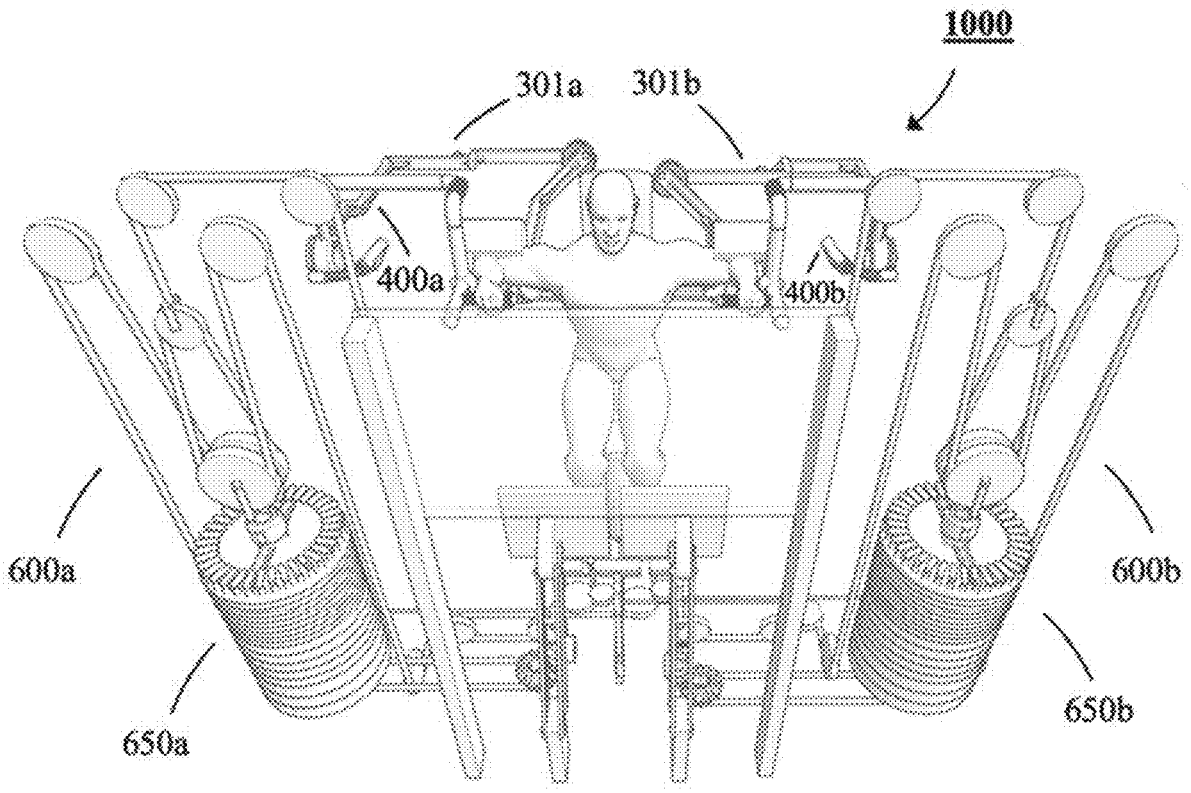
FIGS. 31*a-e* depict multiple views of an internal and external shoulder exercise apparatus according to an embodiment.
Figure 31B:
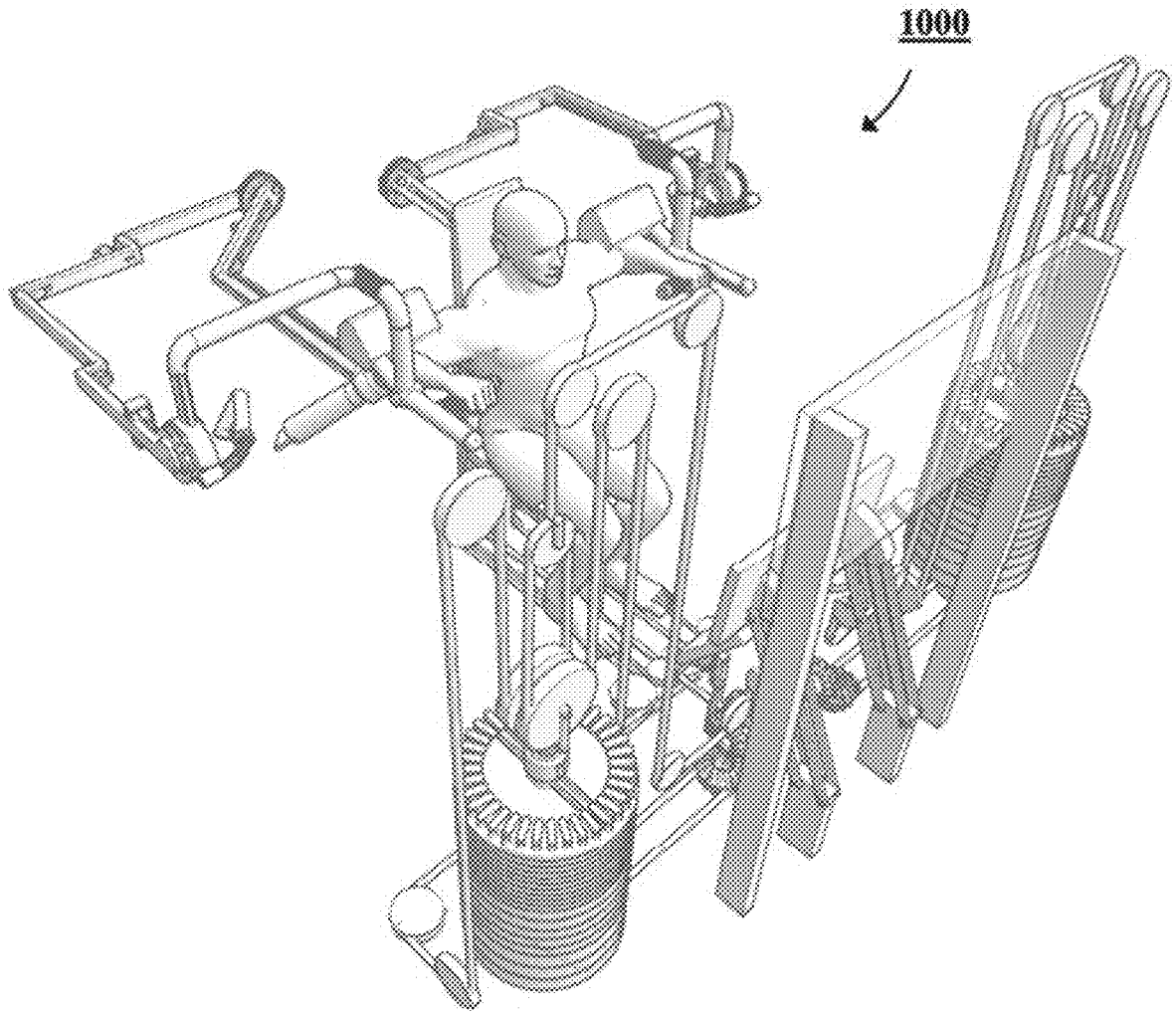
Figure 31C:
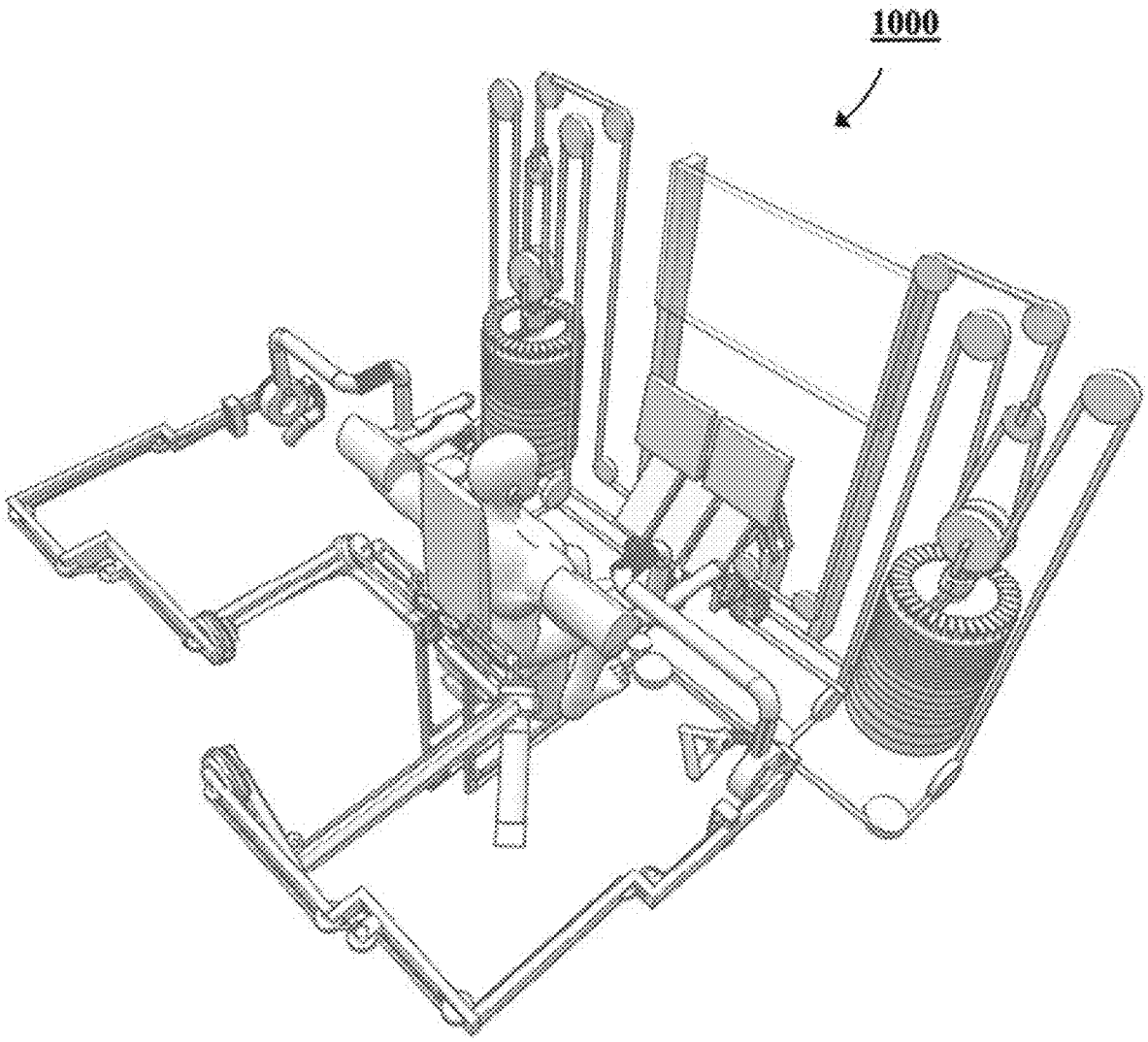
Figure 31D:
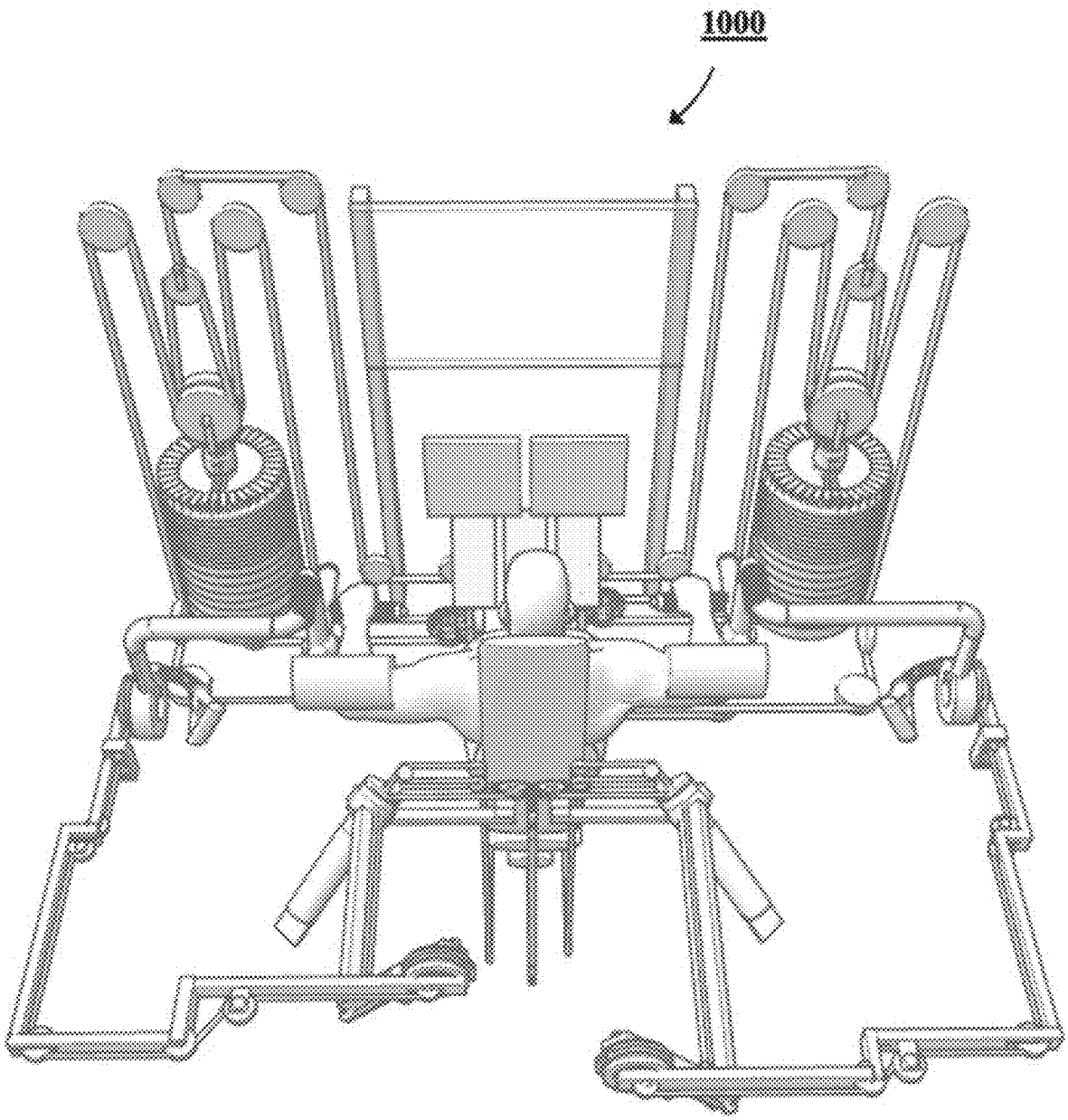
Figure 31E:
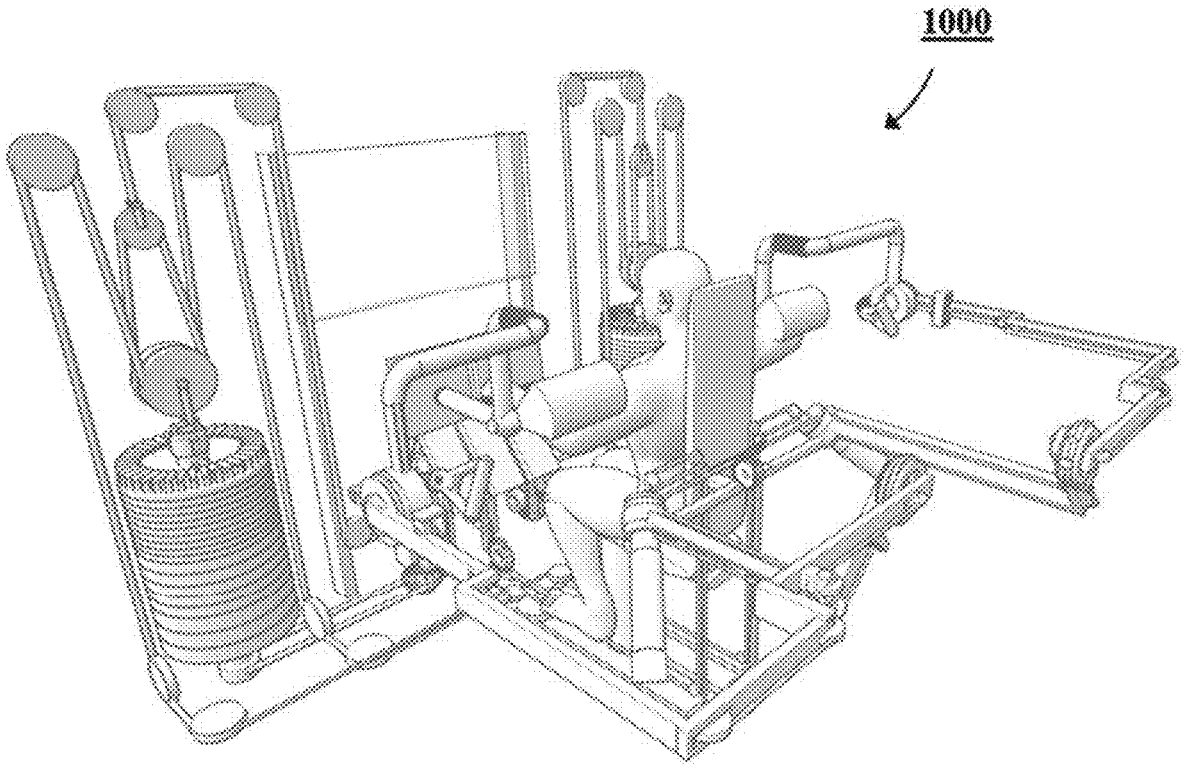

FIGS. 31*a-e* depict multiple views of internal and external shoulder exercise apparatus 1000. As shown in FIGS. 31*a* and 31*b*, internal and external shoulder exercise apparatus 1000 comprises secondary armatures 301*a* and 301*b* and primary armatures 400*a* and 400*b*, as well as weight assemblies 600*a* and 600*b*, which comprise weight stacks 650*a* and 650*b*, respectively, as described in connection with the external shoulder exercise apparatus 100.

Positioned at the front of a user position, in one embodiment, is video monitor 110 that is connected electronically to internal and external shoulder exercise apparatus 1000. Through a monitor the user is able to view a variety of displayed information such as repetitions, weight, exercise type, resting period, vital signs, scenery traveled through, game interface, virtual instructor, television programming movies, streaming entertainment, exercise dynamics (weights, repetitions, rest time, total exercise time, vitals), training, interactive games, and team competitions.

Figure 32A:
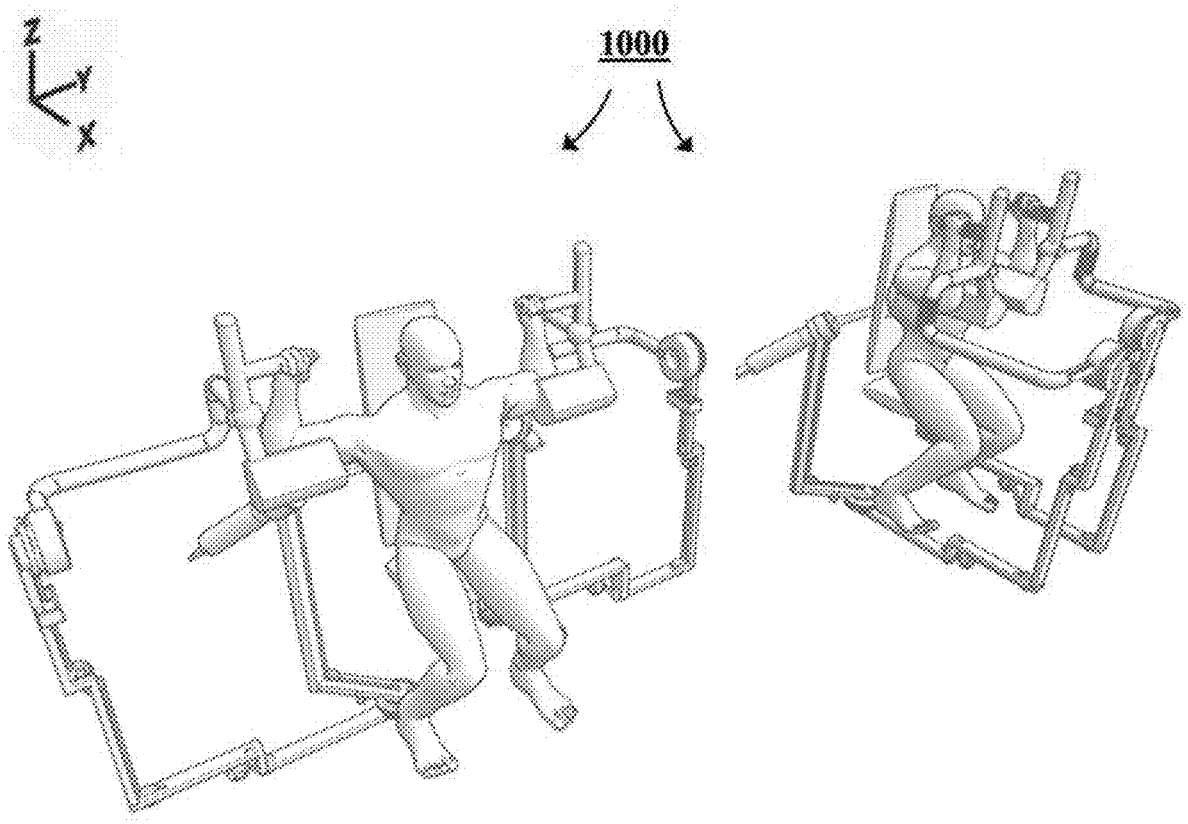
FIGS. 32*a-c* depict start and finish positions, respectively, of an internal and external shoulder exercise apparatus for the three major external muscle exercises rotating about the z, y, and x-axes, respectively according to an embodiment.
Figure 32B:
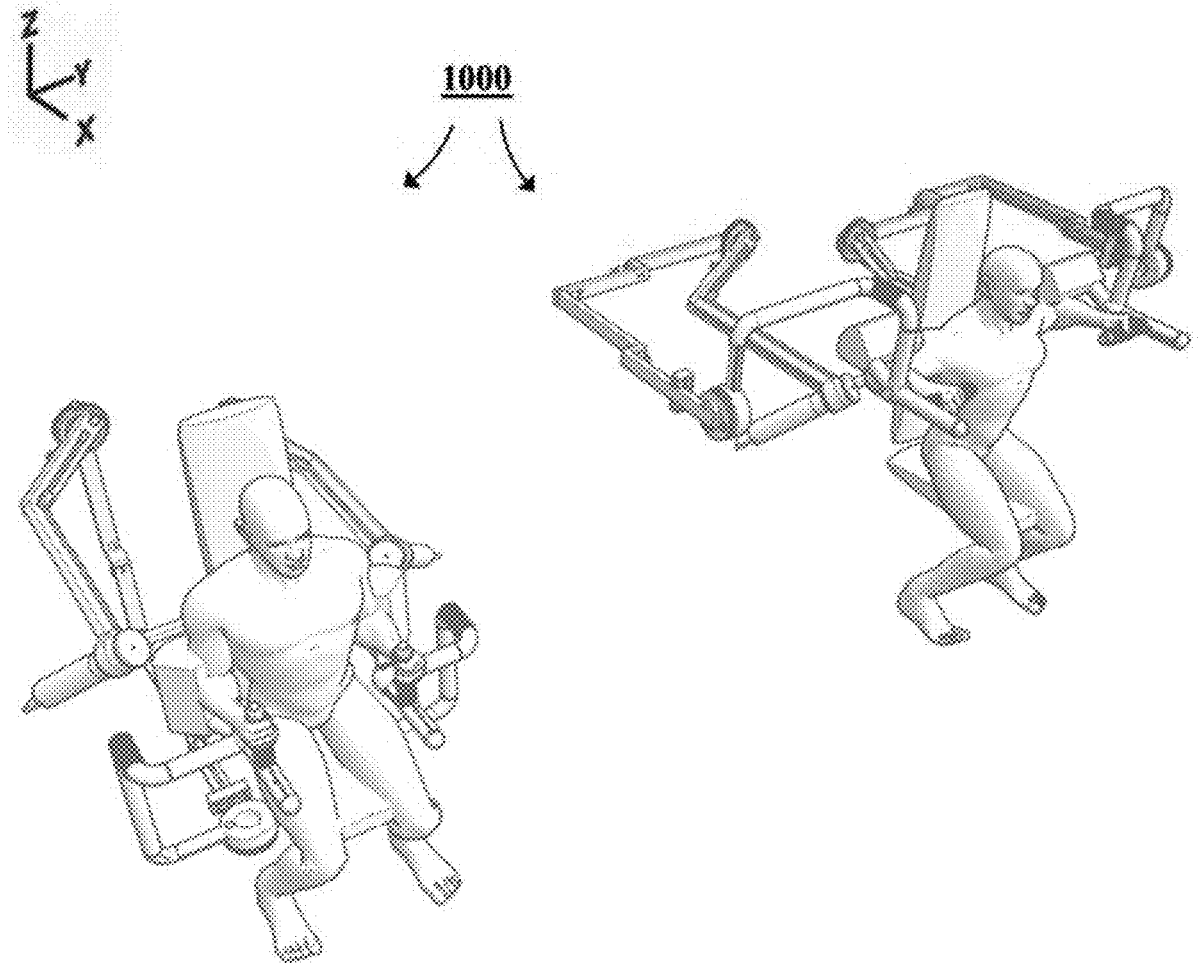
Figure 32C:
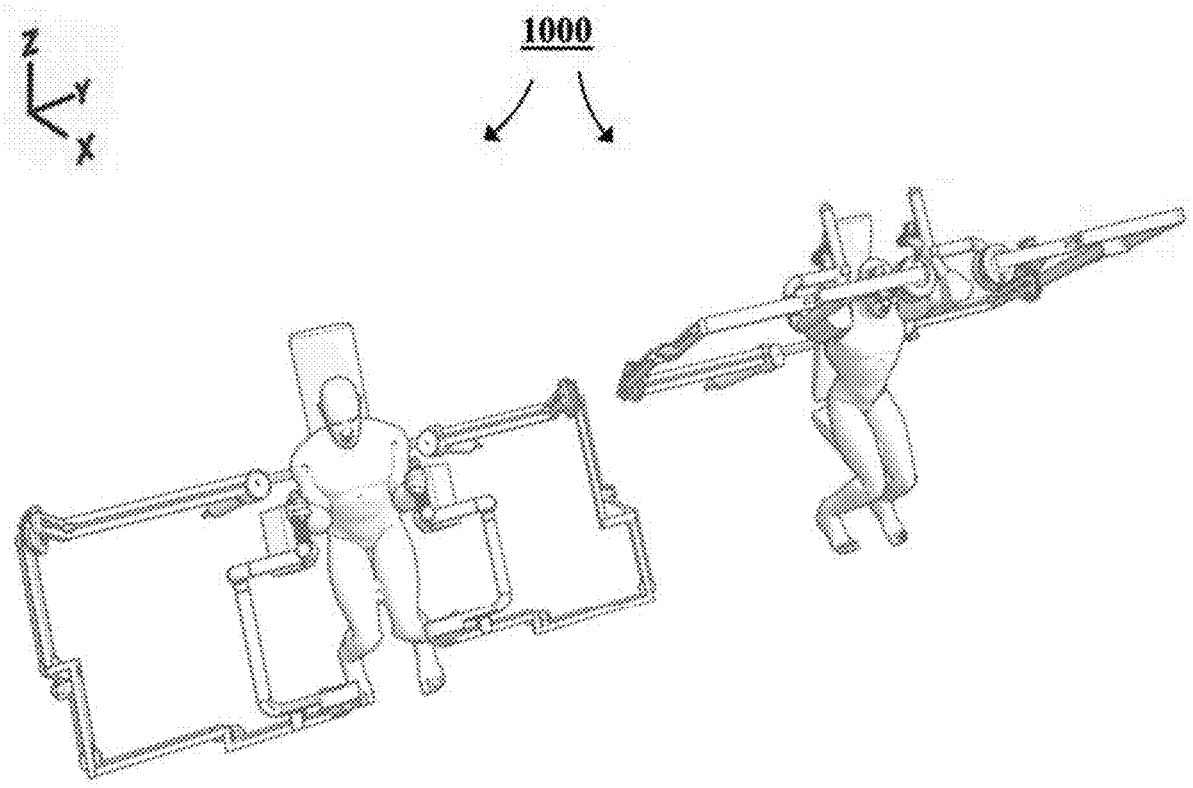

FIGS. 32*a-c* depict start and finish positions, respectively, of an internal and external shoulder exercise apparatus for the three major external muscle exercises rotating about the z, y, and x-axes, respectively according to an embodiment. FIGS. 32*a-c* are diagrams showing the start and finish positions, respectively, the Atlas apparatus 1000 for the three major external muscle exercises rotating about the z, y, and x-axes, respectively. As with the external shoulder exercise apparatus 100, the user may exercise in the opposite direction of movement for each of the three exercises shown.

Figure 33:
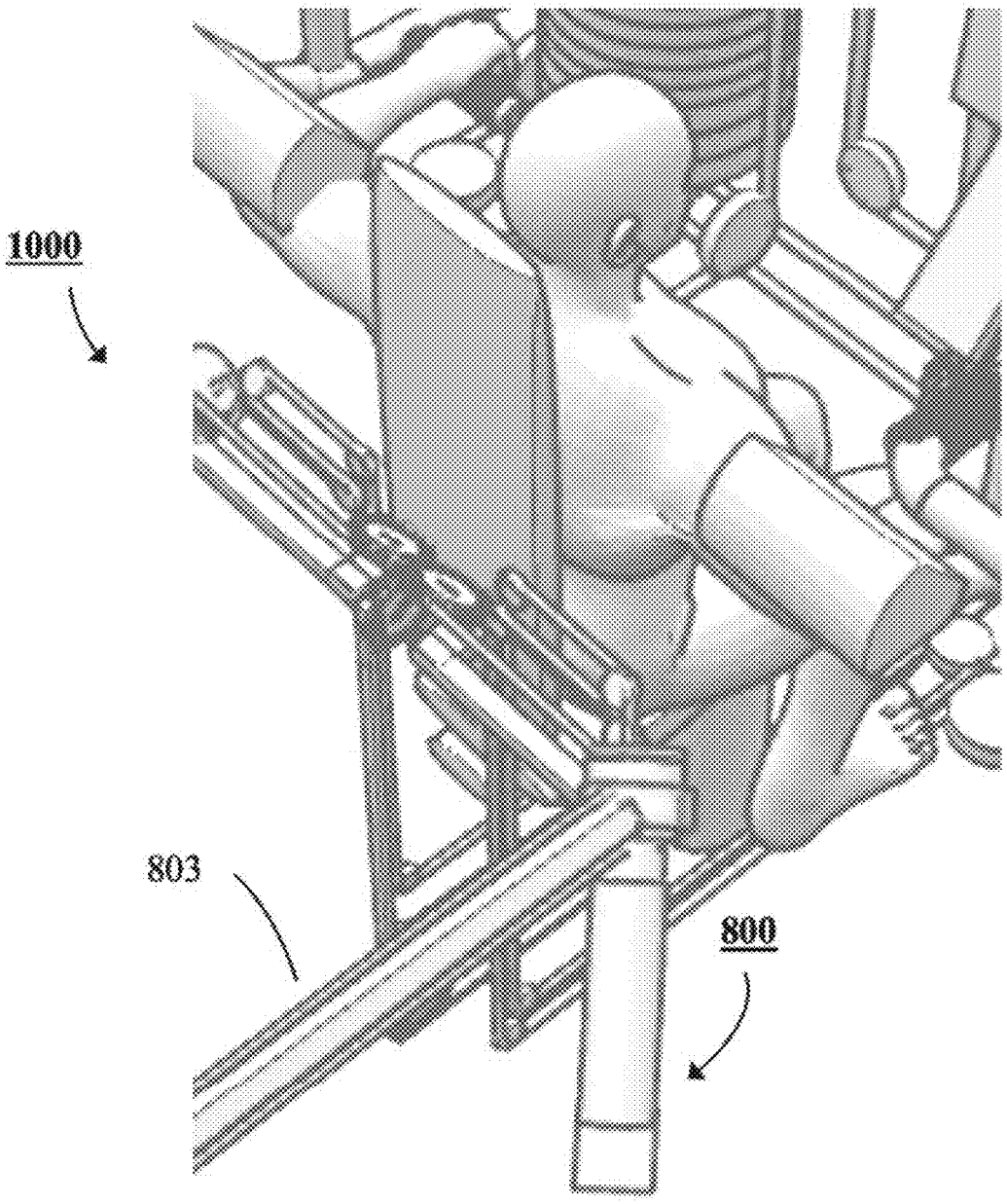
FIG. 33 is a close up view of an axis support of an internal and external shoulder exercise apparatus according to an embodiment.

FIG. 33 is a blowup of exterior shoulder exercise apparatus 1000, with (1,1,1) axis support 800. This allows tertiary armature 803 to point at the users' humeri. (Armature 803 corresponds to the A5 armature shown later.) Axis support 800 is different than the axis support for external shoulder exercise apparatus 100 as axis support 800 includes a straightener to keep the two cables (one for the external muscle exercises and one for internal muscle exercises) from twisting on each other.

Figure 34:
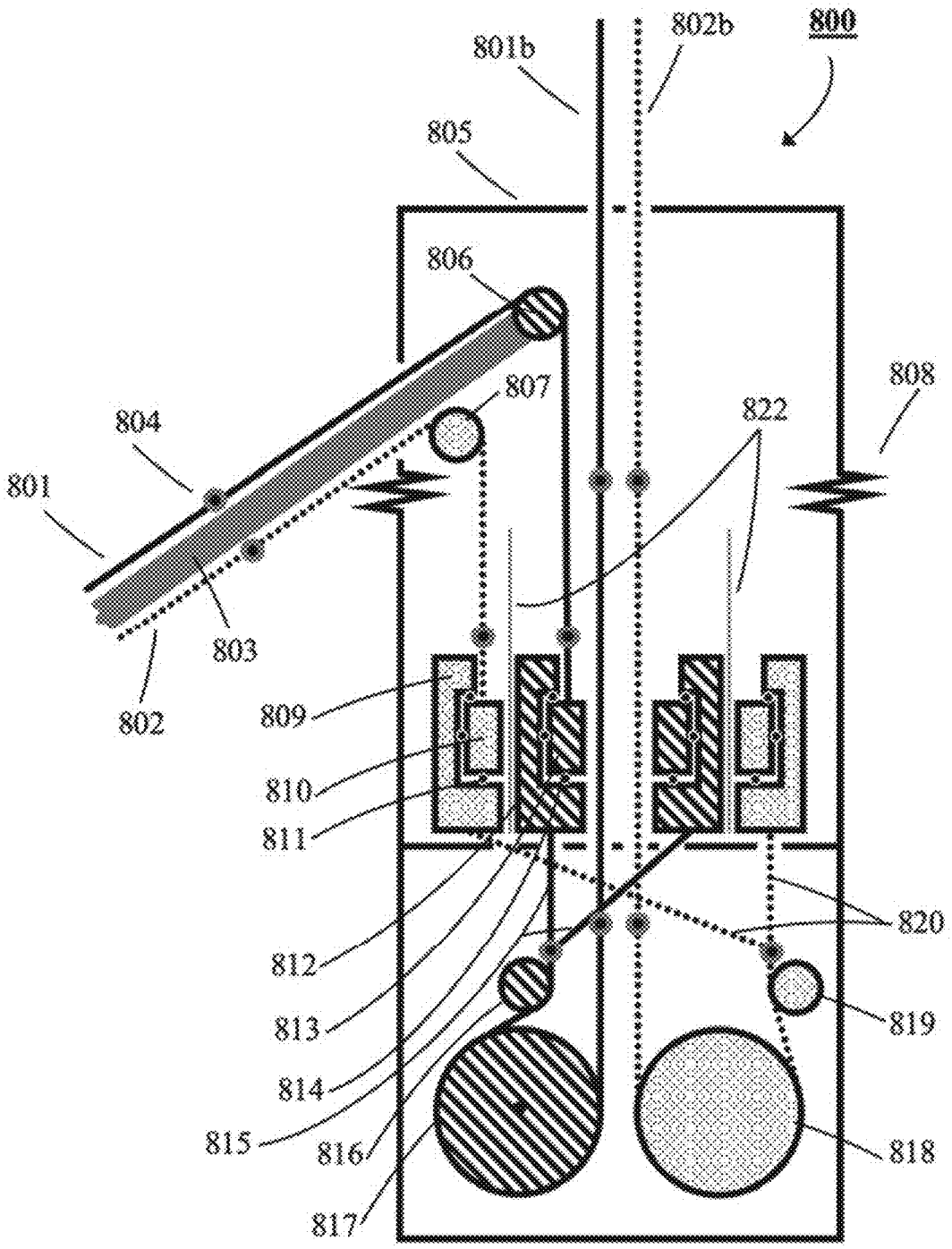
FIG. 34 is a cross sectional, detailed view of an internal and external shoulder exercise apparatus axis support according to an embodiment.

FIG. 34 depicts a cross-sectional, detailed view of (1,1,1) of axis support 800. Support structures are removed to show the mechanics of the apparatus. One function of axis support 800 is to keep rotator cuff cable 801 and main cable 802 from twisting on each other as the tertiary armature 803, rotates 360 degrees. Housing 805 of axis support 800 remains fixed. For a given position of tertiary armature 803 rotator cuff cable 801 (solid line representing the cable operating the rotator cuff exercises) runs over first axis support pulley 806 to connect with first inner disk 813. First inner disk 813 is imbedded concentrically in first C-shaped cylinder 812. When central axis arm 803 rotates, first inner disk 813 slides inside of first C-shaped disk 812. First C-shaped cylinder 812 connects to a corresponding first cylindrical section 815. First cylindrical section 815 connects to a rotator cuff continuation cable 801*b* that wraps around second axis support pulley 816 and third axis support pulley 817. Rotator cuff continuation cable 801*b* emerges vertically from housing 805, parallel to main continuation cable 802*b*. For illustrative purposes, the height of housing 805 is dramatically shortened.

Similarly, for a given position of central axis arm, 803, main cable 802 (dotted line representing the cable operating the main shoulder exercises) runs over fourth axis support pulley 807 to connect with first outer disk 810. First outer disk 810 is imbedded concentrically in second C-shaped cylinder 809. When tertiary armature 803 rotates, first outer disk 810 slides inside corresponding second C-shaped cylinder 809. Second C-shaped cylinder 809 connects to second cylindrical section 820. Second cylindrical section 820 connects to a main continuation cable 802*b*, which is an extension of main cable 802. Main continuation cable 802*b* wraps around fifth axis support pulley 819 and sixth axis support pulley 818. Main continuation cable 802*b* emerges vertically from housing 805, parallel to rotator cuff continuation cable 801*b*.

Multiple ball bearing rings allow the components to slide on each other and central cylinder 822 allows the inner and outer structures to slide on each other.

Figure 35:
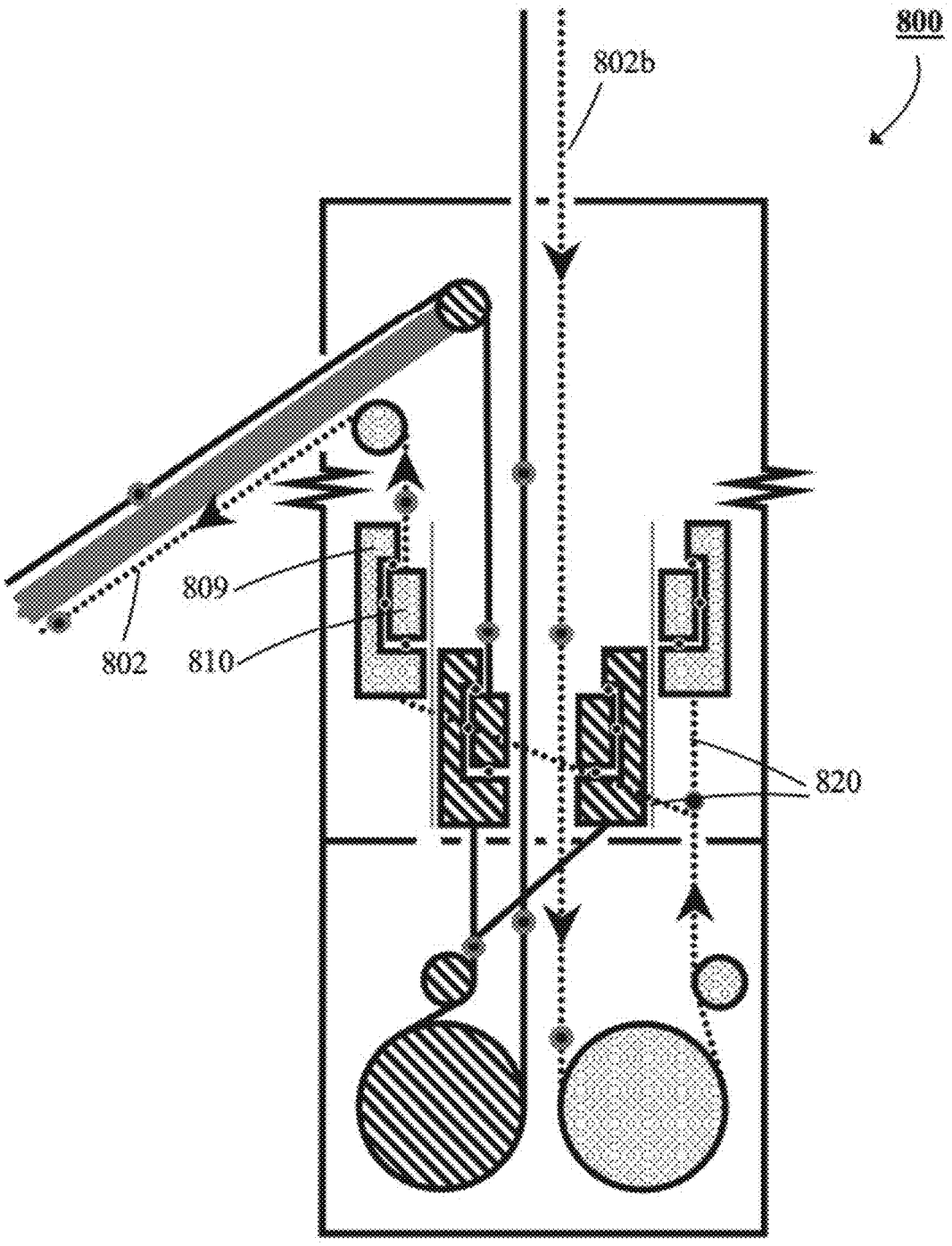
FIG. 35 is a cross sectional, detailed view of an internal and external shoulder exercise apparatus axis support according to an embodiment.

FIG. 35 depicts an embodiment of axis support 800 after movement caused by traction on main cable 802. Main cable 802 pulls up on first outer disk 810 simultaneously elevating outer C-shaped cylinder 809, which lifts second cylindrical section 820, pulling down on continuation main cable 802*b* that lifts the main shoulder weight stack.

Figure 36:
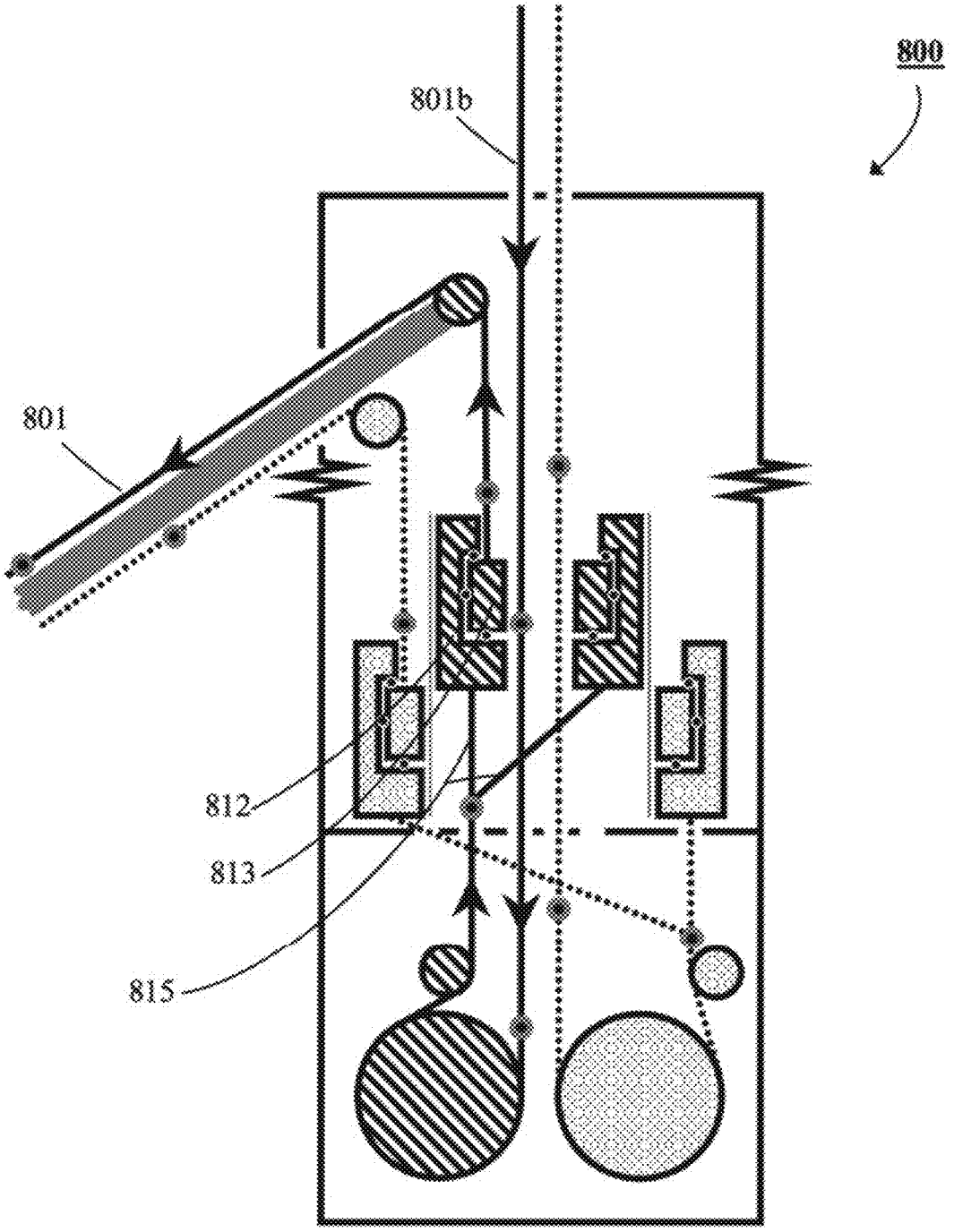
FIG. 36 is a cross sectional, detailed view of an internal and external shoulder exercise apparatus axis support according to an embodiment.

FIG. 36 like FIG. 35 depicts internal axis support 800 changes with traction on rotator cuff cable 801. Rotator cuff cable 801 pulls up on first inner disk 813 simultaneously elevating inner C-shaped cylinder 812 which lifts first cylindrical section 815, pulling down on continuation rotator cuff cable 801*b* that lifts the rotator cuff weight stack.

Figure 37:
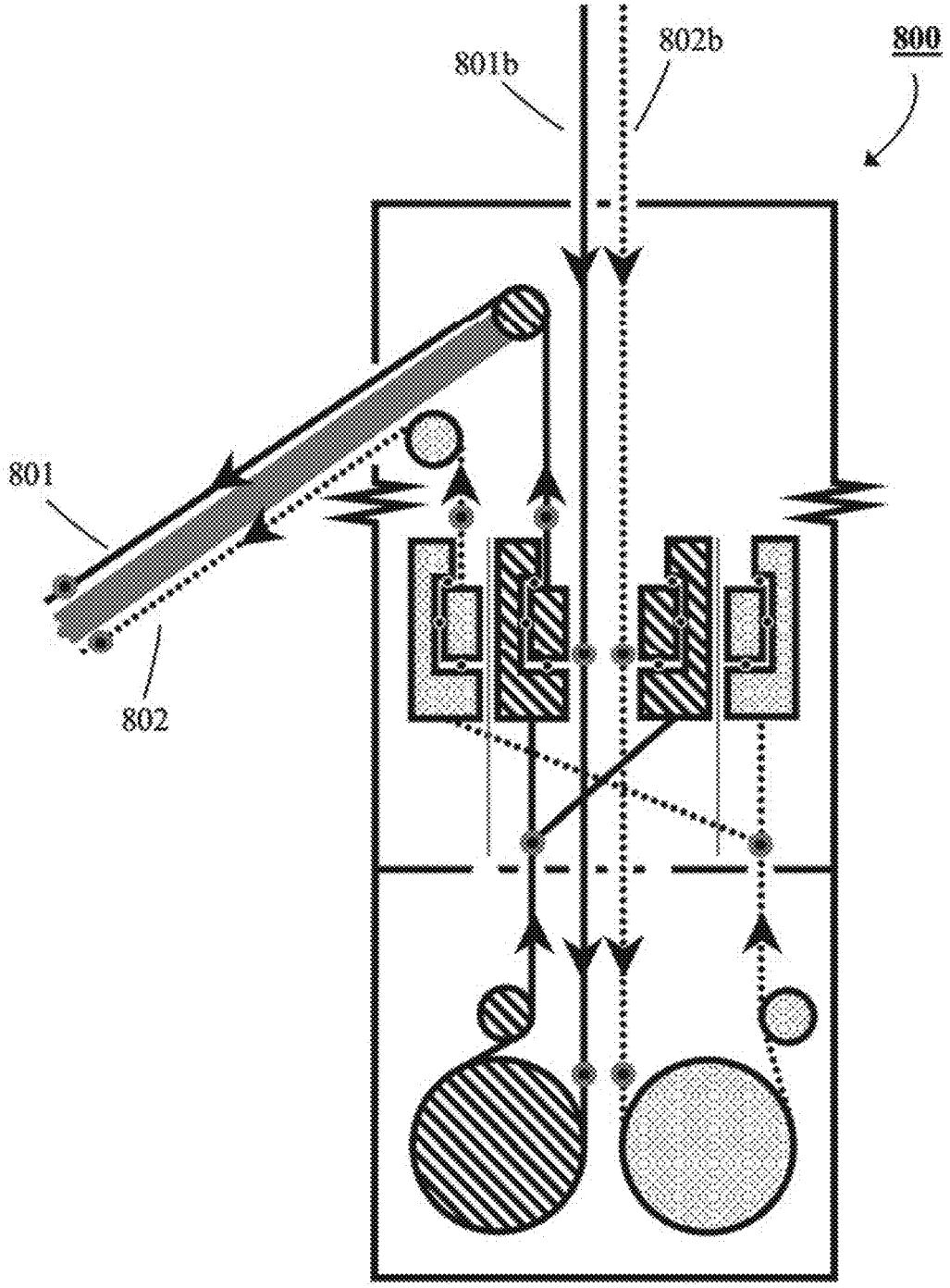
FIG. 37 is a cross sectional, detailed view of an internal and external shoulder exercise apparatus axis support according to an embodiment.

FIG. 37 depicts both the rotator cuff cable and main cable simultaneously pulled.

Figure 38:
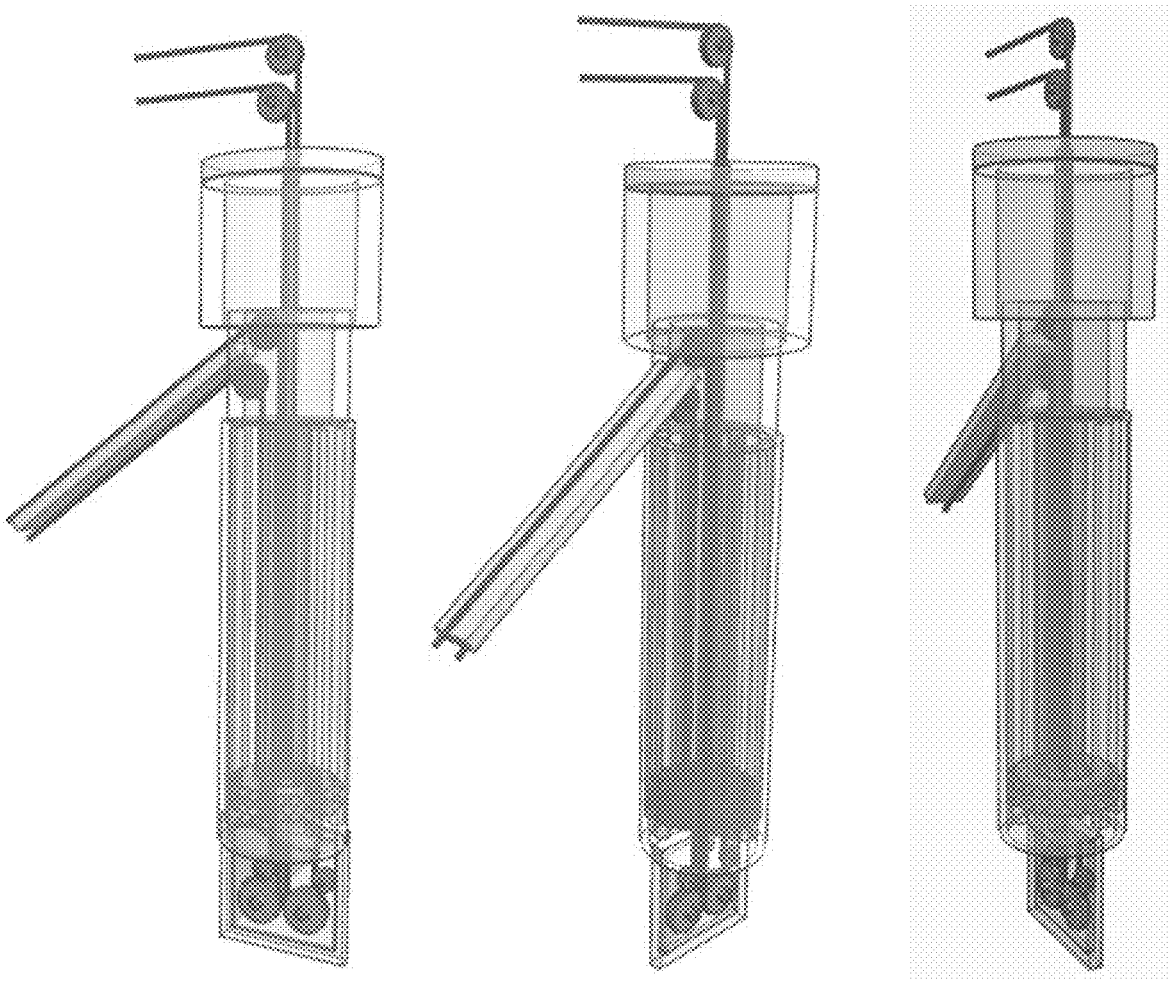
FIG. 38 is a perspective view of an internal and external shoulder exercise apparatus axis support according to an embodiment.

FIG. 38 depicts a three-dimensional drawing of axis support 800 from three angles (1,1,1).

Figure 39:
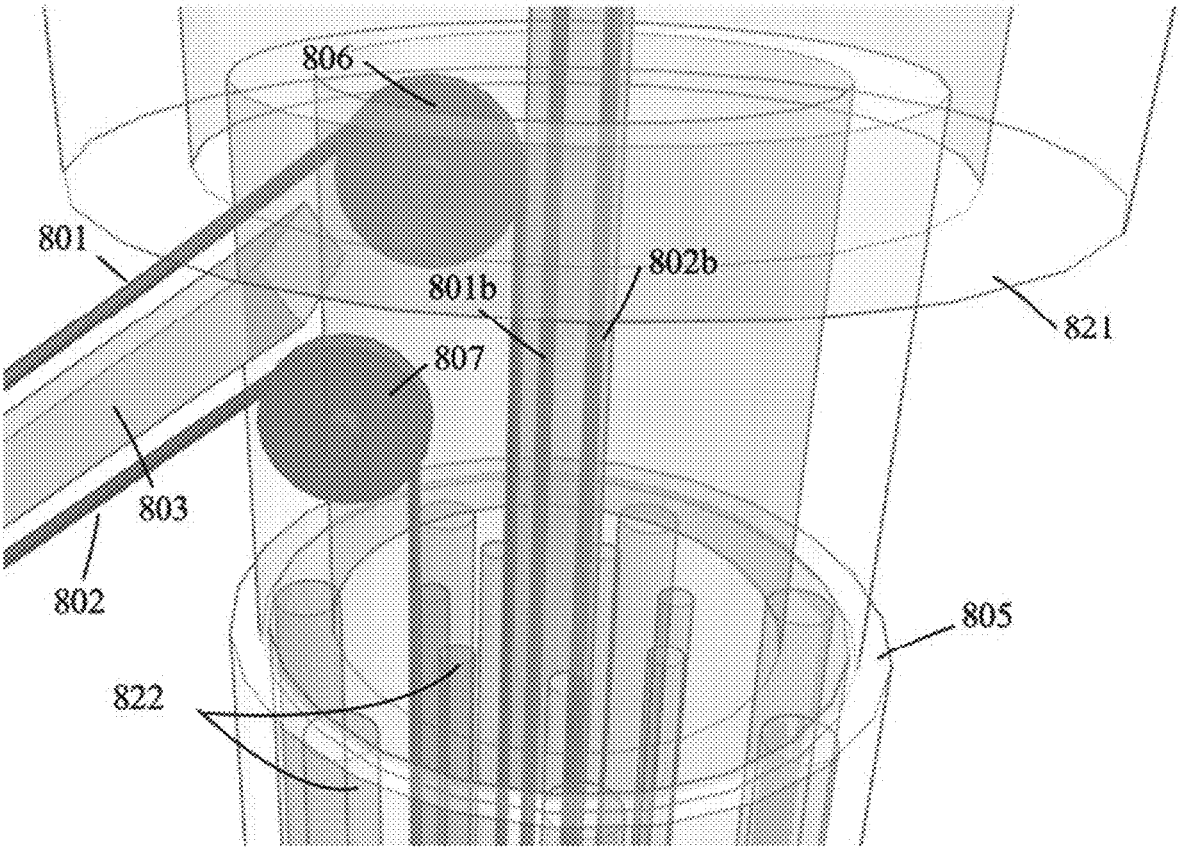
FIG. 39 is a partially transparent view of the top of an internal and external shoulder exercise apparatus axis support according to an embodiment.

FIG. 39 provides a partially transparent view of the top of axis support 800. Previously discussed central axis arm 803, inserts into rotating disk 821 while housing 805 remains fixed. Rotating disk 821 rotates on housing 805. Sliding guides 822 are associated with inner and outer C-shaped disks.

Figure 40:
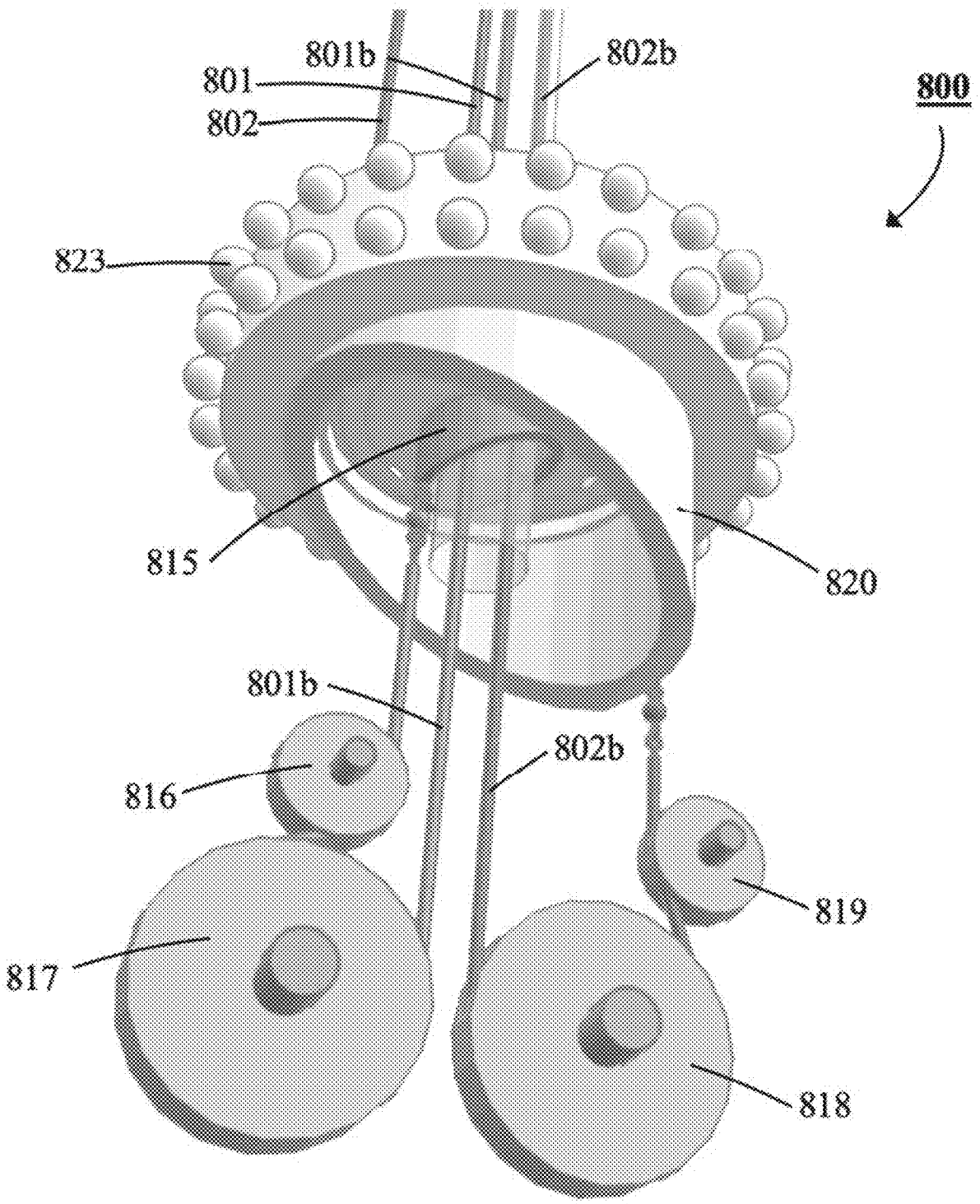
FIG. 40 is a perspective view of an internal and external shoulder exercise apparatus internal and external shoulder exercise apparatus inferior, interior section according to an embodiment.

FIG. 40 is a three-dimensional blowup of axis support 800 inferior, interior section. The outermost set of ball bearings 823 for the outer C-shaped disk is shown.

Figure 41:
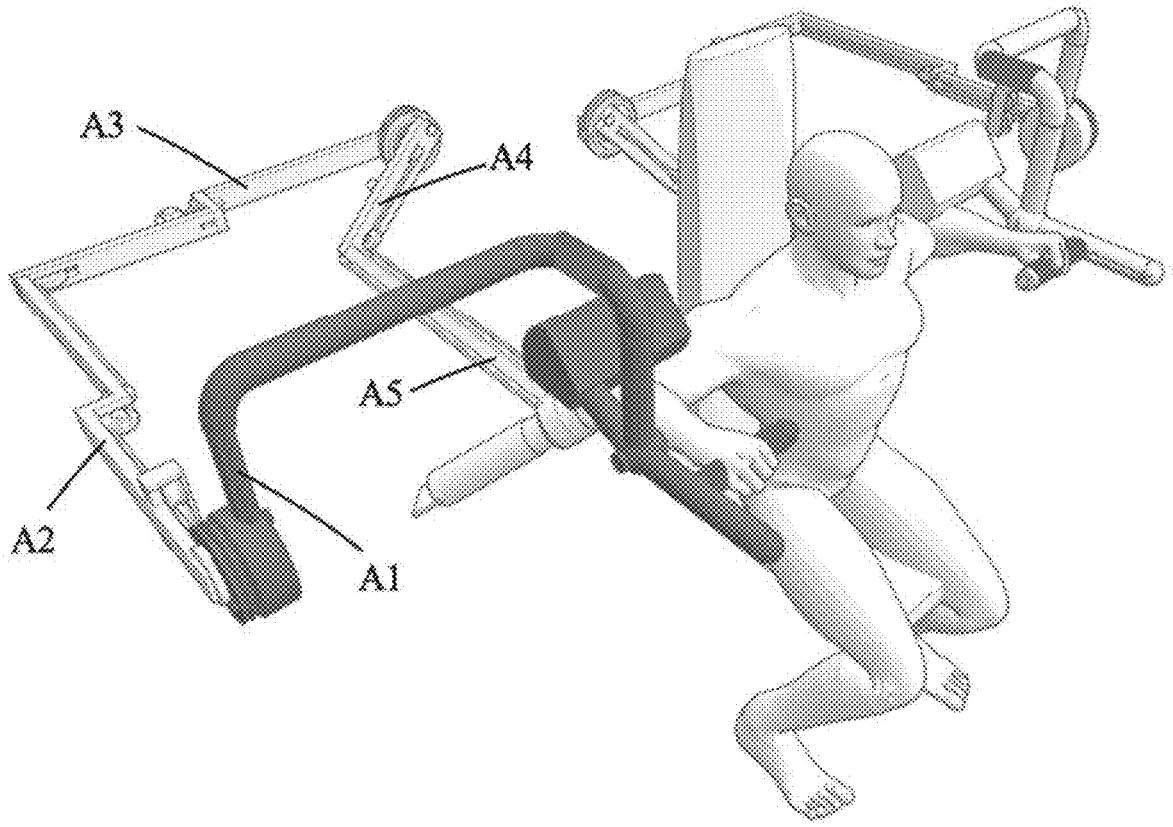
FIG. 41 is a perspective view of major armatures of an internal and external shoulder exercise apparatus according to an embodiment.

FIG. 41 is a diagram showing the five major armatures (A1-A5) of Atlas exercise apparatus 1000 for each of the right and left sides according to an embodiment. The lengths of the armatures are determined by several factors. The size and function of A1 was disclosed in U.S. patent application Ser. No. 17/714,033, filed Apr. 5, 2002, by the same inventor and incorporated herein by reference in its entirety, regarding a dedicated rotator cuff exercise machine.

While A1 provides the same function here, it additionally provides rotational usage similar to main armature 400 on exterior shoulder exercise apparatus 100 described in detail above. A2 is analogous to secondary armature 301 on Axis apparatus 100 except that it attaches to two additional armatures to get back to the (1,1,1) rectifying unit.

Figure 42:
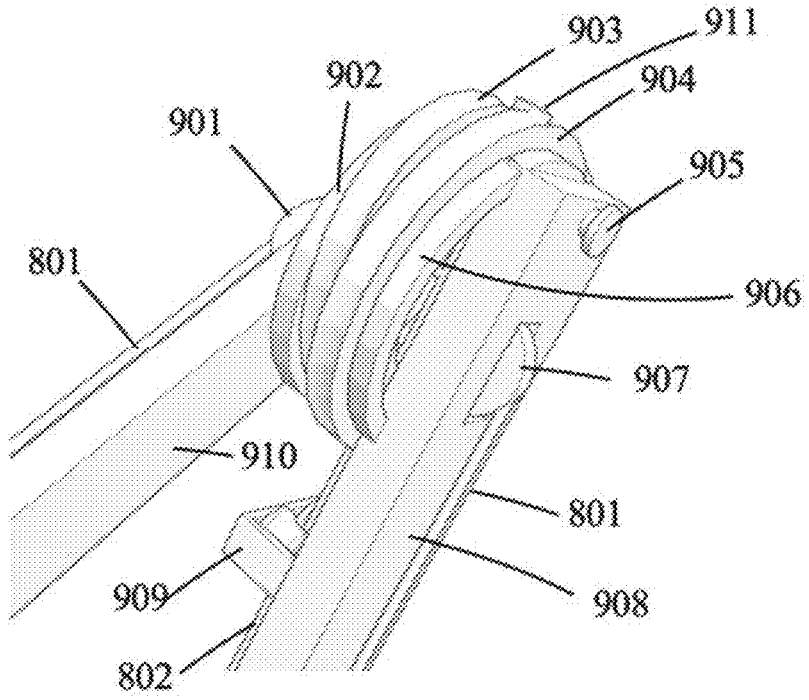
FIG. 42 is a perspective view of articulating ends of an internal and external shoulder exercise apparatus according to an embodiment.
Figure 42:
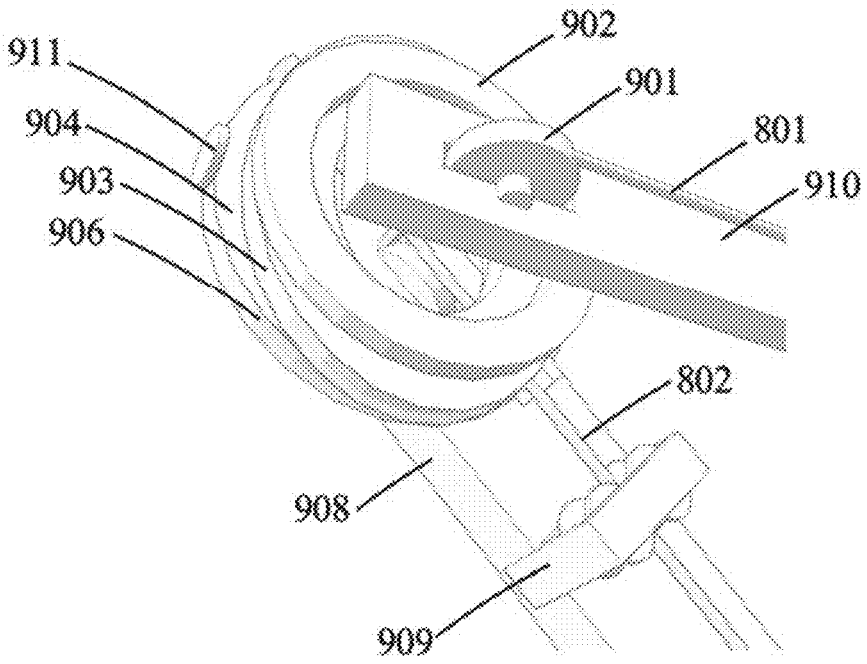

FIG. 42 provides a blowup view of articulating ends of A3 and A4 from each side. A3 connects to A4 with a similar connector except that it adds rotator cuff cable 801 through the connector allowing the cable associated with rotator cuff exercise to traverse a mechanism like the rotating disk portion of main armature 301*a* of Atlas apparatus 100. Rotator cuff cable 801 goes around first pulley 901, through rotating disks 903 and 904, through fixed disks 902 and 906, around second pulley 907, and on to armature A5. Rotating disks 903 and 904 create tension for the main pulley connecting to main cable 802, and on to armature A5. Armature A5 was previously discussed when describing the (1,1,1) mechanism. Note that all five of the A1-A5 armatures are adjusted for length so that no part of either armature group collides as A5 rotated about the (1,1,1) axis. Note that that function of this arrangement is similarly improved by substitution of the embodiments described in FIGS. 16-21.

Figure 43:
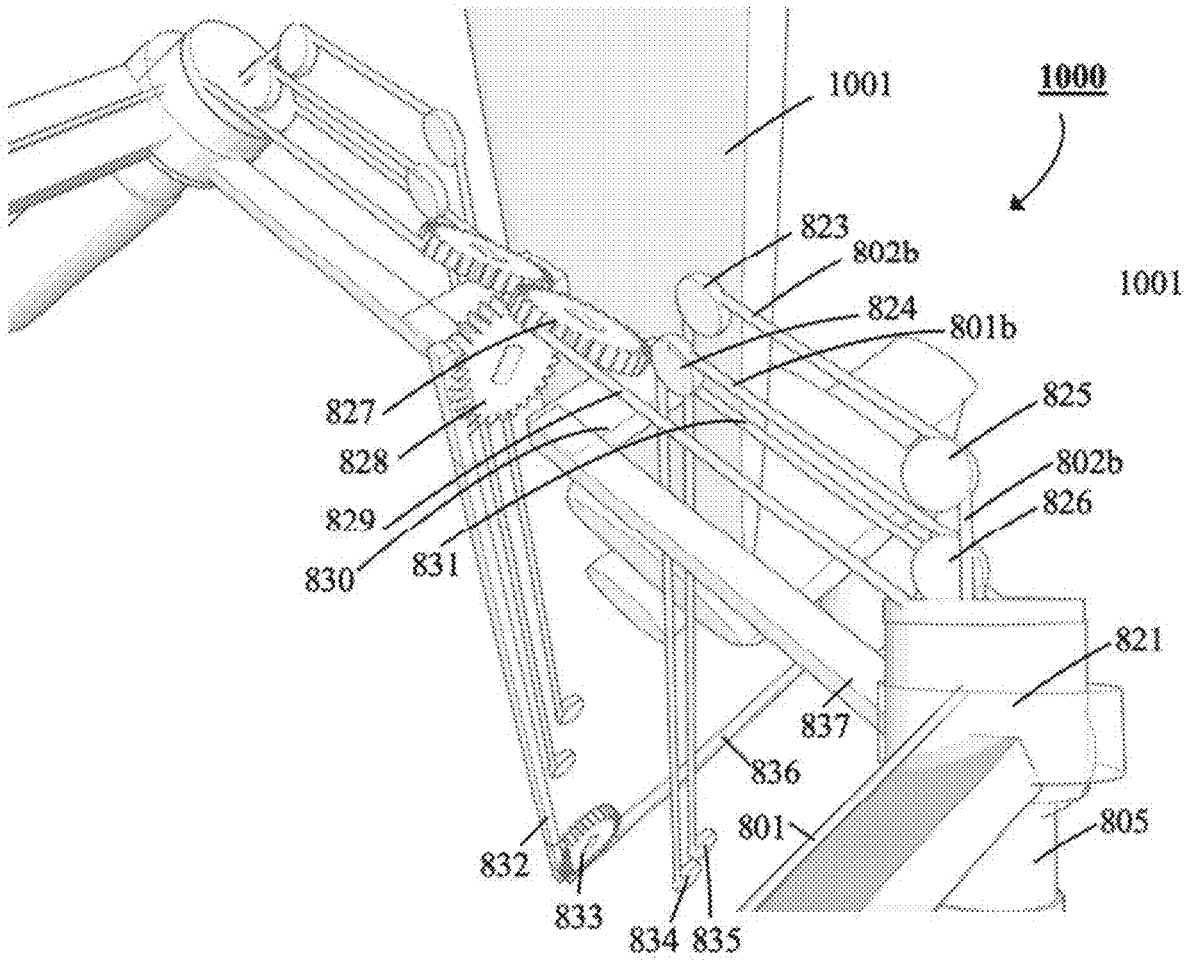
FIG. 43 is a perspective view of a cable management mechanism and rotational position selector of an internal and external shoulder exercise apparatus according to an embodiment.

FIG. 43 depicts the mechanism behind the user's seat managing the cables, bilaterally, from the rotator cuff and main exercises, together with the midline system that selects the rotational position of the A5 armature articulating with the (1,1,1) apparatus. The system is symmetric, right and left, so only one side will be described in additional to the midline system.

Regarding the rotator cuff cable 801 and main cable 802, emerging from the top of the (1,1,1) Atlas apparatus 1000 are the cables from the rotator cuff and main exercises, 801*b* and 802*b*, respectively. Cable 802*b* travels over pulley 825 to pulley 823 down to pulley 835, then forward to the weight stack like that of Axis apparatus 100. Cable 801*b* travels over pulley 826 to pulley 824 down to pulley 834, then forward to the weight stack like the Axis machine.

Regarding the midline system, small rotations of the cog 833 are provided by foot pedals from the front similar to that of Axis 100. These small rotations are translated through rack 832 to cog 828. These rotations are transmitted to cog 827 (and to the other side). Cog 827 rotates to pull on cables 829 and 831 to rotate housing 821 in small angular increments. Supports 830 and 837 are support structures for the (1,1,1) apparatuses.

The anterior system of Atlas 1000 consisting of the weight stack, pulley system, video screen 110, and pedal systems are the same at that of Axis 100, with the exceptions of an additional weight stack and two additional foot pedals to select the additional weight stack and weight assist pedal.

The above summary is not intended as an exhaustive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed description. Although various embodiments of the present disclosure have been illustrated in the accompanying drawings and described in the foregoing Detailed Description, it will be understood that the present system is not limited to the embodiments disclosed, but is capable of numerous rearrangements, modifications, and substitutions without departing from the spirit of the system as set forth and defined herein.

What is claimed is:

1. A mechanical exercise apparatus for resistance exercise of exterior shoulder muscles, comprising:

a primary armature;

a secondary armature, wherein a proximate end of the secondary armature is connected with the primary armature;

a handle disposed on the primary armature, parallel to the secondary armature;

a hub connected to a distal end of the secondary armature connecting the secondary armature rotatably to a frame assembly;

a weight stack comprising a plurality of selectable weight plates;

a main cable guided by a plurality of pulleys disposed on the secondary armature and a frame assembly, the main cable terminating at a weight stack;

a plurality of mode selection disks disposed on the secondary armature; and a mode selection disk pin for selectably engaging between a first mode of main cable travel requiring constant force to displace the weight stack and a second mode of main cable travel requiring varying force to displace the weight stack, wherein angulation of the primary armature causes multiple planes of motion of the primary armature and secondary armature, wherein angulation of the primary armature causes the main cable to raise selected engaged weight plates on the weight stack, and wherein the primary armature and the secondary armature are connected by a fixed chain and a sprocket connector.

2. The mechanical exercise apparatus of claim 1, further comprising an assist cable connected on a first end to an assist pedal, the assist pedal depressible during articulation of the primary armature, and on a second end to the weight stack, wherein tension on the assist cable is increased when the assist pedal is depressed, causing lifting of the weight stack;

wherein angulation of the primary armature causes multiple planes of motion of the primary armature and secondary armature.

3. The mechanical exercise apparatus of claim 1, wherein the plurality of weight plates is vertically arranged to form the weight stack, wherein each of the plurality of weight plates is arranged vertically according to a weight of the each of the plurality of weight plates with the lightest weight plate among the plurality weight plates positioned at a top end of the weight stack and the heaviest weight plate among the plurality of weight plates positioned at the bottom end of the weight stack.

4. The mechanical exercise apparatus of claim 1, further comprising a weight selection carriage disposed at a top end of the weight stack.

5. The mechanical exercise apparatus of claim 4, further comprising a plurality of C-shaped rods each having a top end and a bottom end imbedded concentrically within the weight stack, each C-shaped rod top end detachably engageable with the weight selection carriage.

6. The mechanical exercise apparatus of claim 5, further comprising a rotatable hub disposed at a center of the weight stack with the weight selection carriage connected thereto; and a visual display window disposed within the rotatable hub for display of an amount of weight selected for exercise according to a position of the weight selection carriage.

7. The mechanical exercise apparatus of claim 6, further comprising a plurality of holes disposed on the perimeter of each of the plurality of weight plates for engaging the plurality of C-shaped rods.

8. The mechanical exercise apparatus of claim 4, further comprising a weight selection pedal;

at least one rack and pinion assembly;

and a weight pedal selection cable in communication with the weight selection pedal, wherein activation of the weight selection pedal rotates the weight selection carriage.

9. The mechanical exercise apparatus of claim 1, further comprising a video display disposed on the frame assembly.

10. The mechanical exercise apparatus of claim 9, wherein the video display displays information comprising television programs, movies, streaming entertainment, exercise dynamics (weights, repetitions, rest time, total exercise time, or vitals), training, interactive games, and team competitions.

* * * * *